US010065848B2

(12) United States Patent
Volin

(10) Patent No.: US 10,065,848 B2
(45) Date of Patent: Sep. 4, 2018

(54) UNIQUE SELF-PRESSURIZING, SELF-COOLING BEVERAGE SYSTEM, HAVING IMPACT-AND-VIBRATION-ABSORBING SYSTEMS, ANTI-SHAKING ANTI-ROLLING CLAMPING SYSTEM, ROOT-BEER-FLOAT SYSTEM, BEVERAGE-DISPENSING SYSTEM, AND MULTI-HEIGHT SPIGOT SYSTEM

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 211 days.

(21) Appl. No.: 15/288,994

(22) Filed: Oct. 7, 2016

(65) Prior Publication Data

US 2017/0101301 A1 Apr. 13, 2017

Related U.S. Application Data

(60) Provisional application No. 62/238,711, filed on Oct. 8, 2015.

(51) Int. Cl.
*B67D 1/00* (2006.01)
*B67D 1/08* (2006.01)
(Continued)

(52) U.S. Cl.
CPC ..... *B67D 1/0857* (2013.01); *B67D 1/0004* (2013.01); *B67D 1/0082* (2013.01); *B67D 1/0406* (2013.01); *B67D 1/0891* (2013.01); *F25D 3/06* (2013.01); *F25D 23/026* (2013.01); *F25D 23/028* (2013.01); *F25D 23/04* (2013.01); *F25D 23/12* (2013.01); *F25D 31/006* (2013.01);
(Continued)

(58) Field of Classification Search
CPC ..... A45C 11/20; B67D 1/06; B67D 1/0857; B67D 2210/00133; B67D 1/0004; B67D 1/0082; B67D 1/0406; B67D 1/0891; B67D 2001/0089; B67D 2001/0092; F25D 2400/38; F25D 23/026; F25D 23/028; F25D 23/04; F25D 23/12
USPC ..... 222/608–628, 146.6, 399, 129.1; 62/289
See application file for complete search history.

(56) References Cited

U.S. PATENT DOCUMENTS 3,268,199 A * 8/1966 Kordyban ..... F16F 3/10 220/632
4,194,647 A 3/1980 Spurrier
(Continued)

*Primary Examiner* — Charles P Cheyney

(57) ABSTRACT

A portable CO2 based cooler and beverage dispensing system for pressurizing and cooling beverage tanks, comprises a vibration-absorbing portable shell with a snap on removable tray for holding beverage containers and ice-cream-recesses, two growler-vibration-absorbing circular springs molded on the shell bottom for absorbing vibration from transportation and for holding and separating two beverage tanks, a tank-vibration-absorbing circular spring molded on the shell bottom for absorbing vibration from transportation and for holding a pressurized tank, a clamping system for clamping on and stabilizing two beverage growlers and a pressurized tank for transportation, two multi-height spigots, two height-adjustable telescopic posts, and a retractable height-adjustable spigot-locking handle attached the two posts and having two spigot-locking receptacles molded thereon for locking and adjusting the multi-height spigots to multiple different heights.

19 Claims, 57 Drawing Sheets

(51) Int. Cl.

| | |
|---|---|
| ***B67D 1/04*** | (2006.01) |
| ***F25D 3/06*** | (2006.01) |
| ***F25D 23/12*** | (2006.01) |
| ***F25D 23/02*** | (2006.01) |
| ***F25D 23/04*** | (2006.01) |
| ***F25D 31/00*** | (2006.01) |

(52) U.S. Cl.
CPC ..... *B67D 2001/0089* (2013.01); *B67D 2001/0092* (2013.01); *F25D 2303/081* (2013.01); *F25D 2331/806* (2013.01); *F25D 2400/38* (2013.01)

(56) References Cited

U.S. PATENT DOCUMENTS 4,350,267 A * 9/1982 Nelson ..... B67D 1/04 222/131
4,581,902 A 4/1986 Starck
4,889,257 A 12/1989 Steffes
5,263,338 A 11/1993 Banks
5,295,369 A 3/1994 Garcia
5,454,477 A * 10/1995 Bornhorst ..... A45C 5/02 220/23.4
5,626,353 A * 5/1997 Campbell ..... A47B 31/02 280/47.35
5,701,757 A 12/1997 Heverly
6,216,488 B1 * 4/2001 Rucker ..... A45B 11/00 62/331
6,276,162 B1 8/2001 Schemel
6,328,179 B1 * 12/2001 Conrado ..... A45C 5/14 108/14
6,427,475 B1 8/2002 DeFelice
D478,782 S 8/2003 Li
6,626,006 B1 9/2003 Tedder
7,040,115 B1 5/2006 Lopez
7,140,507 B2 * 11/2006 Maldonado ..... A45C 11/20 220/592.2
7,162,890 B2 1/2007 Mogil
7,168,260 B2 * 1/2007 Lee ..... F16F 15/04 248/678
7,168,263 B1 1/2007 Zenner
D585,705 S 2/2009 Weers
7,735,334 B2 * 6/2010 Johnson ..... F25D 31/006 62/457.4
7,757,908 B1 * 7/2010 Buhl, Jr. ..... B67D 1/0406 141/231
D674,245 S * 1/2013 Williams, Jr. ..... D7/605
8,453,882 B2 * 6/2013 Johnson ..... B67D 1/0864 222/146.6
8,511,846 B1 8/2013 Sandberg
8,516,848 B2 8/2013 White
8,881,545 B2 * 11/2014 Lee ..... F25D 17/065 62/389
8,967,419 B2 3/2015 Gerber
D732,327 S * 6/2015 Ciuksza, Jr. ..... D7/300
9,199,782 B1 12/2015 Cliatt
9,616,910 B2 * 4/2017 Chaloux ..... B62B 3/04
9,809,238 B2 * 11/2017 Kincaid ..... B62B 1/264
2002/0043076 A1 4/2002 Hodosh
2008/0093384 A1 * 4/2008 Fire ..... B67D 1/0084 222/144.5
2008/0185803 A1 * 8/2008 Analbers ..... A47F 9/00 280/47.34
2008/0264953 A1 * 10/2008 Lowman ..... B67D 1/0406 220/592.19
2010/0212351 A1 * 8/2010 Chapin ..... F25D 3/08 62/457.5
2014/0013789 A1 * 1/2014 Conrad ..... F25D 3/08 62/331
2015/0159938 A1 * 6/2015 Weckerly ..... F25D 23/12 381/334
2016/0153690 A1 * 6/2016 Patsis ..... F25D 3/08 222/608
2016/0187046 A1 * 6/2016 Chen ..... A45C 11/20 62/239
2016/0325978 A1 * 11/2016 Lehman ..... B67D 1/0406
2016/0347597 A1 * 12/2016 Schlecht, Jr. ..... B67D 1/0412
2017/0362072 A1 * 12/2017 Garcia ..... B67D 1/0891

* cited by examiner

UNIQUE SELF-PRESSURIZING, SELF-COOLING BEVERAGE SYSTEM, HAVING IMPACT-AND-VIBRATION-ABSORBING SYSTEMS, ANTI-SHAKING ANTI-ROLLING CLAMPING SYSTEM, ROOT-BEER-FLOAT SYSTEM, BEVERAGE-DISPENSING SYSTEM, AND MULTI-HEIGHT SPIGOT SYSTEM

REFERENCE TO PREVIOUSLY FILED PROVISIONAL PATENT APPLICATION

Provisional Patent Application No. 62/238,711 was filed on Oct. 8, 2015.

FIELD OF THE INVENTION

The present invention relates to a cooler. More specifically, the present invention relates to an impact-and-vibration-absorbing self-cooling portable caddy system.

DESCRIPTION OF THE PRIOR ART

Prior-art coolers have had many disadvantages. For example, FIG. 1 (PRIOR ART) illustrates a prior-art cooler having cumbersome spigots, messy beverage hoses, uncomplete beverage system, oversized growler. For example, FIG. 2 (PRIOR ART) illustrates a prior-art cooler;

a) Having no built-in systems to absorb impact for transportation,
b) Having no built-in systems to stabilize growlers,
c) Having no built-in systems to adjust the elevation of beverage spigots,
d) Having no built-in systems to retract beverage hoses and spigots,
e) Having no built-in systems to stabilize CO2 tank,
f) Having no built-in systems to make root beer float, and
g) Having no built-in systems to organize and serve beverage, A number of portable cooler have been introduced.

U.S. Pat. No. 4,194,647, issued on 1980 Mar. 25, to Spurrier, Harry A., relates to a cooler chest and dispenser structure including a can or object dispenser assembly releasably mounted in a cooler chest assembly. The cooler chest assembly has a main container body with a lid member connected to the main container body and operable in a conventional manner to provide access thereto. One endwall of the main container wall is provided with a rectangular opening that is covered with an access door assembly. The access door assembly includes a door member movable from opened to closed conditions relative the rectangular opening.

U.S. Pat. No. 4,581,902, issued on 1986 Apr. 15, to Starck, Jane G., includes an insulated container having an openable top to provide access to the cooler chamber. In one embodiment, an auxiliary top panel is provided with U-shaped brackets at opposite ends which are selectively securable in receivers at the opposite ends of the container to secure the top in a position immediately overlying the cooler cover for storage. To place the auxiliary table in an elevated position of use, the table is removed from the receivers and legs are foldable from a stored position to a position of use and engageable in the receivers to position the table at an elevation above and parallel to the cooler top to allow access to the cooler chamber.

U.S. Pat. No. 4,889,257, issued on 1989 Dec. 26, to Steffes, William J., includes a container body and a lid. The lid includes a pair of pins which extend into slots in the side walls of the container body. The configurations of the slots and the pins are such that the pins can slide but not rotate in the main portions of the slot but can rotate in enlarged end portions of the slots. The position of the lid can be reversed by positioning the pins in the enlarged end portions of the slots, rotating the lid 180 .degree., and sliding the lid and the pins to the other ends of the slots.

U.S. Pat. No. 5,263,338, issued on 1993 Nov. 23, to Banks, Jim, is basically a cooler that has been designed to eliminate the problems of what to do with the beer, pop or other beverage cans after they are empty. In the preferred embodiment of the invention an individual who has drank his beverage can from the cooler section of the invention just places his can in the crusher section of the invention and closes the lid. This crushes the can which falls with the help of gravity into a bin for storages.

U.S. Pat. No. 5,295,369, issued on 1994 Mar. 22, to Garcia, Kenneth M., is a water and ice cooler combination including 1) a main cooler container assembly provided with a cool fluid supply assembly to receive and dispense cooled fluid therefrom; and 2) a compartment separation assembly mounted within the main cooler container assembly to provide wet and dry storage areas. The main cooler container assembly includes a rectangular primary housing assembly with an enclosure lid assembly pivotally connected thereto. The cooled fluid supply assembly includes a fluid container compartment mounted in a lower portion of the primary housing assembly and a fluid discharge spigot to selectively remove cooled fluid therefrom.

U.S. Pat. No. 5,701,757, issued on 1997 Dec. 30, to Heverly, Marilou, is for facilitating cooling of food when a refrigerator is unavailable thereby preventing the food from melting and becoming unappealing. The inventive device includes an outer pan formed to receive a frozen gel pack on the bottom surface, and an inner pan removably positioned within the outer pan juxtaposed the frozen gel pack where the inner pan creates a seal with the outer pan preventing the escape of cooled air from between the pans.

U.S. Pat. No. 6,276,162, issued on 2001 Aug. 21, to Schemel, Daniel R., discloses a cooler having many plate shelves, an accessory tray and a screw on lid with carrying handle. The container is cylindrical in shape and sized to accept a standard nine (9) inch to ten and one-half (10½) inch diameter dinner plate in a level, upright position on one or more shelves. The first shelf is the floor of the cooler which has a raised rim along its perimeter for accepting a standard shaped plate with a circular border rim and concave center. The second shelf is comprised of a protruding rim inside the cooler upon which another plate may rest.

U.S. Pat. No. 6,427,475, issued on 2002 Aug. 6, to DeFelice, Terry Robert, discloses a nested cooler system for temporary storage of perishable foodstuffs and more particularly to articles for convenient, temporary storage of human breast milk and infant formulas. The inner and outer coolers jointly or independently receive the perishable foodstuffs and freezable gel packs for cooling the perishable foodstuffs.

U.S. Pat. No. 6,626,006, issued on 2003 Sep. 30, to Tedder, Carl Kenneth, discloses an adjustable, removable shelving system for separating items stored in a cooler from ice or water in the cooler, including: (a) at least one generally flat, rectangular-shaped, one-piece, stackable, generally horizontally oriented shelf; (b) a number of generally circular, spaced-apart apertures in the shelf; (c) a number of evenly spaced, same-sized stationary legs projecting down from the shelf; and (d) many same-sized, reversible leg extensions, each including a projection on one end of the leg extension, which extends in the same direction as the remainder of the leg extension, each of the leg extensions further comprising a bore in an opposite end.

U.S. Pat. No. 7,040,115, issued on 2006 May 9, to Lopez, Jesse M., discloses an insulated container assembly, which has a main body portion and a lid hingedly attached to the main body portion. The main body portion has four walls and is substantially rectangular in shape. The walls of the main body portion define an area for receiving and holding food and beverages therein. The walls each have a slot extending therethrough. The lid has an interior surface having a rectangular indentation centered therein.

U.S. Pat. No. 7,162,890, issued on 2007 Jan. 16, to Mogil, Melvin S., discloses a soft sided insulated container assembly, which includes a first portion having an insulated, soft sided external wall structure, and an internal, substantially rigid molded plastic receptacle mounted therein. It has a cover structure that includes a reinforcement member for engaging a land region of the molded receptacle, thereby tending to yield an interface tending to have a sealing relationship.

U.S. Pat. No. 7,168,263, issued on 2007 Jan. 30, to Zenner, Eugene R., discloses a stable portable beverage dispensing cooler, which includes a spring loaded dispensing unit for beverages with freezer packs between the rows of beverages for maintaining the beverages in a chilled environment. The portable cooler includes a lower drawer for storage and at least two snack trays and two beverage trays. The cooler lid can be formed in the shape of any outdoor activity, U.S. Pat. No. 8,511,846, issued on 2013 Aug. 20, to Sandberg, Jayson T., discloses a cooler that utilizes multiple LEDs to illuminate an entire interior is disclosed herein. The LEDs are activated by a magnetic reed switch positioned between an inside liner and an outer liner of the cooler. A magnet is positioned in a lid. Removal of the magnetic field of the magnet when the lid is in an open state allows the magnetic reed switch to complete a circuit from a battery to the LEDs thereby allowing the LEDs to illuminate the entire interior chamber of the cooler.

U.S. Pat. No. 8,516,848, issued on 2013 Aug. 27, to White, Richard W., discloses a liner of a cooler, which has sides extending upward to an inner shoulder. A platform assembly fits onto the inner shoulder of the cooler. The assembly provides a sanitary platform for ready access to ice cubes and/or cooled items below, a scoop for the ice, a lid(s) for closing the aperture(s) so that the larger cooler cover need not be opened and closed while dispensing cubes during drink or meal preparation.

U.S. Pat. No. 8,967,419, issued on 2015 Mar. 3, to Gerber, Scott Dennis, discloses a portable cooler device, which may include an exterior shell, an insulated container surrounded by the exterior shell and at least one cooling insert held by the insulated container. A liner that may have a cooling chamber may be placed within the interior housing of the at least one cooling insert. A cover may be included so that the contents of the cooling chamber may stay cool. A carrying handle may hold the cover in place and allow for transport.

U.S. Pat. No. 9,199,782, issued on 2015 Dec. 1, to Cliatt; Larry, discloses a cooler with bladders filled with liquid attached to dispensers and placed in the interior of the cooler. The base of the cooler has recesses and channels to capture melted ice and provide cooling for the bladders. There is a front telescoping handle and a rear telescoping handle with a pair of wheels for transport. A pair of dispensers at equidistance apart, each having a control mechanism and an outlet, is mateable with bladders with either one or two liquid conduits.

U.S. Pub. No. 20020043076, issued on 2018 Feb. 4, to Hodosh, Marc A., discloses an insulated container having a container wall, and a space to be warmed or cooled defined within the container wall. The container has an opening in the wall and a receptacle positioned so that objects introduced through the opening can seat in the receptacle and extend outwardly through the opening so that part of the object, such as a canned or bottled drink, seats within the receptacle, and part extends outwardly of the container so that a user can reach it. Either or both of the receptacle and the container can be collapsible.

U.S. Pub. No. 20100212351, issued on 2010 Aug. 26, to Chapin, Michael L., discloses a liquid dispensing cooler for beverages in the form of an insulated ice chest having an insulated base, insulated side walls, insulated end walls and an insulated cover; a spigot mounted in one of the chest walls above the base and having a controllable dispensing valve adjacent an exterior surface of the chest wall; at least one inverted bottle having a valve body mounted thereon, the valve body having locking grooves and splines formed thereon on upper portions and having an air venting means integrally formed by crenellations on lowermost portions thereon; a reservoir with a reservoir top wall having a circular opening with locking grooves and splines formed thereon adapted to engage and to support an inverted bottle through the grooves and splines on the valve body; and a delivery tube communicating between the reservoir and the spigot to permit gravity flow of liquid from the reservoir to the spigot.

U.S. Pat. No. D478782, issued on 2003 Aug. 26, to Li, Daniel Dai, discloses the ornamental design for a cooler bag.

U.S. Pat. No. D585705, issued on 2009 Feb. 3, to Weers, Dianne Marlene, discloses the ornamental design for a cooler for beer and wine.

OBJECTS AND ADVANTAGES OF THE INVENTION

The present invention substantially departs from the conventional concepts and designs of the prior art. In doing so, the present invention provides an impact-and-vibration-absorbing self-cooling portable caddy system, having multiple unique capabilities, functions, and advantages, which overcome all the disadvantages of the prior art, as follows:

1) (FIGS. 41A, 41B, 42A, 42B, 25F, 25G, 25H, and 25I)

Multi-position multi-height spigots 166 of the impact-and-vibration-absorbing self-cooling portable caddy system are instantly adjustable to add convenience to operating the root beer or other beverage dispensing process. Multi-position multi-height spigots 166 are made available at any typically useful height that a person doing this operation would need, while needed. In addition, multi-position multi-height spigots 166 can be immediately re-adjusted without tools or any time-wasting methods used in prior art methods.

2) (FIGS. 23, 24, and 39)

When multi-position multi-height spigots 166 of the impact-and-vibration-absorbing self-cooling portable caddy system complete their serving operation, the adjustable handles with spigot-locking receptacles 115 are quickly and conveniently retracted back into post tunnels 117 and are compacted, out-of-the-way, and ready for transport. The prior art has no mechanism to accomplish this.

3) (FIGS. 18, 19, 27B, 27C, 14A, 14B, 15D, 27D, and 27C)

Anti-shaking anti-rolling tank-and-growler-clamping system 140 reduces vibration, rocking, and other movement.

The Vibration is absorbed and controlled by Growler-impact-and-vibration-absorbing circular springs 107. These 2 systems reduce or eliminate pressure build-up in the carbonated beverage contained within the growler canisters. The prior art has no mechanism to accomplish this.

Anti-shaking anti-rolling tank-and-growler-clamping system 140 combined with Growler-impact-and-vibration-absorbing circular springs 107 is multi-functional, which accomplishes 4 things in one: a) Stabilizes the kegs b) separates the growler kegs from one another to eliminate the kegs from colliding while in transit (as the prior art will collide with one another) c) Absorbs vertical shock as the weight of the kegs bounce up and down during movement over uneven surfaces, and d) Anti-shaking anti-rolling tank-and-growler-clamping system 141 is conveniently small and easy to deploy.

4) (FIGS. 18, 19, 27B, 27C, 14A, 14B, 15D, 27D, and 27C)

CO2-tank-locking recess 104 reduces or eliminates sliding, rocking, and other movement of the heavy and top-heavy CO2 tank. The vibration and vertical movement is absorbed, dampened, and controlled by tank-impact-and-vibration-absorbing circular springs 106. These components together will greatly reduce the danger posed by the three tanks colliding while in a vehicle during transport, or being transported over rough surfaces. The prior art has no mechanism to accomplish this.

5) (FIGS. 40A, 40B, 40C, and 40D)

Spring-assisted retractable-beverage-hose reels 201 are for beverage-dispensing hoses 164 to wind thereon to retract multi-position multi-height spigots 166 out-of-the-way and are available to operate the spigots and dispense beverages directly from the front face of the cooler. This is for situations when the cooler would be sitting on a table or other elevated location.

6) (FIGS. 25A, 25B, 25C, 25D, 25E, 40A, 40B, 40C, and 40D) Spring-assisted retractable-beverage-hose reels 201 are able to be deployed at multiple heights when the impact-and-vibration-absorbing self-cooling portable caddy system is positioned at ground level the hoses/spigots can be quickly pulled out and deployed, to be securely stationed atop spigot-locking receptacles 115 at any desired height.

7) (FIGS. 7A, 7B, and 7C)

Snap-on removable cup-holder tray 128 is part of the built-in ice-cream-and-root-beer float system, which provides a way to securely hold multiple cups while preparing the root beer floats and snap-on removable cup-holder tray 128 then snaps out to serve the root beer floats to thirsty recipients.

8) (FIGS. 4, 5, 6B and 6C)

Multi-flavor ice-cream compartments 124 is designed to provide multiple (one or more) flavors of ice-cream. This increases the convenience as well as serving and time efficiency. This gives immediate choices to the recipient being served and makes this impact-and-vibration-absorbing self-cooling portable caddy system more desirable than the prior art.

9) (FIGS. 10A, 10B, 27A, and 27B)

Impact-and-vibration-absorbing wheel system 131 is in contact with the rolling surface, on which the impact-and-vibration-absorbing self-cooling portable caddy system would be transported. The surface may be uneven and therefore would cause the beverages and ice cream to be shaken. Impact-and-vibration-absorbing wheel system 131, in companionship with the anti-shaking anti-rolling tank-and-growler-clamping system 140, will reduce or eliminate pressure build-up in the carbonated beverage contained within the growler canisters. The prior art has no mechanism to accomplish this.

10) (FIGS. 18, 19, 27B, 27C, 14A, 14B, 15D, 27D, and 27C)

CO2-tank-locking recess 104 combined with growler-impact-and-vibration-absorbing circular springs 107, impact-and-vibration-absorbing wheel system 131, and anti-shaking anti-rolling tank-and-growler-clamping system 140 stabilize the movement as to provide a mechanism to minimize or eliminate the impact-and-vibration-absorbing self-cooling portable caddy system from tipping while transporting. The prior art is unstable, and because of the shifting of the heavy tanks filled with CO2 and liquid beverages, will become unbalanced, top-heavy and will tip over when encountering sudden rocks, holes, jagged cement, or uneven side-by-side sidewalk slabs.

11) (FIGS. 4, 5, 6B and 6C)

Multi-flavor ice-cream compartments 124 are uniquely designed to help the cold air circulate around multi-flavor ice-cream compartments 124 and expose the ice cream environment to this cold air, which is produced by the ice, or re-freezable cooling gel-packs 108. This cold environment will keep the ice cream cold for extended periods of time.

12) (FIGS. 40A, 40B, 40C, and 40D,)

Spring-assisted retractable-beverage-hose reels 201 are spring-loaded and able to automatically rotate, so that when finished using multi-position multi-height spigots 166 and serving root beer floats, beverage-dispensing hoses 164 and multi-position multi-height spigots 166 can be instantly and effortlessly retracted back into the impact-and-vibration-absorbing self-cooling portable caddy system, ready for transport or storage.

13) (FIGS. 25F, 25G, 25H, and 25I)

Spigot-locking receptacles 115 are designed as to utilize the least amount of materials during manufacturing. Spigot-locking receptacles 115 are recessed inside retractable height-adjustable spigot-locking handle 114, utilizing empty space for their function. This reduces cost of manufacturing.

14) (FIGS. 25F, 25G, 25H, and 25I)

Spigot-locking receptacles 115, according to their minimalistic design, do not extend outside of the physical dimension of the handles, as to not snag on any clothing, jewelry, or other miscellaneous objects in the path while deploying or while transporting.

15) (FIGS. 4, and 5)

Built-in root-beer-float system 123 are portable and conveniently at hand to create and serve root beer floats. To have multiple flavors of ice-cream, to keep the ice-cream cold due to the self-cooling compartment.

16) (FIG. 30)

Part of built-in root-beer-float system 123 is snap-on removable cup-holder tray 128, which provides a way to securely hold multiple cups while preparing the root beer floats and snap-on removable cup-holder tray 128 then snaps out to serve the root beer floats to thirsty recipients.

17) (FIGS. 20B, 43A, 43B, 43C, and 43D)

Re-freezable cooling gel-packs 108 are a user option to conveniently provide ice packs, which fit perfectly in the impact-and-vibration-absorbing self-cooling portable caddy system, snugly surrounding the growler kegs, to keep the beverage cold for extended amounts of time. These can be re-frozen by simply placing them in a freezer. The other user option is to provide cooling by pouring in ice cubes into the empty space surrounding the growler kegs.

18) (FIGS. 4, 5, and 15A)

These nine above-mentioned systems are all contained in a protective vibration-absorbing portable shell 103, which is portable. The prior art has no mechanism to accomplish this. Previous portable systems contain either a system to cool the keg or to pressurize the keg, but not all nine above-mentioned systems.

19) (FIG. 8A)

Clamp-system-storing recess 145 makes it quick and easy to retrieve and deploy anti-shaking anti-rolling tank-and-growler-clamping system 140 from its secure, compact, integrated storage compartment in the lid of the impact-and-vibration-absorbing self-cooling portable caddy system.

20) (FIGS. 25B, and 25E)

When beverage-dispensing hoses 164 are deployed out from their retracted position, they are then able to be routed through the empty space between the side handles and right and left sides of vibration-absorbing portable shell 103. This safely holds beverage-dispensing hoses 164 out of the way while the operating server is serving. This will prevent beverage-dispensing hoses 164 from causing distraction and/or catching on a serving spoon, or cause a cup to be overturned and spilled.

Other objects and advantages of the present invention will become apparent from the consideration of the accompanying drawings and the ensuing description.

SUMMARY OF THE INVENTION

A portable CO2 based cooler and beverage dispensing system for pressurizing and cooling beverage tanks, comprises a vibration-absorbing portable shell with a snap on removable tray for holding beverage containers and ice-cream-recesses, two growler-vibration-absorbing circular springs molded on the shell bottom for absorbing vibration from transportation and for holding and separating two beverage tanks, a tank-vibration-absorbing circular spring molded on the shell bottom for absorbing vibration from transportation and for holding a pressurized tank, a clamping system for clamping on and stabilizing two beverage growlers and a pressurized tank for transportation, two multi-height spigots, two height-adjustable telescopic posts, and a retractable height-adjustable spigot-locking handle attached the two posts and having two spigot-locking receptacles molded thereon for locking and adjusting the multi-height spigots to multiple different heights.

DETAILED DESCRIPTION OF THE INVENTION

Component

Figure 1:
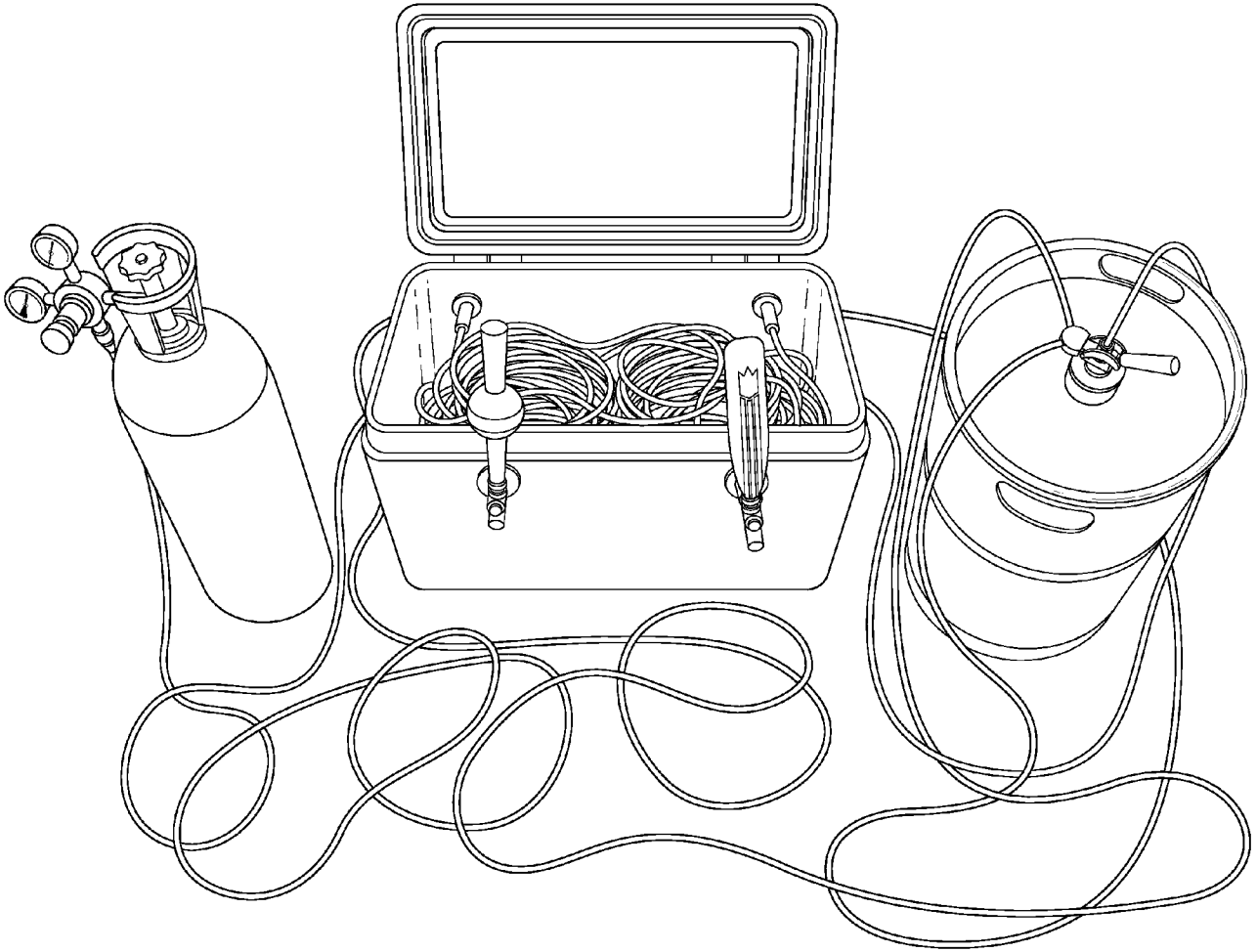
Fig. 1 (Prior Art)
FIGS. 1 (prior art) and 2 (prior art) illustrate the disadvantages of the prior art.
Figure 2:
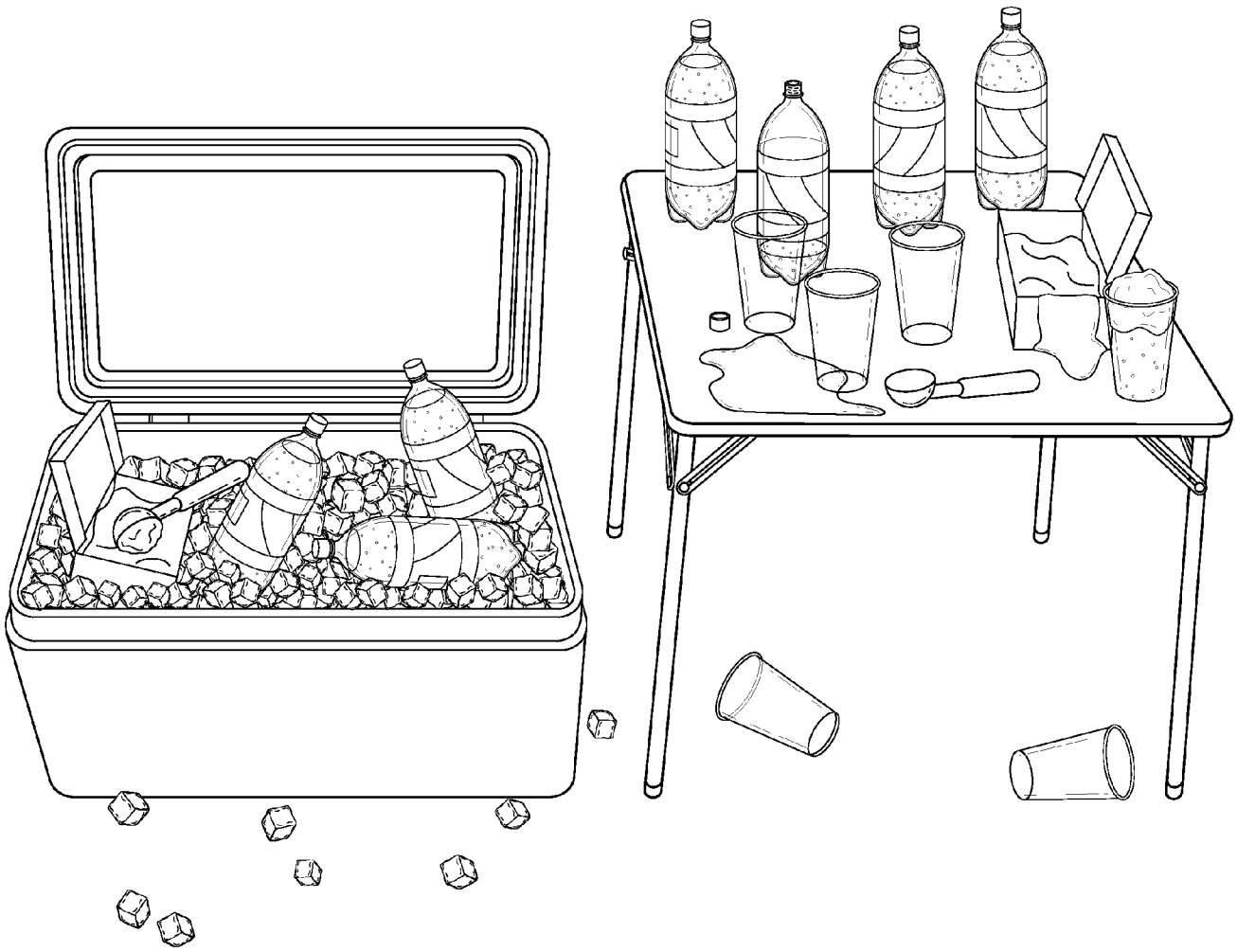
Fig. 2 (Prior Art)
Figure 3:
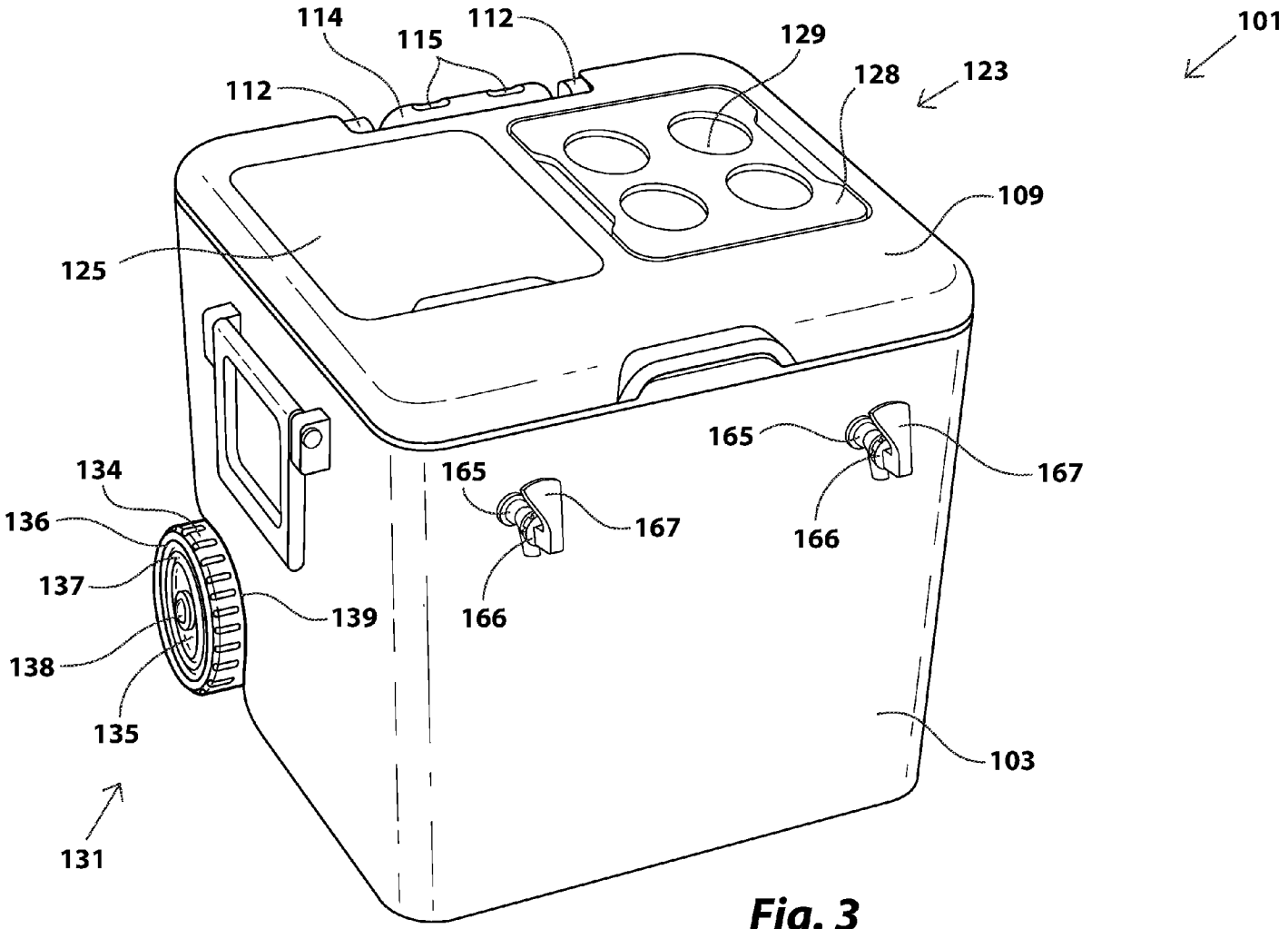
FIGS. 3, 4, and 5 illustrate perspective views of an impact-and-vibration-absorbing self-cooling portable caddy system, a root-beer-float system, an impact-and-vibration-absorbing wheel system, and a multi-position multi-height beverage-dispensing spigot system.

Referring to FIGS. 3, 4, 5, 6A, 6B, 6C, 6D, 7A, 7B, 7C, 8A, 8B, 8C, 9A, 9B, 10A, 10B, 11, 12A, 12B, 13, 14A, 14B, 15A, 15B, 15C, 15D, and 15E, a unique all-in-one, self-pressurizing, self-cooling, dual-retractable-dispensing-hose-and-tap, portable ice-cream root-beer-float-and-beverage dispensing system comprises:

1) Impact-and-vibration-absorbing self-cooling portable caddy system 101, comprising:
2) Vibration-absorbing portable vault 102,
3) Vibration-absorbing portable shell 103,
4) CO2-tank-locking recess 104,
5) Growler-locking recesses 105,
6) Tank-impact-and-vibration-absorbing circular springs 106,
7) Growler-impact-and-vibration-absorbing circular springs 107,
8) Re-freezable cooling gel-packs 108,
9) Root-beer-float-and-serving-tray lid 109,
10) Lid-locking groove 110,
11) Lid-locking ridge 111,
12) Lid hinges 112,
13) Lid-hinge pins 113,
14) Retractable height-adjustable spigot-locking handle 114,
15) Spigot-locking receptacles 115,
16) Height-adjustable telescopic posts 116,
17) Post tunnels 117,
18) Upper and lower post-stabilizing bars 118*a* and 118*b*,
19) Bar screws 119,
20) Drain 120,
21) Drain plug 121,
22) Spigot-locking-handle screws 122;
23) Root-beer-float system 123, comprising:
24) Multi-flavor ice-cream compartments 124,
25) Snap-on ice-cream lid 125,
26) Ice-cream-lid-locking groove 126,
27) Ice-cream-lid-locking ridge 127,
28) Snap-on removable cup-holder tray 128,
29) Snap-on removable cup-holder-tray cavity 129,
30) Cup-holder-tray locks 130;
31) Impact-and-vibration-absorbing wheel system 131, comprising:
32) Wheel axle 132,
33) Wheel-axle tunnel 133,
34) Wheels 134,
35) Circular spokes 135,
36) Wheel-impact-and-vibration-absorbing circular convex springs 136,
37) Spoke-impact-and-vibration-absorbing circular concave springs 137,
38) Wheel nuts 138,
39) Wheel wells 139;
40) Anti-shaking anti-rolling tank-and-growler-clamping system 140, comprising:
41) Resilient tank clamp 141,
42) Double growler locks 142*a* and 142*b*,
43) Growler spacer 143,
44) Growler-locking disk 144,
45) Clamp-system-storing recess 145;
46) CO2 tank system 146, comprising:
47) Tank 147,
48) Valve handle 148,
49) Pressure gauge 149,
50) Liquid-volume gauge 150,
51) Pressure-adjusting knob 151,
52) Tank-pressure-releasing safety valve 152,
53) CO2-hose adaptors 153,
54) CO2-hose on-and-off valves 154,
55) CO2 hoses 155;
56) Beverage growler system 156, comprising:
57) Growlers 157,
58) Spears 158,
59) Growler-pressure-releasing safety valves 159,
60) Low-profile spear-top couplers 160,
61) CO2-hose connectors 161,
62) Beverage-hose connectors 162; and
63) Multi-position multi-height beverage-dispensing spigot system 163, comprising:
64) Beverage-dispensing hoses 164,
65) Hose-and-spigot couplers 165, 66) Multi-position multi-height spigots 166,
67) Beverage-dispensing spigot levers 167,
68) Hose holes 168,
69) Hose washers 169,
70) Hose nuts 170,
71) Tube screws 171.

Material

Referring to FIGS. 3, 4, 5, 6A, 6B, 6C, 6D, 7A, 7B, 7C, 8A, 8B, 8C, 9A, 9B, 10A, 10B, 11, 12A, 12B, 13, 14A, 14B, 15A, 15B, 15C, 15D, and 15E:

1) Impact-and-vibration-absorbing self-cooling portable caddy system 101 is made of the combined materials of its components.
2) Vibration-absorbing portable vault 102 is made of plastic or plasticized material.
   (Vibration-absorbing portable vault 102 can, for example, have the dimensions of 13.90 inches by 18.75 inches by 16.80 inches).
3) Vibration-absorbing portable shell 103 is made of plastic or plasticized material.
   (Vibration-absorbing portable shell 103 can, for example, have the dimensions of 19.50 inches by 26.45 inches by 20.30 inches).
4) CO2-tank-locking recess 104 is made of empty space.
5) Growler-locking recesses 105 each are made of empty space.
6) Tank-impact-and-vibration-absorbing circular springs 106 each are made of plastic or plasticized material.
7) Growler-impact-and-vibration-absorbing circular springs 107 each are made of plastic or plasticized material.
8) Re-freezable cooling gel-packs 108 each are made of plastic or plasticized material and gel-refrigerant material.
9) Root-beer-float-and-serving-tray lid 109 is made of plastic or plasticized material.
10) Lid-locking groove 110 is made of empty space.
11) Lid-locking ridge 111 is made of plastic or plasticized material.
12) Lid hinges 112 each are made of plastic or plasticized material.
13) Lid-hinge pins 113 each are made of plastic or plasticized material.
14) Retractable height-adjustable spigot-locking handle 114 is made of plastic or metallic material.
15) Spigot-locking receptacles 115 each are made of empty space.
16) Height-adjustable telescopic posts 116 each are made of plastic or metallic material.
17) Post tunnels 117 each are made of empty space.
18) Upper and lower post-stabilizing bars 118*a* and 118*b* each are made of plastic or metallic material.
19) Bar screws 119 each are made of metallic material.
20) Drain 120 is made of plastic or rubber material.
21) Drain plug 121 is made of plastic or metallic material.
22) Spigot-locking-handle screws 122 each are made of metallic material.
23) Root-beer-float system 123 is made of the combined materials of its components.
24) Multi-flavor ice-cream compartments 124 each are made of plastic or plasticized material.
25) Snap-on ice-cream lid 125 is made of plastic or plasticized material.
26) Ice-cream-lid-locking groove 126 is made of empty space.
27) Ice-cream-lid-locking ridge 127 is made of plastic or plasticized material.
28) Snap-on removable cup-holder tray 128 is made of plastic or plasticized material.
29) Snap-on removable cup-holder-tray cavity 129 is made of empty space.
30) Cup-holder-tray locks 130 each are made of plastic or plasticized material.
31) Impact-and-vibration-absorbing wheel system 131 is made of the combined materials of its components.
32) Wheel axle 132 is made of metallic material.
33) Wheel-axle tunnel 133 is made of empty space.
34) Wheels 134 each are made of plastic or plasticized material.
35) Circular spokes 135 each are made of plastic or plasticized material.
36) Wheel-impact-and-vibration-absorbing circular convex springs 136 each are made of plastic or plasticized material.
37) Spoke-impact-and-vibration-absorbing circular concave springs 137 each are made of plastic or plasticized material.
38) Wheel nuts 138 each are made of metallic material.
39) Wheel wells 139 each are made of empty space.
40) Anti-shaking anti-rolling tank-and-growler-clamping system 140 is made of the combined materials of its components.
41) Resilient tank clamp 141 is made of plastic or plasticized material.
42) Double growler locks 142*a* and 142*b* each are made of plastic or plasticized material.
43) Growler spacer 143 is made of plastic or plasticized material.
44) Growler-locking disk 144 is made of plastic or plasticized material.
45) Clamp-system-storing recess 145 is made of empty space.
46) CO2 tank system 146 is made of the combined materials of its components.
47) Tank 147 is made of metallic material.
48) Valve handle 148 is made of metallic material.
49) Pressure gauge 149 is made of metallic and/or plasticized materials.
50) Liquid-volume gauge 150 is made of metallic and/or plasticized materials.
51) Pressure-adjusting knob 151 is made of metallic material.
52) Tank-pressure-releasing safety valve 152 is made of metallic material.
53) CO2-hose adaptors 153 each are made of metallic material.
54) CO2-hose on-and-off valves 154 each are made of metallic material.
55) CO2 hoses 155 each are made of flexible material (e.g., vinyl).
56) Beverage growler system 156 is made of the combined materials of its components.
57) Growlers 157 each are made of metallic material.
   (Growlers 157 each can have the outer dimensions of, for example, 12.20 or 11.20 inches by 9.25 inches. Growlers 157 each can hold up to, for example, two gallons of drinkable liquid).
58) Spears 158 each are made of metallic material.
59) Growler-pressure-releasing safety valves 159 each are made of metallic material.
60) Low-profile spear-top couplers 160 each are made of metallic material.
61) CO2-hose connectors 161 each are made of metallic material.
62) Beverage-hose connectors 162 each are made of metallic material.

63) Multi-position multi-height beverage-dispensing spigot system 163 is made of the combined materials of its components.
64) Beverage-dispensing hoses 164 each are made of flexible material (e.g., vinyl).
65) Hose-and-spigot couplers 165 each are made of metallic material.
66) Multi-position multi-height spigots 166 each are made of plastic or plasticized material.
67) Beverage-dispensing spigot levers 167 each are made of plastic or plasticized material.
68) Hose holes 168 each are made of empty space.
69) Hose washers 169 each are made of a resilient material.
70) Hose nuts 170 each are made of metallic material.
71) Tube screws 171 each are made of metallic material.

Shape

Referring to FIGS. 3, 4, 5, 6A, 6B, 6C, 6D, 7A, 7B, 7C, 8A, 8B, 8C, 9A, 9B, 10A, 10B, 11, 12A, 12B, 13, 14A, 14B, 15A, 15B, 15C, 15D, and 15E:

1) Impact-and-vibration-absorbing self-cooling portable caddy system 101 has the combined shapes of its components.
2) Vibration-absorbing portable vault 102 has a rectangular-box shape with an open top.
3) Vibration-absorbing portable shell 103 has a rectangular-box shape with an open top.
4) CO2-tank-locking recess 104 has a circular shape.
5) Growler-locking recesses 105 each have a circular shape.
6) Tank-impact-and-vibration-absorbing circular springs 106 each have a circular shape.
7) Growler-impact-and-vibration-absorbing circular springs 107 each have a circular shape.
8) Re-freezable cooling gel-packs 108 each have a square, rectangular, round, or crescent shape.
9) Root-beer-float-and-serving-tray lid 109 has a rectangular shape.
10) Lid-locking groove 110 has a concave rectangular shape.
11) Lid-locking ridge 111 has a convex rectangular shape.
12) Lid hinges 112 each have a half-round-tube shape.
13) Lid-hinge pins 113 each have a half-round-rod shape.
14) Retractable height-adjustable spigot-locking handle 114 has a handle shape.
15) Spigot-locking receptacles 115 each have an oval shape.
16) Height-adjustable telescopic posts 116 each have a tubular shape.
17) Post tunnels 117 each have a tubular shape.
18) Upper and lower post-stabilizing bar 118*a* and 118*b* each have an elongated shape with
a U cross-section or an L cross-section.
19) Bar screws 119 each have a screw shape.
20) Drain 120 has a ring shape and/or a cup shape.
21) Drain plug 121 has a cup shape.
22) Spigot-locking-handle screws 122 each have a screw shape.
23) Root-beer-float system 123 has the combined shapes of its components.
24) Multi-flavor ice-cream compartments 124 each have a kidney shape with an open top.
25) Snap-on ice-cream lid 125 has a rectangular shape.
26) Ice-cream-lid-locking groove 126 has a concave rectangular shape.
27) Ice-cream-lid-locking ridge 127 has a convex rectangular shape.
28) Snap-on removable cup-holder tray 128 has a rectangular shape.
29) Snap-on removable cup-holder-tray cavity 129 has a square shape.
30) Cup-holder-tray locks 130 each have a rectangular shape.
31) Impact-and-vibration-absorbing wheel system 131 has the combined shapes of its components.
32) Wheel axle 132 has a round-rod shape.
33) Wheel-axle tunnel 133 has a round-rod shape.
34) Wheels 134 each have a circular shape.
35) Circular spokes 135 each have a circular spoke shape.
36) Wheel-impact-and-vibration-absorbing circular convex springs 136 each have a circular shape.
37) Spoke-impact-and-vibration-absorbing circular concave springs 137 each have a circular shape.
38) Wheel nuts 138 each have a nut shape.
39) Wheel wells 139 each have a partial-pie shape.
40) Anti-shaking anti-rolling tank-and-growler-clamping system 140 has the combined shapes of its components.
41) Resilient tank clamp 141 has a U shape.
42) Double growler locks 142*a* and 142*b* each have a U shape or a water-drop shape.
43) Growler spacer 143 has an I shape.
44) Growler-locking disk 144 has a round shape.
45) Clamp-system-storing recess 145 has a clamp-system shape.
46) CO2 tank system 146 has the combined shapes of its components.
47) Tank 147 has a cylindrical shape.
48) Valve handle 148 has an octafoil shape.
49) Pressure gauge 149 has a circular shape.
50) Liquid-volume gauge 150 has a circular shape.
51) Pressure-adjusting knob 151 has hexagonal shape.
52) Tank-pressure-releasing safety valve 152 has a cylindrical shape with an attached ring.
53) CO2-hose adaptor 153 has a Y shape.
54) CO2-hose on-and-off valves 154 each have a rectangular shape.
55) CO2 hoses 155 each have a tubular shape.
56) Beverage growler system 156 has the combined shapes of its components.
57) Growlers 157 each have a cylindrical shape.
58) Spears 158 each have a tubular-pendulum shape.
59) Growler-pressure-releasing safety valves 159 each have a cylinder shape with an attached ring.
60) Low-profile spear-top couplers 160 each have a cup shape with two protruding tubes.
61) CO2-hose connectors 161 each have a circular shape.
62) Beverage-hose connectors 162 each have a circular shape.
63) Multi-position multi-height beverage-dispensing spigot system 163 has the combined shapes of its components.
64) Beverage-dispensing hoses 164 each have a tubular shape.
65) Hose-and-spigot couplers 165 each have a circular shape.
66) Multi-position multi-height spigots 166 each have a tubular L shape.
67) Beverage-dispensing spigot levers 167 each have a C shape.
68) Hose holes 168 each have a square or round shape.
69) Hose washers 169 each have a ring shape.
70) Hose nuts 170 each have a square, hexagonal, domed, or round nut shape.
71) Tube screws 171 each have a hollowed-out-screw shape with a square-hexagonal-domed-orround-cross-section tube and a square, hexagonal, domed, or round screw head.

Connection

Referring to FIGS. 3, 4, 5, 6A, 6B, 6C, 6D, 7A, 7B, 7C, 8A, 8B, 8C, 9A, 9B, 10A, 10B, 11, 12A, 12B, 13, 14A, 14B, 15A, 15B, 15C, 15D, and 15E:

1) Impact-and-vibration-absorbing self-cooling portable caddy system 101 is molded to root-beer-float system 123.
2) Vibration-absorbing portable vault 102 is inserted into vibration-absorbing portable shell 103.
3) Vibration-absorbing portable shell 103 is slid on vibration-absorbing portable vault 102.
4) CO2-tank-locking recess 104 is molded to vibration-absorbing portable vault 102.
5) Growler-locking recesses 105 respectively are molded to vibration-absorbing portable vault 102.
6) Tank-impact-and-vibration-absorbing circular springs 106 respectively are molded to the bottom of vibration-absorbing portable vault 102.
7) Growler-impact-and-vibration-absorbing circular springs 107 respectively are molded to the bottom of vibration-absorbing portable vault 102.
8) Re-freezable cooling gel-packs 108 respectively are removably placed adjacent to tank 147 and growlers 157.
9) Root-beer-float-and-serving-tray lid 109 is molded to lid-hinge pins 113.
10) Lid-locking groove 110 is molded to vibration-absorbing portable vault 102.
11) Lid-locking ridge 111 is molded to root-beer-float-and-serving-tray lid 109.
12) Lid hinges 112 respectively are molded to upper post-stabilizing bar 118*a*.
13) Lid-hinge pins 113 respectively are inserted into lid hinges 112.
14) Retractable height-adjustable spigot-locking handle 114 is connected to height-adjustable telescopic posts 116.
15) Spigot-locking receptacles 115 respectively are molded in retractable height-adjustable spigot-locking handle 114.
16) Height-adjustable telescopic posts 116 respectively are inserted through upper post-stabilizing bars 118*a* and into post tunnels 117.
17) Post tunnels 117 respectively are molded in the back of vibration-absorbing portable shell 103.
18) Upper and lower post-stabilizing bar 118*a* and 118*b* respectively are screwed to the back of vibration-absorbing portable shell 103.
19) Bar screws 119 respectively are screwed through upper and lower post-stabilizing bars 118*a* and 118*b* and to the back of vibration-absorbing portable shell 103.
20) Drain 120 is connected to vibration-absorbing portable vault 102 and vibration-absorbing portable shell 103.
21) Drain plug 121 is connected to drain 120.
22) Spigot-locking-handle screws 122 respectively are screwed through height-adjustable telescopic posts 116 and into retractable height-adjustable spigot-locking handle 114.
23) Root-beer-float system 123 is molded to impact-and-vibration-absorbing self-cooling portable caddy system 101.
24) Multi-flavor ice-cream compartments 124 respectively are molded in root-beer-float-and-serving-tray lid 109.
25) Snap-on ice-cream lid 125 is snapped on self-cooling multi-flavor ice-cream compartments 124.
26) Ice-cream-lid-locking groove 126 is molded in self-cooling multi-flavor ice-cream compartments 124.
27) Ice-cream-lid-locking ridge 127 is molded to snap-on ice-cream lid 125.
28) Snap-on removable cup-holder tray 128 is snapped on root-beer-float-and-serving-tray lid 109.
29) Snap-on removable cup-holder-tray cavity 129 is molded in root-beer-float-and-serving-tray lid 109.
30) Cup-holder-tray locks 130 respectively are molded to root-beer-float-and-serving-tray lid 109.
31) Impact-and-vibration-absorbing wheel system 131 is connected to impact-and-vibration-absorbing self-cooling portable caddy system 101.
32) Wheel axle 132 is snapped in wheel-axle tunnel 133.
33) Wheel-axle tunnel 133 is molded in the bottom edge of vibration-absorbing portable shell 103.
34) Wheels 134 respectively are connected to wheel axle 132.
35) Circular spokes 135 respectively are molded to wheels 134.
36) Wheel-impact-and-vibration-absorbing circular convex springs 136 respectively are molded in the side wall of wheels 134.
37) Spoke-impact-and-vibration-absorbing circular concave springs 137 respectively are molded in the side wall of spokes 135.
38) Wheel nuts 138 respectively are clamped on the opposite ends of wheel axle 132.
39) Wheel wells 139 respectively are molded at the opposite ends of the bottom edge of vibration-absorbing portable shell 103.
40) Anti-shaking anti-rolling tank-and-growler-clamping system 140 is connected to vibration-absorbing portable vault 102.
41) Resilient tank clamp 141 is snapped on tank 147.
42) Double growler locks 142*a* and 142*b* respectively are snapped on and between growlers 157.
43) Growler spacer 143 is molded to double growler locks 142*a* and 142*b*.
44) Growler-locking disk 144 is molded to growler spacer 143.
45) Clamp-system-storing recess 145 is molded in root-beer-float-and-serving-tray lid 109.
46) CO2 tank system 146 is removably inserted into vibration-absorbing portable vault 102.
47) Tank 147 is removably inserted into CO2-tank-locking recess 104.
48) Valve handle 148 is connected to the top of tank 147.
49) Pressure gauge 149 is connected to tank 147.
50) Liquid-volume gauge 150 is connected to tank 147.
51) Pressure-adjusting knob 151 is connected to tank 147.
52) Tank-pressure-releasing safety valve 152 is connected to tank 147.
53) CO2-hose adaptors 153 is connected to pressure-adjusting knob 151.
54) CO2-hose on-and-off valves 154 respectively are connected to CO2-hose adaptors 153.
55) CO2 hoses 155 respectively are connected to CO2-hose adaptors 153.
56) Beverage growler system 156 is removably inserted into vibration-absorbing portable vault 102.
57) Growlers 157 respectively are removably inserted into growler-locking recesses 105.
58) Spears 158 respectively are removably screwed on growlers 157.
59) Growler-pressure-releasing safety valves 159 respectively are connected to low-profile spear-top couplers 160.
60) Low-profile spear-top couplers 160 respectively are connected to spears 158.

61) CO2-hose connectors 161 respectively are connected to low-profile spear-top couplers 160.

62) Beverage-hose connectors 162 respectively are connected to low-profile spear-top couplers 160.

63) Multi-position multi-height beverage-dispensing spigot system 163 is connected to beverage growler system 156.

64) Beverage-dispensing hoses 164 respectively are connected to beverage-hose connectors 162, and threaded through hose holes 168.

65) Hose-and-spigot couplers 165 respectively are connected to beverage-dispensing hoses 164 and multi-position multi-height spigots 166.

66) Multi-position multi-height spigots 166 respectively are connected to beverage-dispensing hoses 164.

67) Beverage-dispensing spigot levers 167 respectively are connected to multi-position multi-height spigots 166.

68) Hose holes 168 respectively are drilled through vibration-absorbing portable vault 102 and vibration-absorbing portable shell 103.

69) Hose washers 169 respectively are connected to hose holes 168.

70) Hose nuts 170 respectively are screwed on tube screws 171.

71) Tube screws 171 respectively are screwed through hose holes 168 and in hose nuts 170.

Function

Referring to FIGS. 3, 4, 5, 6A, 6B, 6C, 6D, 7A, 7B, 7C, 8A, 8B, 8C, 9A, 9B, 10A, 10B, 11, 12A, 12B, 13, 14A, 14B, 15A, 15B, 15C, 15D, and 15E:

1) Impact-and-vibration-absorbing self-cooling portable caddy system 101 is for:
   a) Absorbing the ground impact and vibration on root-beer-float system 123, CO2 tank system 146, and beverage growler system 156 during transport;
   b) Minimizing vibration of root-beer-float system 123, CO2 tank system 146, and beverage growler system 156 during transport;
   c) Conveniently transporting and serving root-beer-floats and other beverages;
   d) Portably containing root-beer-float system 123, anti-shaking anti-rolling tank-and-growler-clamping system 140, CO2 tank system 146, and beverage growler system 156; and
   e) Portably cooling root-beer-float system 123, CO2 tank system 146, and beverage growler system 156.

2) Vibration-absorbing portable vault 102 is for:
   a) Holding anti-shaking anti-rolling tank-and-growler-clamping system 140, CO2 tank system 146 and beverage growler system 156; and
   b) Insulating anti-shaking anti-rolling tank-and-growler-clamping system 140, CO2 tank system 146 and beverage growler system 156.

3) Vibration-absorbing portable shell 103 is for:
   a) Protecting vibration-absorbing portable vault 102; and
   b) Insulating vibration-absorbing portable vault 102.

4) CO2-tank-locking recess 104 is for:
   a) Securely holding CO2 tank system 146 in place; and
   b) Absorbing and minimizing vibration of tank 147 during transport.

5) Growler-locking recesses 105 respectively are for:
   a) Securely holding growlers 157 in place; and
   b) Preventing growlers 157 from sliding around.

6) Tank-impact-and-vibration-absorbing circular springs 106 respectively are for:
   a) Absorbing the ground impact on CO2 tank system 146; and
   b) Minimizing vibration of CO2 tank system 146 during transport.

7) Growler-impact-and-vibration-absorbing circular springs 107 respectively are for:
   a) Absorbing the ground impact on beverage growler system 156; and
   b) Minimizing vibration of beverage growler system 156 during transport.

8) Re-freezable cooling gel-packs 108 respectively are for:
   a) Portably cooling root-beer-float system 123;
   b) Portably cooling CO2 tank system 146; and
   c) Portably cooling beverage growler system 156.

9) Root-beer-float-and-serving-tray lid 109 is for:
   a) Storing root-beer-float system 123;
   b) Insulating root-beer-float system 123; and
   c) Closing and insulating vibration-absorbing portable vault 102 and vibration-absorbing portable shell 103.

10) Lid-locking groove 110 is for:
   Snap-locking on lid-locking ridge 111.

11) Lid-locking ridge 111 is for:
   Snap-locking in lid-locking groove 110.

12) Lid hinges 112 respectively are for:
   Inserting lid-hinge pins 113 therein.

13) Lid-hinge pins 113 respectively are for:
   Being inserted into lid hinges 112.

14) Retractable height-adjustable spigot-locking handle 114 is for:
   a) Gripping to pull impact-and-vibration-absorbing self-cooling portable caddy system 101 for easy transport; and
   b) Adjust the height of height-adjustable telescopic posts 116.

15) Spigot-locking receptacles 115 respectively are for:
   a) Locking beverage-dispensing spigot levers 167 therein; and
   b) Adjust the height of beverage-dispensing spigot levers 167.

16) Height-adjustable telescopic posts 116 respectively are for:
   Adjusting the height of retractable height-adjustable spigot-locking handle 114.

17) Post tunnels 117 respectively are for:
   Locking height-adjustable telescopic posts 116 therein.

18) Upper and lower post-stabilizing bars 118*a* and 118*b* respectively are for:
   a) Stabilizing height-adjustable telescopic posts 116; and
   b) Attaching height-adjustable telescopic posts 116 to vibration-absorbing portable shell 103.

19) Bar screws 119 respectively are for:
   Screwing upper and lower post-stabilizing bars 118*a* and 118*b* on
   vibration-absorbing portable shell 103.

20) Drain 120 is for:
   Draining liquid out of vibration-absorbing portable vault 102.

21) Drain plug 121 is for:
   Plugging drain 120.

22) Spigot-locking-handle screws 122 respectively are for:
   Screwing height-adjustable telescopic posts 116 on retractable height-adjustable spigot-locking handle 114.

23) Root-beer-float system 123 is for:
   a) Portably and conveniently storing and transporting ice cream to make root-beer floats; and
   b) Portably and conveniently serving root-beer floats.

24) Multi-flavor ice-cream compartments 124 respectively are for:
a) Portably and conveniently storing and transporting ice cream of different flavors; and
b) Portably and conveniently serving ice cream of different flavors.

25) Snap-on ice-cream lid 125 is for:
a) Closing self-cooling multi-flavor ice-cream compartments 124; and
b) Insulating self-cooling multi-flavor ice-cream compartments 124.

26) Ice-cream-lid-locking groove 126 is for:
Snap-locking on ice-cream-lid-locking ridge 127.

27) Ice-cream-lid-locking ridge 127 is for:
Snap-locking in ice-cream-lid-locking groove 126.

28) Snap-on removable cup-holder tray 128 is for:
a) Conveniently preparing root-beer-floats thereon;
b) Conveniently serving root-beer-floats thereon; and
c) Quickly and easily being removed and washed.

29) Snap-on removable cup-holder-tray cavity 129 is for:
Securely storing snap-on removable cup-holder tray 128 in root-beer-float-and-serving-tray lid 109.

30) Cup-holder-tray locks 130 respectively are for:
Securely locking snap-on removable cup-holder tray 128 in snap-on removable cup-holder-tray cavity 129.

31) Impact-and-vibration-absorbing wheel system 131 is for:
a) Absorbing the ground impact and vibration on root-beer-float system 123, CO2 tank system 146, beverage growler system 156 during transport;
b) Minimizing the vibration of root-beer-float system 123, CO2 tank system 146, beverage growler system 156 during transport; and
c) Conveniently transporting impact-and-vibration-absorbing self-cooling portable caddy system 101, root-beer-float system 123, anti-shaking anti-rolling tank-and-growler-clamping system 140, CO2 tank system 146, beverage growler system 156, and multi-position multi-height beverage-dispensing spigot system 163.

32) Wheel axle 132 is for:
Rotatably attaching wheels 134 thereto.

33) Wheel-axle tunnel 133 is for rotatably attaching wheel axle 132 therein.

34) Wheels 134 respectively are for:
Conveniently transporting impact-and-vibration-absorbing self-cooling portable caddy system 101, root-beer-float system 123, anti-shaking anti-rolling tank-and-growler-clamping system 140, CO2 tank system 146, beverage growler system 156, and multi-position multi-height beverage-dispensing spigot system 163.

35) Circular spokes 135 respectively are for:
Supporting wheels 134.

36) Wheel-impact-and-vibration-absorbing circular convex springs 136 respectively are for:
a) Absorbing the ground impact and vibration on root-beer-float system 123, CO2 tank system 146, beverage growler system 156 during transport;
b) Minimizing the vibration of root-beer-float system 123, CO2 tank system 146, beverage growler system 156 during transport; and
c) Conveniently transporting impact-and-vibration-absorbing self-cooling portable caddy system 101, root-beer-float system 123, anti-shaking anti-rolling tank-and-growler-clamping system 140, CO2 tank system 146, beverage growler system 156, and multi-position multi-height beverage-dispensing spigot system 163.

37) Spoke-impact-and-vibration-absorbing circular concave springs 137 respectively are for:
a) Absorbing the ground impact and vibration on root-beer-float system 123, CO2 tank system 146, beverage growler system 156 during transport;
b) Minimizing the vibration of root-beer-float system 123, CO2 tank system 146, beverage growler system 156 during transport; and
c) Conveniently transporting impact-and-vibration-absorbing self-cooling portable caddy system 101, root-beer-float system 123, anti-shaking anti-rolling tank-and-growler-clamping system 140, CO2 tank system 146, beverage growler system 156, and multi-position multi-height beverage-dispensing spigot system 163.

38) Wheel nuts 138 respectively are for:
Securing wheels 134 to wheel axle 132.

39) Wheel wells 139 respectively are for:
Housing wheels 134.

40) Anti-shaking anti-rolling tank-and-growler-clamping system 140 is for:
a) Securely locking CO2 tank system 146 during transport in CO2-tank-locking recess 104 inside vibration-absorbing portable vault 102;
b) Securely locking beverage growler system 156 during transport in Growler-locking recesses 105 inside vibration-absorbing portable vault 102;
c) Stabilizing CO2 tank system 146 during transport in CO2-tank-locking recess 104 inside vibration-absorbing portable vault 102; and
d) Stabilizing beverage growler system 156 during transport in CO2-tank-locking recess 104 inside vibration-absorbing portable vault 102.

41) Resilient tank clamp 141 is for:
a) Securely locking CO2 tank system 146 during transport in CO2-tank-locking recess 104 inside vibration-absorbing portable vault 102;
b) Stabilizing CO2 tank system 146 during transport in CO2-tank-locking recess 104 inside vibration-absorbing portable vault 102;
c) Preventing CO2 tank system 146 from rotating around;
d) Preventing CO2 tank system 146 from leaning; and
e) Preventing CO2 tank system 146 from bouncing.

42) Double growler locks 142*a* and 142*b* respectively are for:
a) Securely locking beverage growler system 156 during transport in Growler-locking recesses 105 inside vibration-absorbing portable vault 102;
b) Stabilizing beverage growler system 156 during transport in CO2-tank-locking recess 104 inside vibration-absorbing portable vault 102;
c) Preventing beverage growler system 156 from rotating around;
d) Preventing beverage growler system 156 from leaning; and
e) Preventing beverage growler system 156 from bouncing.

43) Growler spacer 143 is for:
a) Spacing growlers 157;
b) Connecting together double growler locks 142*a* and 142*b*; and
c) Stabilizing double growler locks 142*a* and 142*b*.

44) Growler-locking disk 144 is for:
a) Locking beverage growler system 156 in growler-locking recesses 105;
b) Preventing beverage growler system 156 from rotating around;
c) Preventing beverage growler system 156 from leaning;

d) Preventing beverage growler system 156 from bouncing; and e) Locking anti-shaking anti-rolling tank-and-growler-clamping system 140 to beverage growler system 156.

45) Clamp-system-storing recess 145 is for:
Storing and locking anti-shaking anti-rolling tank-and-growler-clamping system 140 in root-beer-float-and-serving-tray lid 109.

46) CO2 tank system 146 is for:
a) Storing CO2;
b) Carbonating beverages; and
c) Pressurizing beverages.

47) Tank 147 is for:
Storing CO2.

48) Valve handle 148 is for:
Opening and closing tank 147.

49) Pressure gauge 149 is for:
Displaying the pressure within tank 147.

50) Liquid-volume gauge 150 is for:
Displaying the amount of liquid within tank 147.

51) Pressure-adjusting knob 151 is for:
Adjusting the pressure within tank 147.

52) Tank-pressure-releasing safety valve 152 is for:
a) Manually releasing pressure from inside tank 147; and
b) Automatically releasing pressure from inside tank 147.

53) CO2-hose adaptors 153 respectively are for:
Routing pressurized CO2 from CO2 tank system 146 to beverage growler system 156.

54) CO2-hose on-and-off valves 154 respectively are for:
Controlling the flow of pressurized CO2 from CO2 tank system 146 to beverage growler system 156.

55) CO2 hoses 155 respectively are for:
Dispensing pressurized CO2 from CO2 tank system 146 to beverage growler system 156.

56) Beverage growler system 156 is for:
a) Storing beverages; and
b) Storing pressurized beverages.

57) Growlers 157 respectively are for:
Storing beverages.

58) Spears 158 respectively are for:
a) Allowing pressurized CO2 into growlers 157; and
b) Allowing pressurized beverages into low-profile spear-top couplers 160.

59) Growler-pressure-releasing safety valves 159 respectively are for:
a) Manually releasing pressure from inside growlers 157; and
b) Automatically releasing pressure from inside growlers 157.

60) Low-profile spear-top couplers 160 respectively are for:
a) Channeling pressurized CO2 into spears 158; and
b) Channeling pressurized beverages out of spears 158.

61) CO2-hose connectors 161 respectively are for:
Connecting CO2 hoses 155 to one of low-profile spear-top couplers 160.

62) Beverage-hose connectors 162 respectively are for:
Connecting beverage-dispensing hoses 164 to low-profile spear-top couplers 160.

63) Multi-position multi-height beverage-dispensing spigot system 163 is for:
a) Conveniently dispensing beverages at multiple different heights; and
b) Conveniently making root-beer floats.

64) Beverage-dispensing hoses 164 respectively are for:
Dispensing beverages from growlers 157.

65) Hose-and-spigot couplers 165 respectively are for:
Coupling beverage-dispensing hoses 164 to one of multi-position multi-height spigots 166; and 66) Multi-position multi-height spigots 166 respectively are for:
a) Conveniently being locked at multiple different positions;
b) Conveniently being locked at multiple different heights; and
c) Discharging beverages from beverage-dispensing hoses 164.

67) Beverage-dispensing spigot levers 167 respectively are for:
a) Hooking in spigot-locking receptacles 115 in retractable height-adjustable spigot-locking handle 114, to lock multi-position multi-height spigots 166 at multiple different positions;
b) Hooking in spigot-locking receptacles 115 in retractable height-adjustable spigot-locking handle 114, to lock multi-position multi-height spigots 166 at multiple different heights; and
c) Turning multi-position multi-height spigots 166 on and off.

68) Hose holes 168 respectively are for:
Threading beverage-dispensing hoses 164 through.

69) Hose washers 169 respectively are for:
Sealing hose holes 168.

70) Hose nuts 170 respectively are for:
Securing hose washers 169 and tube screws 171 on vibration-absorbing portable vault 102 and vibration-absorbing portable shell 103.

71) Tube screws 171 respectively are for:
Securing hose washers 169 and hose nuts 170 on vibration-absorbing portable vault 102 and vibration-absorbing portable shell 103.

Operation

The operation of the unique all-in-one, self-pressurizing, self-cooling, dual-retractable-dispensing-hose-and-tap, portable ice-cream root-beer-float-and-beverage dispensing system comprises:

How to Fill Up

The Unique All-In-One, Self-Pressurizing, Self-Cooling, Dual-Retractable-Dispensing-Hose-And-Tap, Portable Ice-Cream Root-Beer-Float-And-Beverage Dispensing System Referring to FIGS. 16A, 16B, 16C, 16D, 16E, and 17:

1) Filing up multi-flavor ice-cream compartments 124 with multi-flavor ice cream;
2) Snap-locking snap-on ice-cream lid 125 on root-beer-float-and-serving-tray lid 109;
3) Filing up growlers 157 with beverages;
4) Screwing spear-top cap 172 on spears 158, in the direction of arrow 173; and
5) Filing up tank 147 with CO2.

How To Hook Up And Secure

The Unique all-in-One, Self-Pressurizing, Self-Cooling, Dual-Retractable-Dispensing-Hose-And-Tap, Portable Ice-Cream Root-Beer-Float-And-Beverage Dispensing System Referring to FIGS. 18, 19, 20, 21, and 22:

1) Inserting growlers 157 into growler-locking recesses 105, respectively:
a) To securely lock growlers 157 in growler-locking recesses 105,
b) To prevent growlers 157 from sliding around, and
c) To securely lock growlers 157 within the rear wall and side wall of vibration-absorbing portable shell 103;

2) Inserting tank 147 into CO2-tank-locking recess 104:
   a) To securely lock tank 147 in CO2-tank-locking recess 104, and
   b) To prevent tank 147 from sliding around;
3) Unscrewing spear-top cap 172 from spears 158;
4) Screwing low-profile spear-top couplers 160 on spears 158;
5) Snap-locking resilient tank clamp 141 on the neck of tank 147;
6) Snap-locking double growler locks 142*a* and 142*b* on and between growlers 157:
   a) To lock together tank 147 and growlers 157,
   b) To use growler spacer 143 to space apart tank 147 and growlers 157,
   c) To use growler-locking disk 144 to lock anti-shaking anti-rolling tank-and-growler-clamping system 140 to tank 147 and growlers 157,
   d) To use double growler locks 142*a* and 142*b* to lock tank 147 and growlers 157 together,
   e) To restrict shaking of tank 147 and growlers 157,
   f) To restrict leaning of tank 147 and growlers 157, and
   g) To restrict rotating of tank 147 and growlers 157;
7) Connecting CO2 hoses 155 to CO2-hose adaptors 153 and CO2-hose connectors 161;
8) Connecting beverage-dispensing hoses 164 to beverage-hose connectors 162 and multi-position multi-height spigots 166;
9) Clamping hose-and-spigot couplers 165 on beverage-dispensing hoses 164 and multi-position multi-height spigots 166;
10) Inserting re-freezable cooling gel-packs 108 into vibration-absorbing portable shell 103:
   a) To keep growlers 157 cold for extended periods of time, and
   b) To keep multi-flavor ice-cream compartments 124 cold for extended periods of time;
11) Snap-locking root-beer-float-and-serving-tray lid 109 on
   vibration-absorbing portable vault 102 and
   vibration-absorbing portable shell 103;
12) Popping up snap-on ice-cream lid 125, in the direction of arrow 174;
13) Inserting multi-flavor ice cream in multi-flavor ice-cream compartments 124, respectively; and
14) Snap-locking snap-on ice-cream lid 125,
   in the direction of arrow 175.

How to Adjust
Multi-Position Multi-Height Spigots 166 to Different Heights

Referring to FIGS. 23, 24, 25A, 25B, 25C, 25D, 25E, 25F, 25G, 25H, 25I, and 26:

1) Pulling up on retractable height-adjustable spigot-locking handle 114
   to a desired height to extend height-adjustable telescopic posts 116,
   in the direction of arrow 176 or arrow 177;
2) Pulling up on at least one of multi-position multi-height spigots 166
   to the desired height to extend at least one of beverage-dispensing hoses 164,
   in the directions of arrows 178 and 179;
3) Hooking at least one of beverage-dispensing spigot levers 167
   in at least one of spigot-locking receptacles 115,
   in the direction of arrow 180:
   a) To lock multi-position multi-height spigots 166 at the desired height, and
   b) To conveniently dispense beverages at the desired height; and
4) Further, pulling up on retractable height-adjustable spigot-locking handle 114
   to a new height to further extend height-adjustable telescopic posts 116,
   in the direction of arrow 181:
   a) To lock multi-position multi-height spigots 166 at the new height, and
   b) To conveniently dispense beverages at the new height.

How to Transport and to Absorb Impact and Vibrations from the Ground Against
The Unique all-in-One, Self-Pressurizing, Self-Cooling, Dual-Retractable-Dispensing-Hose-And-Tap, Portable Ice-Cream Root-Beer-Float-And-Beverage Dispensing System Referring to FIGS. 27A, 27B, 27C, 27D, and 27E:

1) Extending height-adjustable telescopic posts 116;
2) Leaning retractable height-adjustable spigot-locking handle 114:
   a) To lean impact-and-vibration-absorbing self-cooling portable caddy system 101 on impact-and-vibration-absorbing wheel system 131, and
   b) To move the center of gravity of the unique all-in-one, portable ice-cream root-beer-float-and-beverage dispensing system over impact-and-vibration-absorbing wheel system 131; and
3) Pulling the unique all-in-one, portable ice-cream root-beer-float-and-beverage dispensing system along the ground, in one of the directions of arrows 182 and 183:
   a) To use wheel-impact-and-vibration-absorbing circular convex springs 136
   to absorb impact and vibrations from the ground, in the directions of arrows 184 and 185,
   b) To use spoke-impact-and-vibration-absorbing circular concave springs 137
   to absorb impact and vibrations from the ground, in the directions of arrows 184 and 185,
   c) To use tank-impact-and-vibration-absorbing circular springs 106
   to absorb impact and vibrations from the ground, in the directions of arrows 186 and 187, and
   d) To use growler-impact-and-vibration-absorbing circular springs 107
   to absorb impact and vibrations from the ground, in the directions of arrows 186 and 187.

Figure 28:
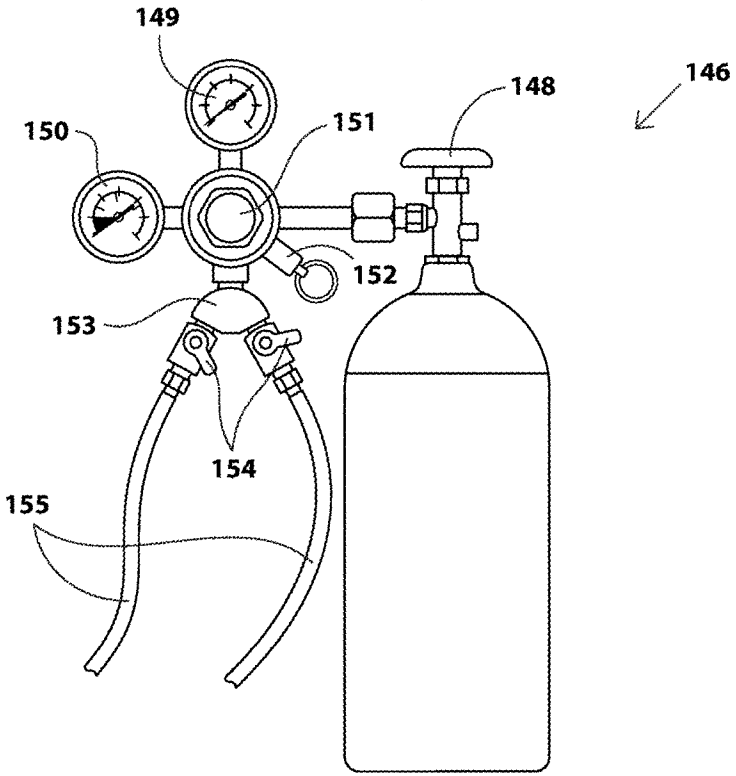
FIG. 28 illustrates a front view of how to adjust the CO2 pressure in the CO2 tank system.

How to Adjust the CO2 Pressure and to Pressurize
The Unique all-in-One, Self-Pressurizing, Self-Cooling, Dual-Retractable-Dispensing-Hose-And-Tap, Portable Ice-Cream Root-Beer-Float-And-Beverage Dispensing System Referring to FIG. 28:

1) Turning off CO2-hose on-and-off valves 154;
2) Rotating valve handle 148 to allow CO2 to flow out of tank 147;
3) Turning pressure-adjusting knob 151 to increase or decrease CO2 pressure; and
4) Turning on CO2-hose on-and-off valves 154 to dispense CO2 into beverage growler system 156 to carbonate beverages.

Figure 29:
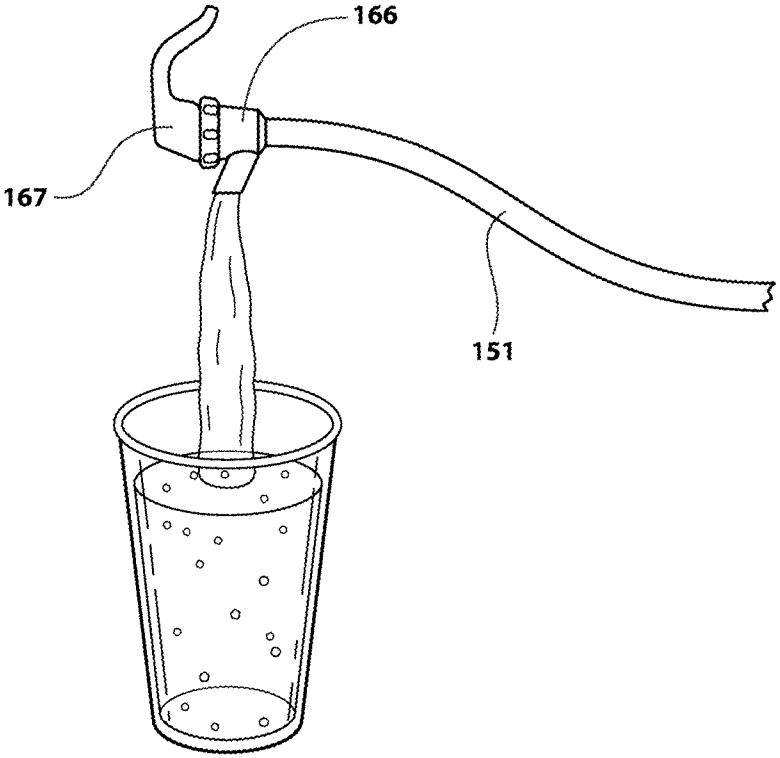
FIG. 29 illustrates a front view of how to dispense beverage from the multi-position multi-height spigot into a cup.

How to Dispense Beverages from
The Unique all-in-One, Self-Pressurizing, Self-Cooling, Dual-Retractable-Dispensing-Hose-And-Tap, Portable Ice-Cream Root-Beer-Float-And-Beverage Dispensing System Referring to FIG. 29:

1) Positioning at least one cup under at least one of multi-position multi-height spigots 166;

2) Squeezing at least one of beverage-dispensing spigot levers 167
to allow carbonated beverages to flow from at least one of
multi-position multi-height spigots 166 into the at least one cup; and
3) Releasing at least one of beverage-dispensing spigot levers 167
to stop carbonated beverages from flowing out of at least one of
multi-position multi-height spigots 166.

Figure 30:
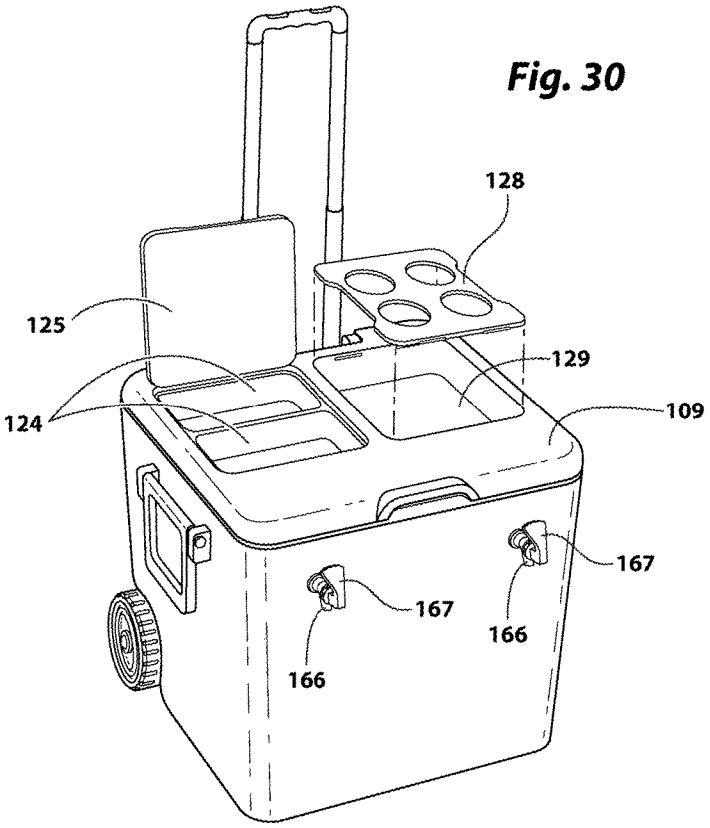
FIG. 30 illustrates a perspective view of how to dispense ice cream and to make root-beer floats from the multi-flavor ice-cream compartments and the snap-on removable cup-holder tray.

How to Dispense Ice Cream from
The Unique all-in-One, Self-Pressurizing, Self-Cooling, Dual-Retractable-Dispensing-Hose-And-Tap, Portable Ice-Cream Root-Beer-Float-And-Beverage Dispensing System Referring to FIG. 30:
1) Popping up snap-on ice-cream lid 125; and
2) Scooping multi-flavor ice cream from at least one of multi-flavor ice-cream compartments 124 into cups.

How to Make Root-Beer Floats from
The Unique all-in-One, Self-Pressurizing, Self-Cooling, Dual-Retractable-Dispensing-Hose-And-Tap, Portable Ice-Cream Root-Beer-Float-And-Beverage Dispensing System Referring to FIG. 30:
1) Placing cups into snap-on removable cup-holder tray 128, respectively;
2) Popping up snap-on ice-cream lid 125;
3) Scooping multi-flavor ice cream from at least one of multi-flavor ice-cream compartments 124 into the cups;
4) Positioning cups under multi-position multi-height spigots 166;
5) Squeezing beverage-dispensing spigot levers 167, to allow carbonated beverages to flow from multi-position multi-height spigots 166 into the cups, respectively;
6) Releasing beverage-dispensing spigot levers 167 to stop carbonated beverages from flowing out of multi-position multi-height spigots 166;
7) Popping up snap-on removable cup-holder tray 128 from
root-beer-float-and-serving-tray lid 109; and
8) Conveniently serving multi-flavor root-beer floats.

Variation

Figure 31:
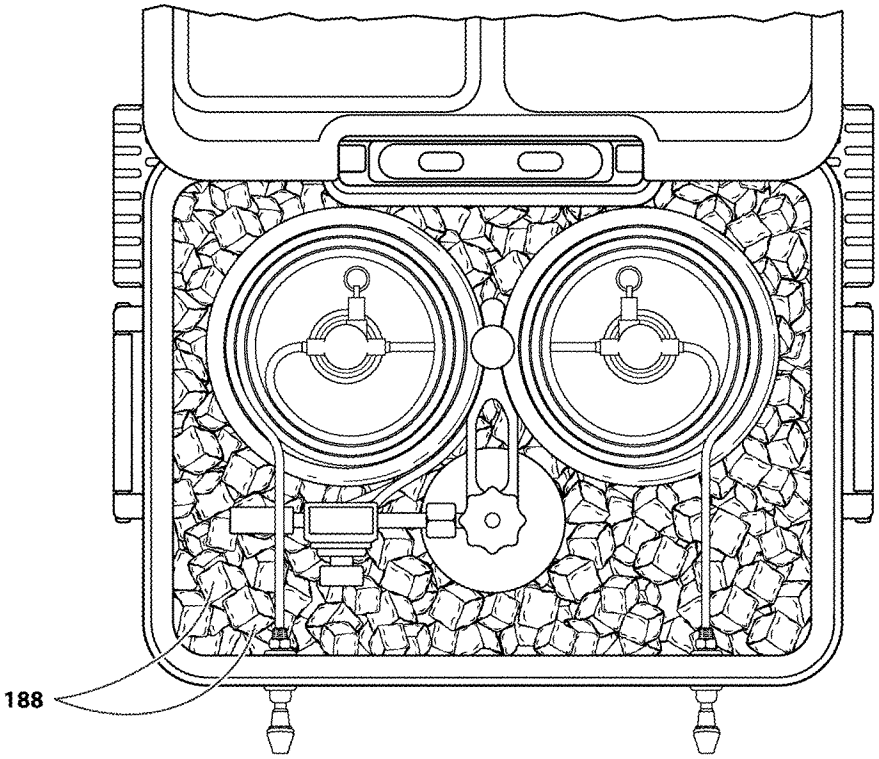
FIG. 31 illustrates a top interior view of how the beverage growler system and the CO2 tank system are cooled by ice cubes.

Each component of the unique all-in-one, self-pressurizing, self-cooling, dual-retractable-dispensing-hose-and-tap, portable ice-cream root-beer-float-and-beverage dispensing system can have any shape and size, can be replaced with an equivalent, and can be disposed at any position in the unique all-in-one, self-pressurizing, self-cooling, dual-retractable-dispensing-hose-and-tap, portable ice-cream root-beer-float-and-beverage dispensing system. For example:

FIG. 31 illustrates ice cubes 188, which are equivalent to, and may replace re-freezable cooling gel-packs 108.

Figure 32:
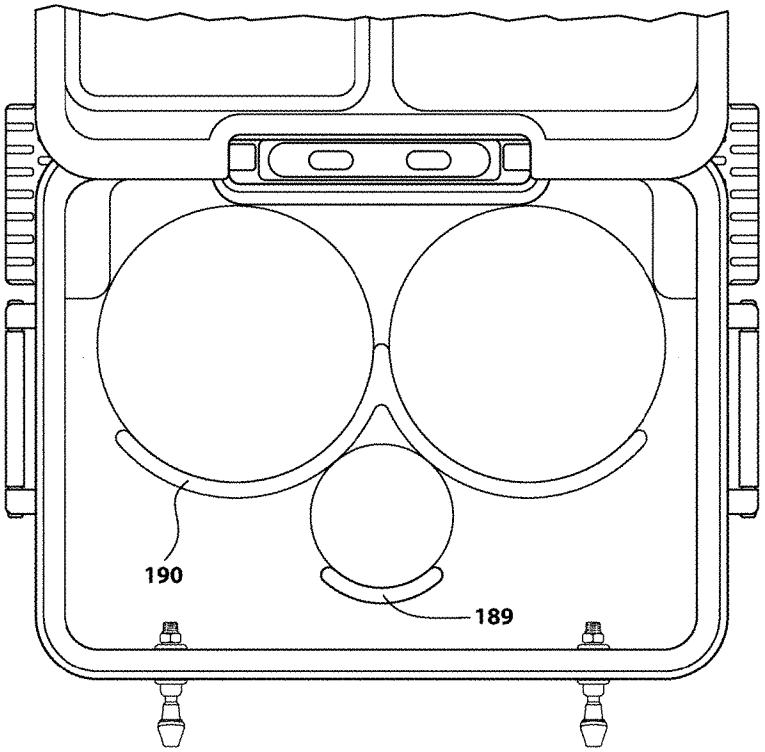
FIGS. 32, 33, 34, 35, 36, 37, and 38 illustrate top views of variations of the tank-impact-and-vibration-absorbing springs and the growler-impact-and-vibration-absorbing springs.

FIG. 32 illustrates equivalent variations 189 and 190 of tank-impact-and-vibration-absorbing circular springs 106 and growler-impact-and-vibration-absorbing circular springs 107, respectively.

Figure 33:
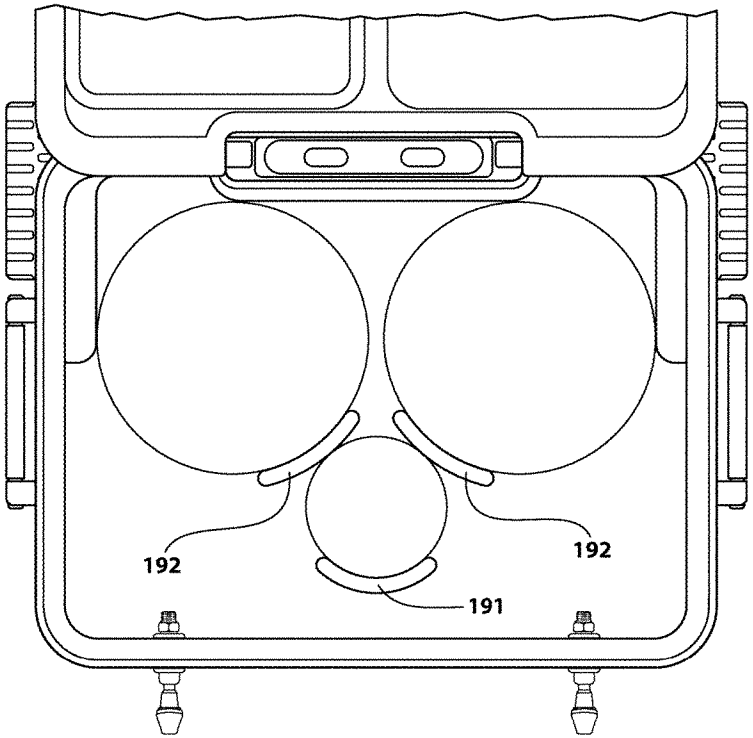

FIG. 33 illustrates equivalent variations 191 and 192 of tank-impact-and-vibration-absorbing circular springs 106 and growler-impact-and-vibration-absorbing circular springs 107, respectively.

Figure 34:
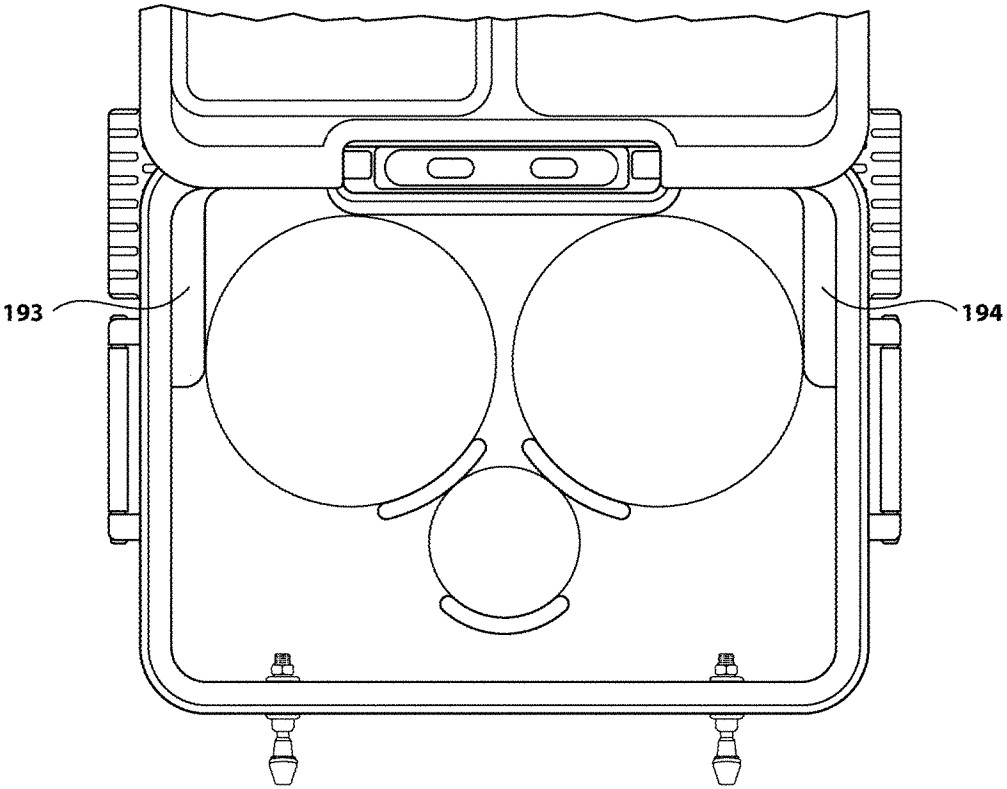

FIG. 34 illustrates equivalent variations 193 and 194 of wheel wells 139.

Figure 35:
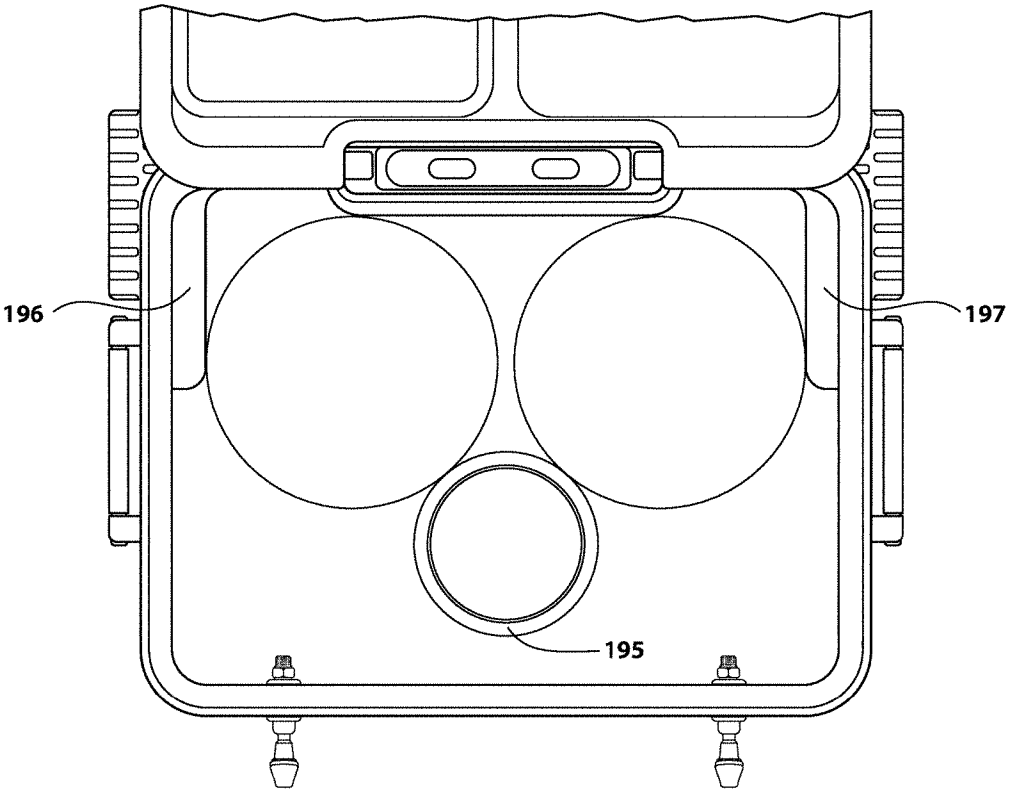

FIG. 35 illustrates a combination of spring 195 and wheel wells 196 and 197. This combination is equivalent to the combination of tank-impact-and-vibration-absorbing circular springs 106, growler-impact-and-vibration-absorbing circular springs 107, and wheel wells 139, respectively.

Figure 36:
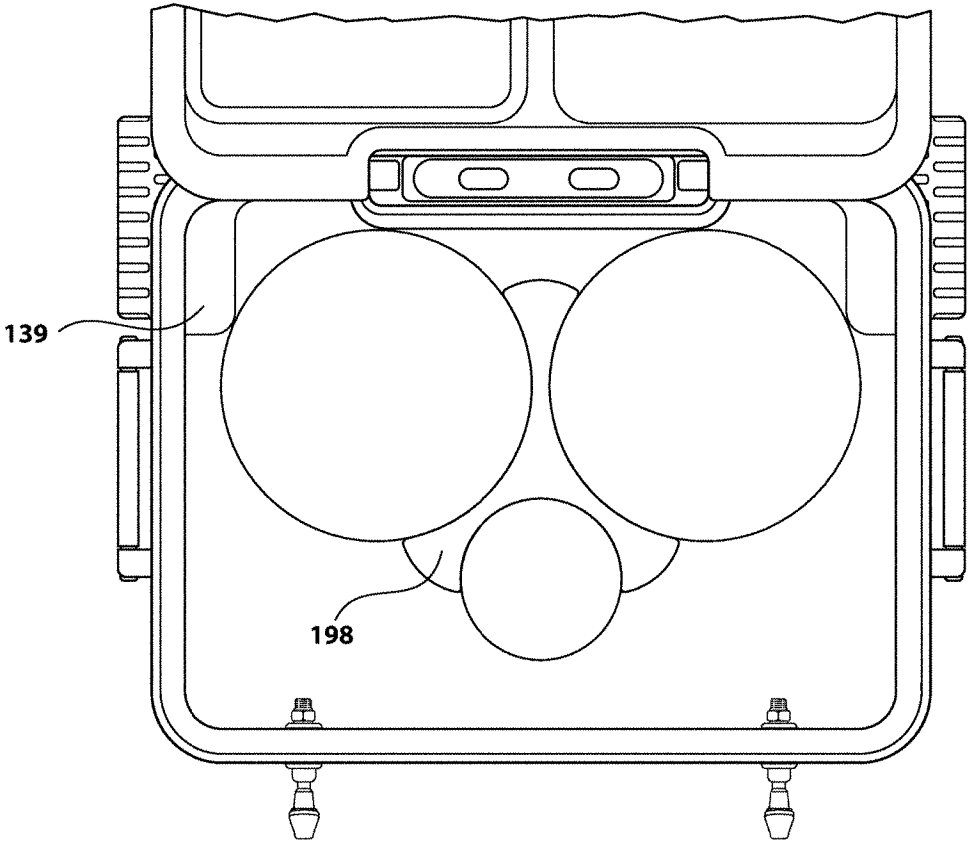

FIG. 36 illustrates a combination of spring 198 and wheel wells 139. This combination is equivalent to the combination of tank-impact-and-vibration-absorbing circular springs 106, growler-impact-and-vibration-absorbing circular springs 107, and wheel wells 139, respectively.

Figure 37:
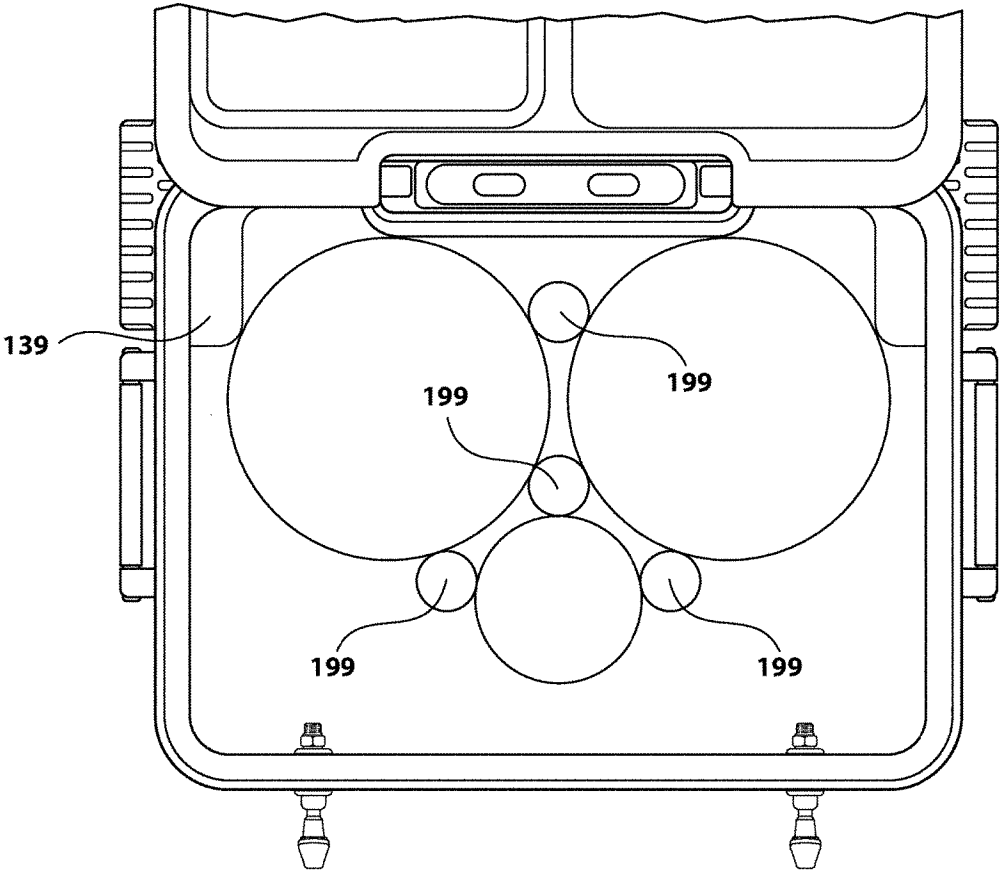

FIG. 37 illustrates a combination of springs 199 and wheel wells 139. This combination is equivalent to the combination of tank-impact-and-vibration-absorbing circular springs 106, growler-impact-and-vibration-absorbing circular springs 107, and wheel wells 139, respectively.

Figure 38:
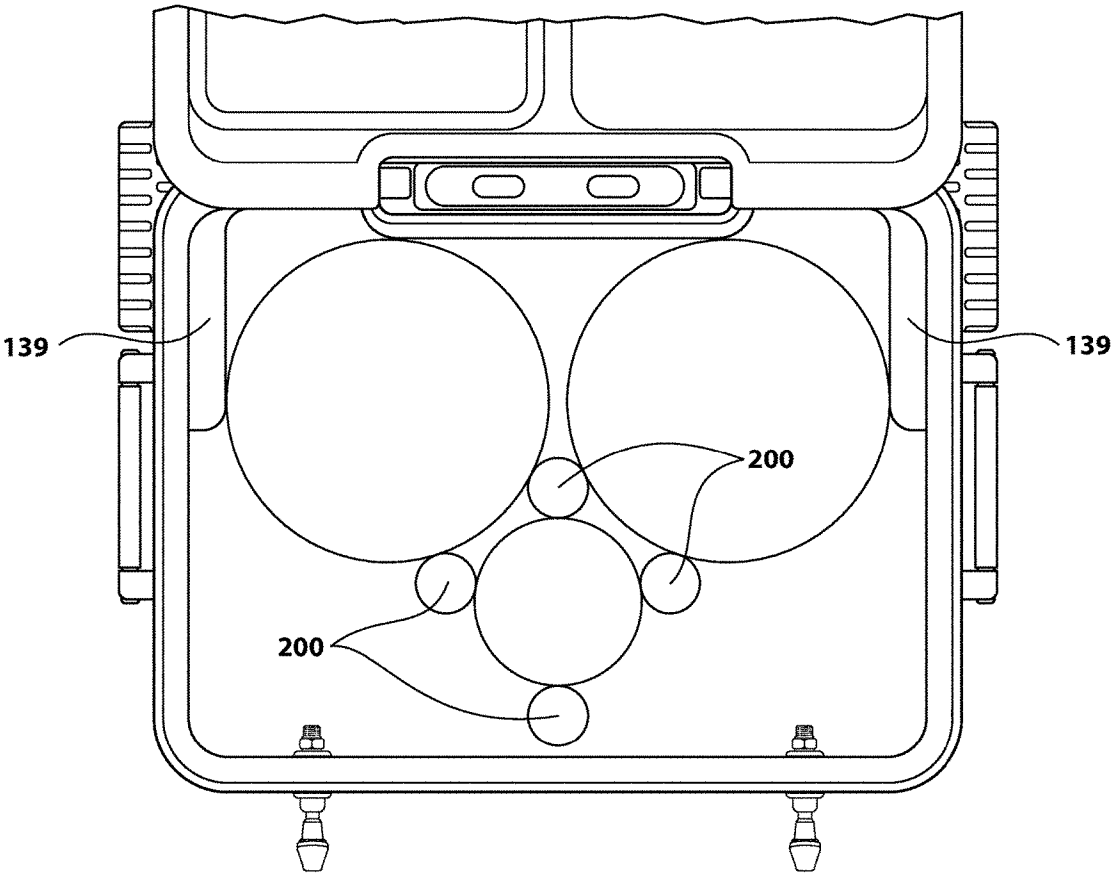

FIG. 38 illustrates a combination of springs 200 and wheel wells 139. This combination is equivalent to the combination of tank-impact-and-vibration-absorbing circular springs 106, growler-impact-and-vibration-absorbing circular springs 107, and wheel wells 139, respectively.

Figure 39:
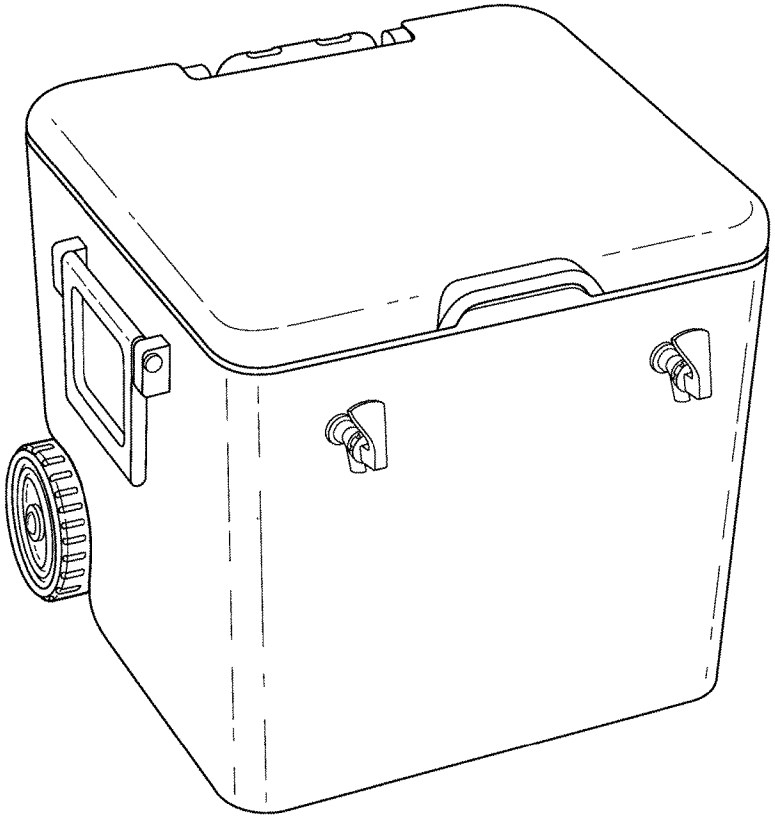
FIG. 39 illustrates a perspective view of a variation of the root-beer-float-and-serving-tray lid.
Figure 40A:
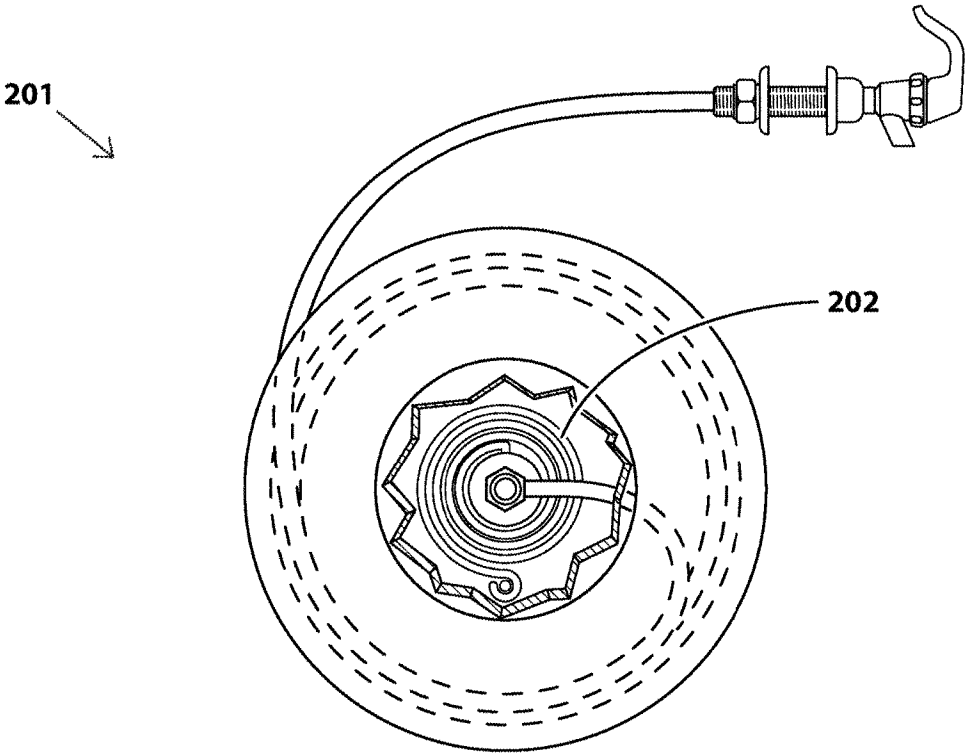
FIGS. 40A, 40B, 40C, and 40D illustrate side and top views of spring-assisted retractable-beverage-hose reels.
Figure 40B:
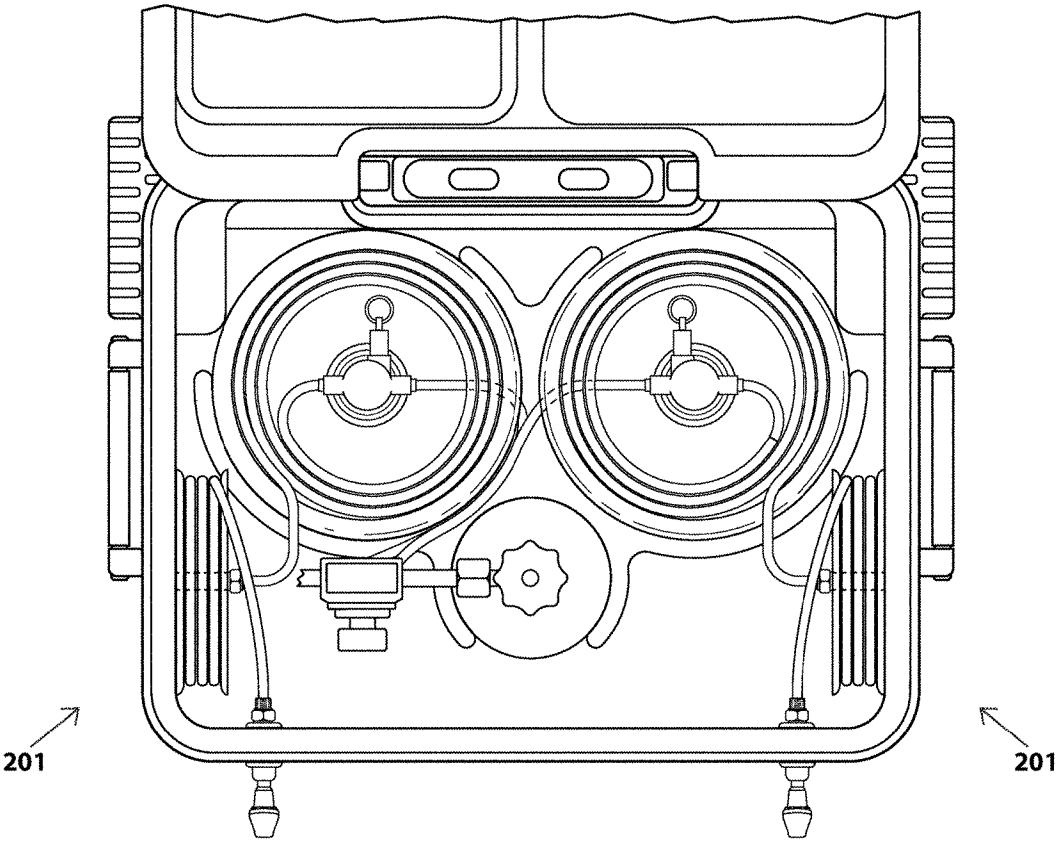
Figure 40C:
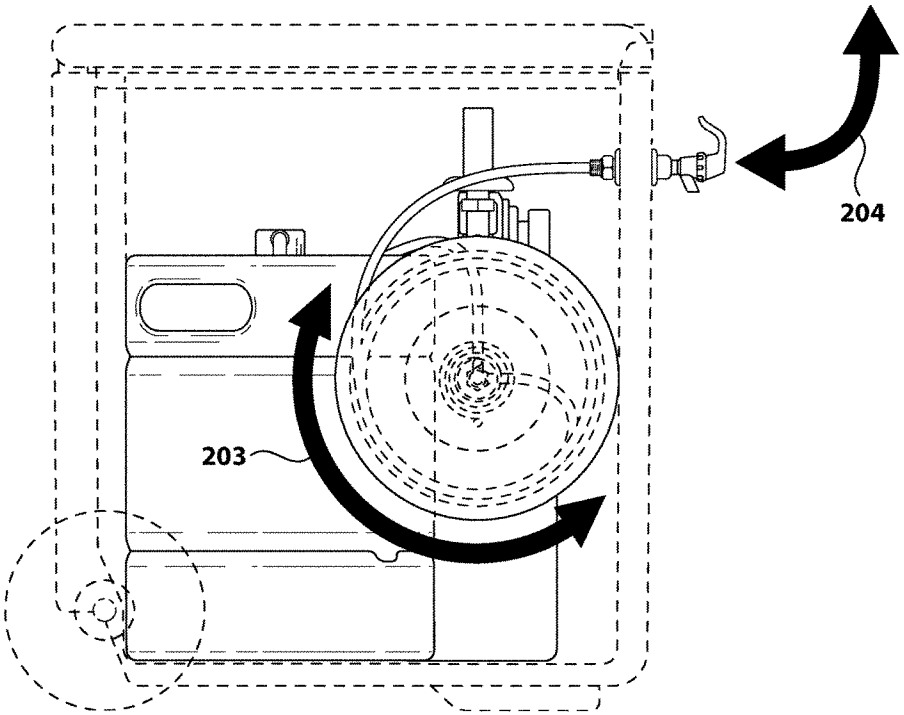
Figure 40D:
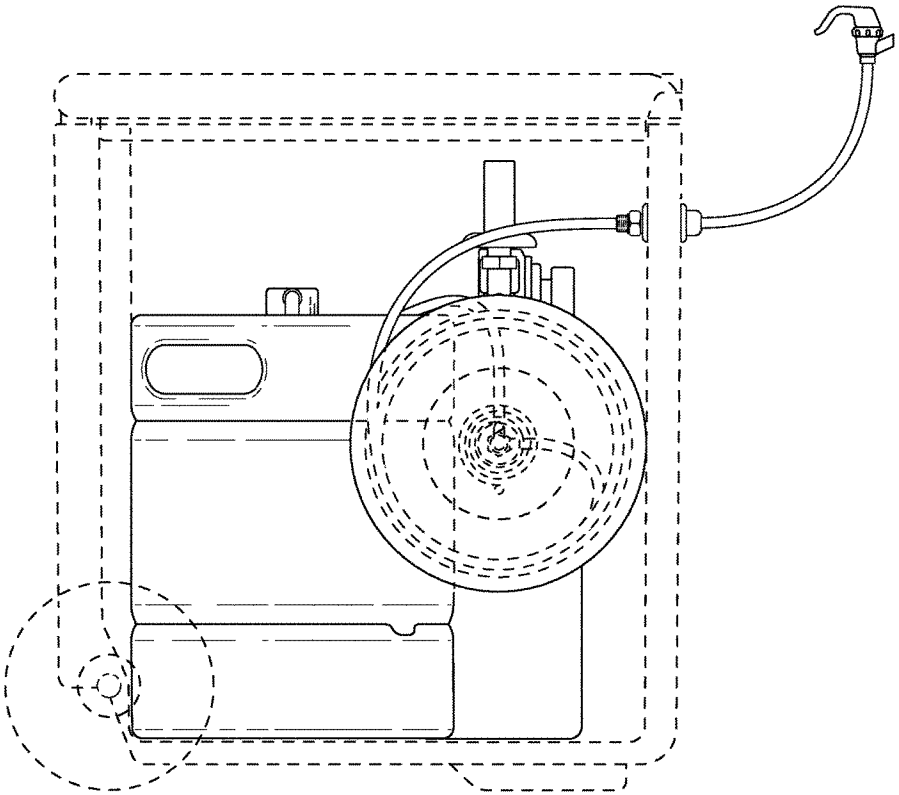
Figure 41B:
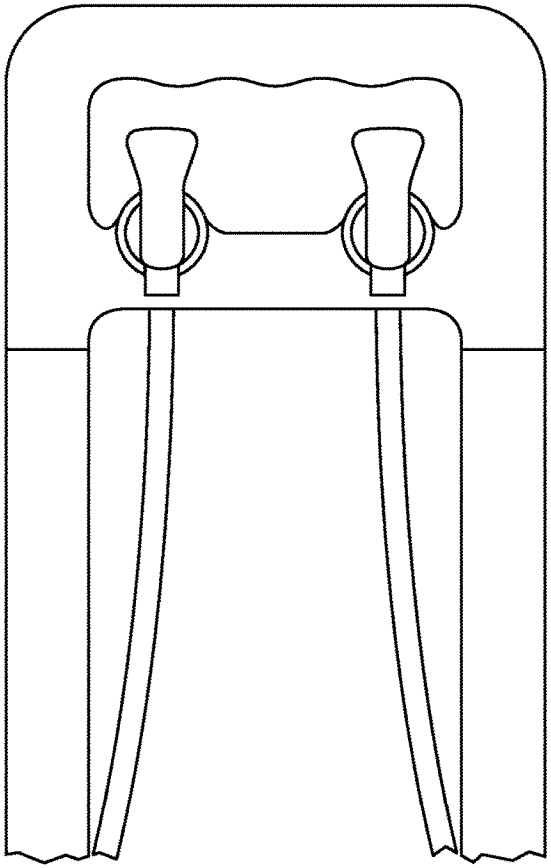
FIGS. 41A, 41B, 42A, and 42B illustrate front views of variations of the retractable height-adjustable spigot-locking handle and the spigot-locking receptacles.
Figure 41A:
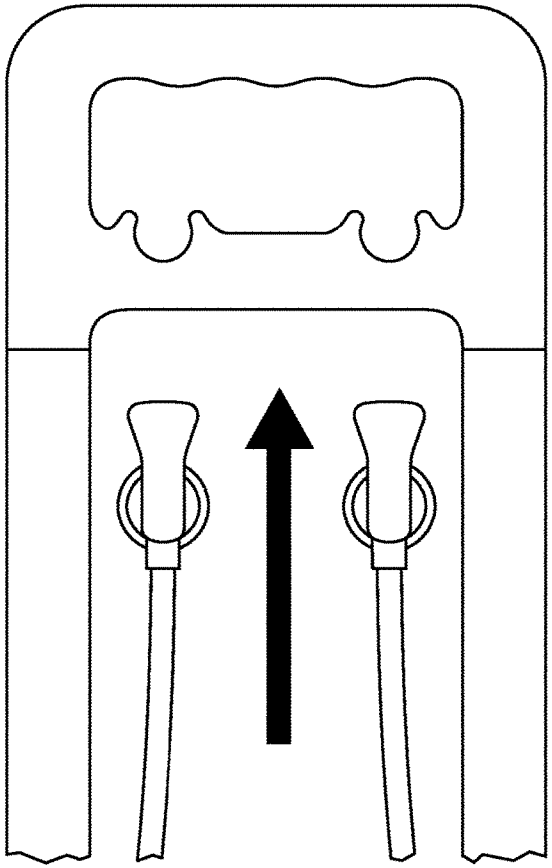
Figure 42B:
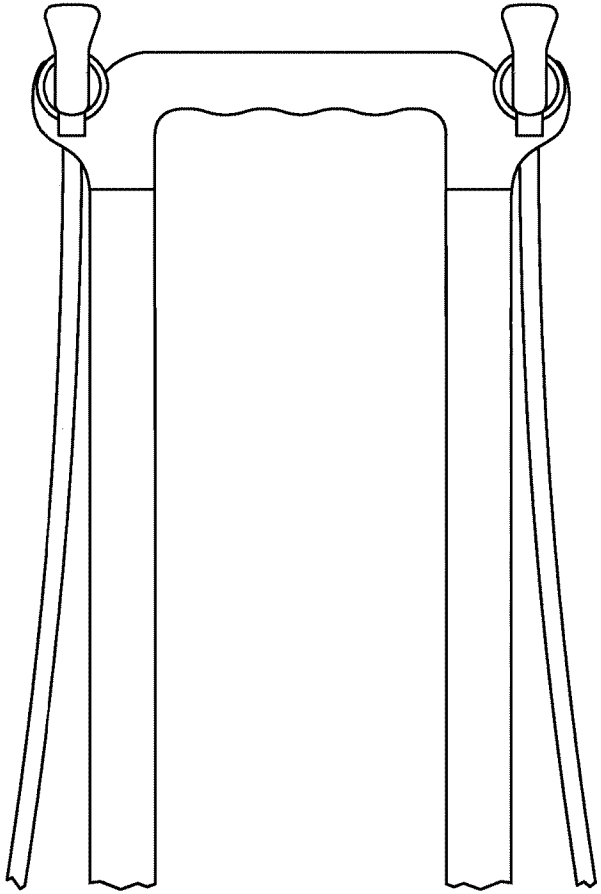
Figure 42A:
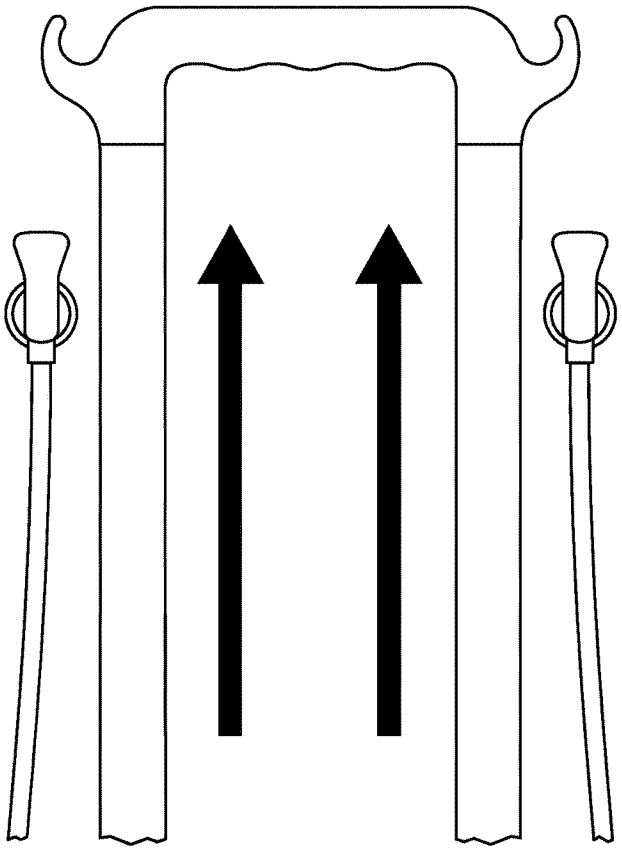
Figure 43D:
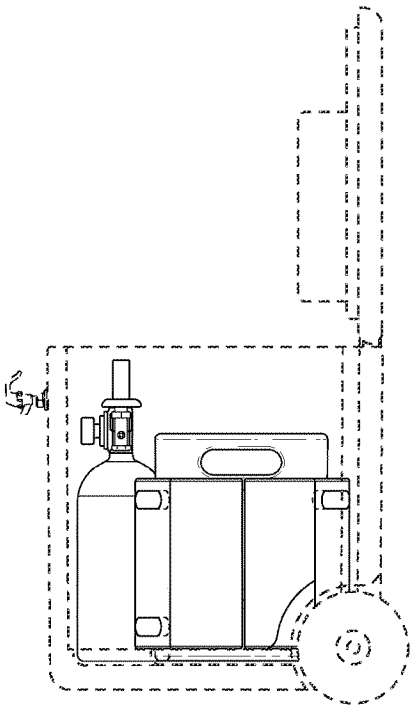
FIGS. 43A, 43B, 43C, 43D, and 43E illustrate top and side views of variations of the re-freezable cooling gel-packs, and how they cool the beverage growler system.
Figure 43C:
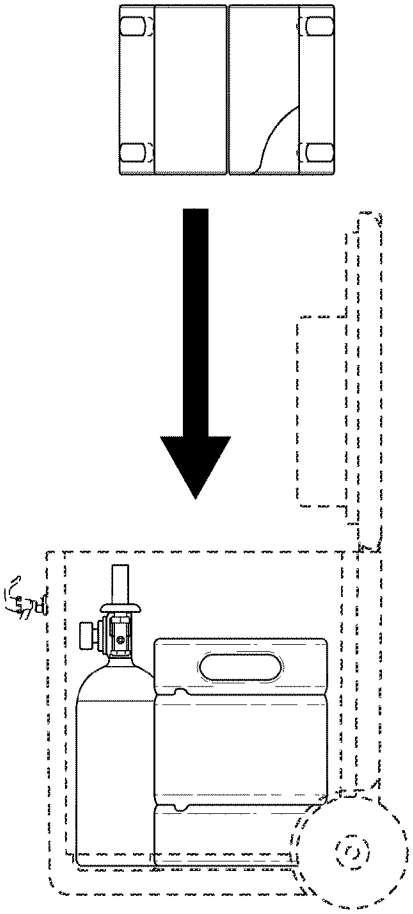
Figure 43A:
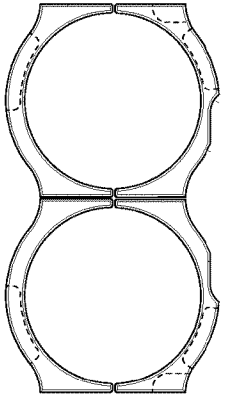
Figure 43B:
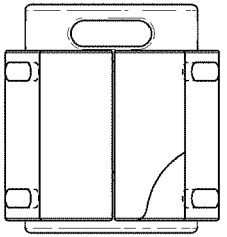
Figure 43E:
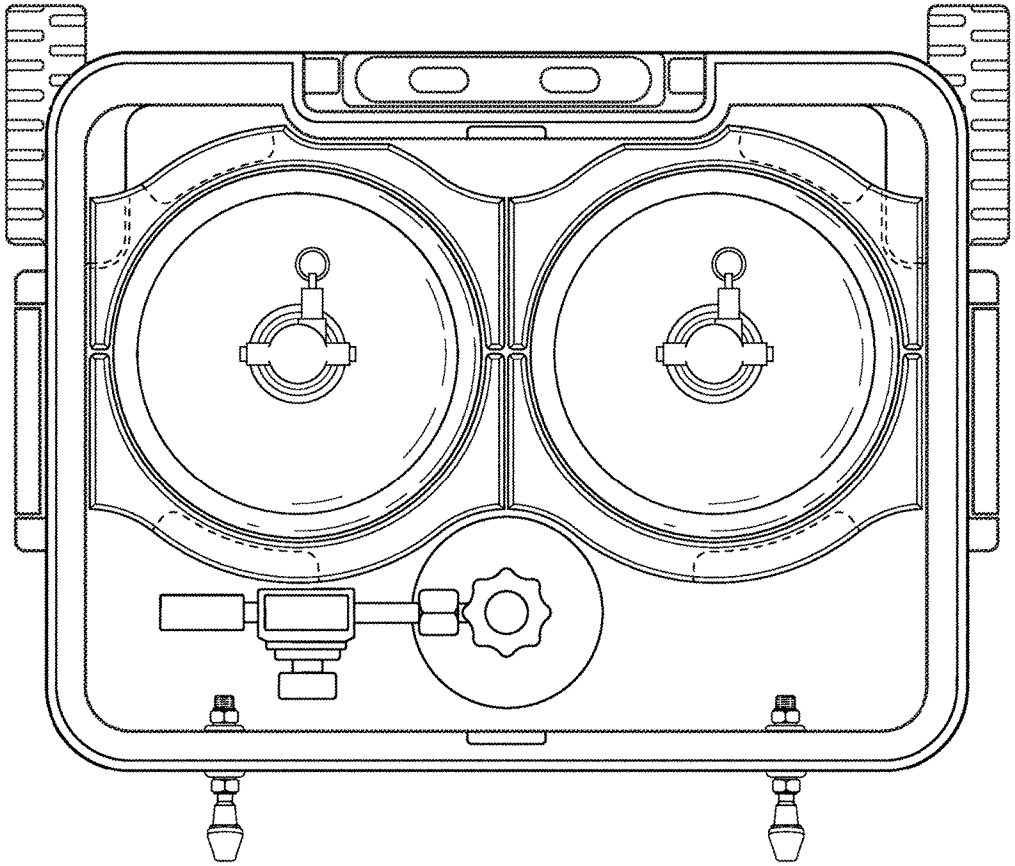

FIG. 39 illustrates a variation of root-beer-float-and-serving-tray lid 109.

FIGS. 40A, 40B, 40C, and 40D illustrate spring-assisted retractable-beverage-hose reels 201 having spring 202. Spring-assisted retractable-beverage-hose reels 201 can rotate, in the opposite directions of arrow 203, to retract and extend beverage-dispensing hoses 164, in the opposite directions of arrow 204, respectively.

FIGS. 41A, 41B, 42A, and 42B illustrate variations of retractable height-adjustable spigot-locking handle 114 and spigot-locking receptacles 115.

FIGS. 43A, 43B, 43C, 43D, and 43E illustrate variations of re-freezable cooling gel-packs 108, and how they wrap around and cool beverage growler system 156.

Figure 44:
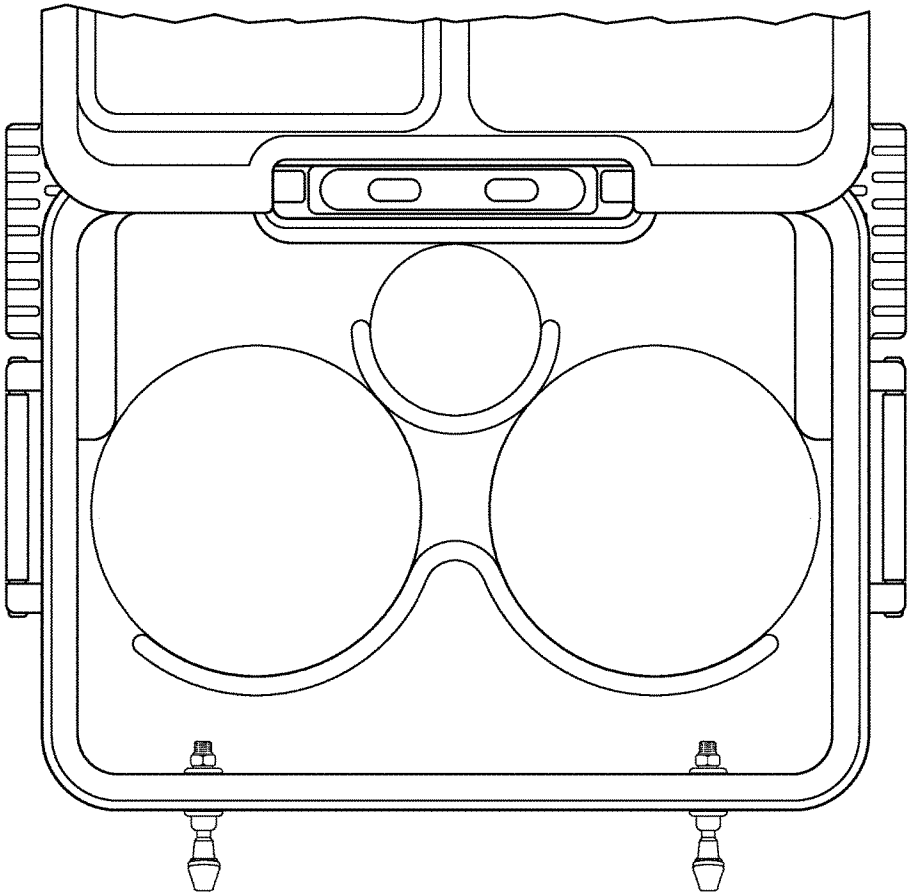
FIG. 44 illustrates a top view of a variation of how to position the CO2-tank-locking recess, the growler-locking recesses, the tank-impact-and-vibration-absorbing circular springs, and the growler-impact-and-vibration-absorbing circular springs.

FIG. 44 illustrates a variation of how to position CO2-tank-locking recess 104, growler-locking recesses 105, tank-impact-and-vibration-absorbing circular springs 106, and growler-impact-and-vibration-absorbing circular springs 107.

CO2-tank-locking recess 104, growler-locking recesses 105, tank-impact-and-vibration-absorbing circular springs 106, and growler-impact-and-vibration-absorbing circular springs 107 can each be disposed at any position inside impact-and-vibration-absorbing self-cooling portable caddy system 101.

Major Advantages of the Invention

The present invention substantially departs from the conventional concepts and designs of the prior art. In doing so, the present invention provides an impact-and-vibration-absorbing self-cooling portable caddy system, having multiple unique capabilities, functions, and advantages, which overcome all the disadvantages of the prior art, as follows:

1) (FIGS. 41A, 41B, 42A, 42B, 25F, 25G, 25H, and 25I)

Multi-position multi-height spigots 166 of the impact-and-vibration-absorbing self-cooling portable caddy system are instantly adjustable to add convenience to operating the root beer or other beverage dispensing process. Multi-position multi-height spigots 166 are made available at any typically useful height that a person doing this operation would need, while needed. In addition, multi-position multi-height spigots 166 can be immediately re-adjusted without tools or any time-wasting methods used in prior art methods.

Figure 24:
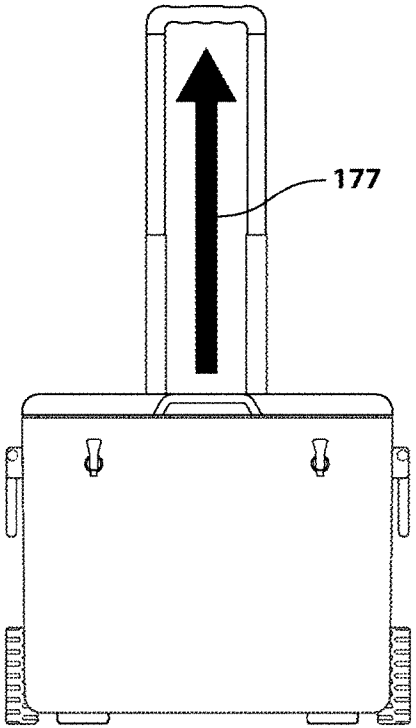
FIGS. 23 and 24 illustrate elevational front views of the impact-and-vibration-absorbing self-cooling portable caddy system and the multi-position multi-height beverage-dispensing spigot system (with the retractable height-adjustable spigot-locking handle in extended positions of different heights).
Figure 23:
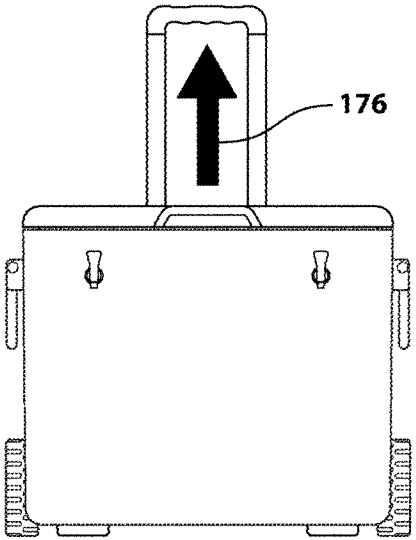

2) (FIGS. 23, 24, and 39)

When multi-position multi-height spigots 166 of the impact-and-vibration-absorbing self-cooling portable caddy system complete their serving operation, the adjustable handles with spigot-locking receptacles 115 are quickly and conveniently retracted back into post tunnels 117 and are compacted, out-of-the-way, and ready for transport. The prior art has no mechanism to accomplish this.

3) (FIGS. 18, 19, 27B, 27C, 14A, 14B, 15D, 27D, and 27C)

Anti-shaking anti-rolling tank-and-growler-clamping system 140 reduces vibration, rocking, and other movement. The Vibration is absorbed and controlled by Growler-impact-and-vibration-absorbing circular springs 107. These 2 systems reduce or eliminate pressure build-up in the carbonated beverage contained within the growler canisters. The prior art has no mechanism to accomplish this.

Anti-shaking anti-rolling tank-and-growler-clamping system 140 combined with Growler-impact-and-vibration-absorbing circular springs 107 is multi-functional, which accomplishes 4 things in one: a) Stabilizes the kegs b) separates the growler kegs from one another to eliminate the kegs from colliding while in transit (as the prior art will collide with one another) c) Absorbs vertical shock as the weight of the kegs bounce up and down during movement over uneven surfaces, and d) Anti-shaking anti-rolling tank-and-growler-clamping system 141 is conveniently small and easy to deploy.

4) (FIGS. 18, 19, 27B, 27C, 14A, 14B, 15D, 27D, and 27C)

CO2-tank-locking recess 104 reduces or eliminates sliding, rocking, and other movement of the heavy and top-heavy CO2 tank. The vibration and vertical movement is absorbed, dampened, and controlled by tank-impact-and-vibration-absorbing circular springs 106. These components together will greatly reduce the danger posed by the three tanks colliding while in a vehicle during transport, or being transported over rough surfaces. The prior art has no mechanism to accomplish this.

5) (FIGS. 40A, 40B, 40C, and 40D)

Spring-assisted retractable-beverage-hose reels 201 are for beverage-dispensing hoses 164 to wind thereon to retract multi-position multi-height spigots 166 out-of-the-way and are available to operate the spigots and dispense beverages directly from the front face of the cooler. This is for situations when the cooler would be sitting on a table or other elevated location.

6) (FIGS. 25A, 25B, 25C, 25D, 25E, 40A, 40B, 40C, and 40D) Spring-assisted retractable-beverage-hose reels 201 are able to be deployed at multiple heights when the impact-and-vibration-absorbing self-cooling portable caddy system is positioned at ground level the hoses/spigots can be quickly pulled out and deployed, to be securely stationed atop spigot-locking receptacles 115 at any desired height.

Figure 7B:
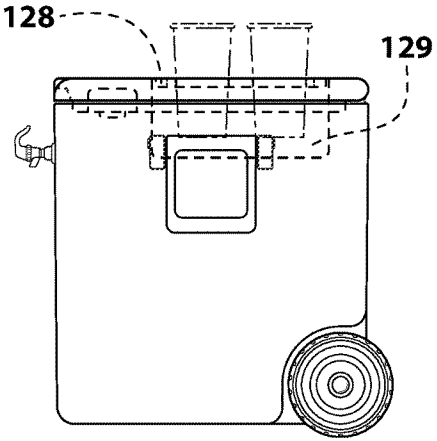
FIGS. 7A, 7B, and 7C illustrate perspective and side views of the impact-and-vibration-absorbing self-cooling portable caddy system, the root-beer-float system, the impact-and-vibration-absorbing wheel system, and the multi-position multi-height beverage-dispensing spigot system (with a retractable height-adjustable spigot-locking handle in an extended position and a snap-on removable cup-holder tray in an elevated position).
Figure 7C:
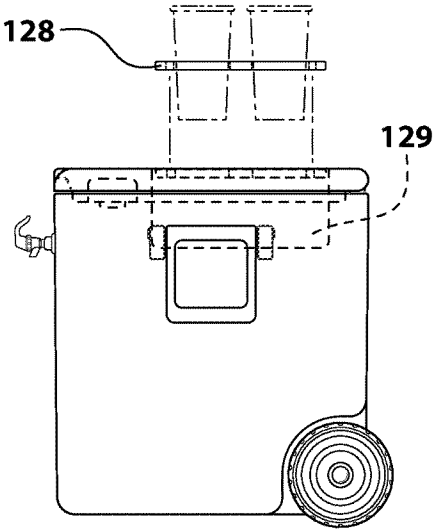
Figure 7A:
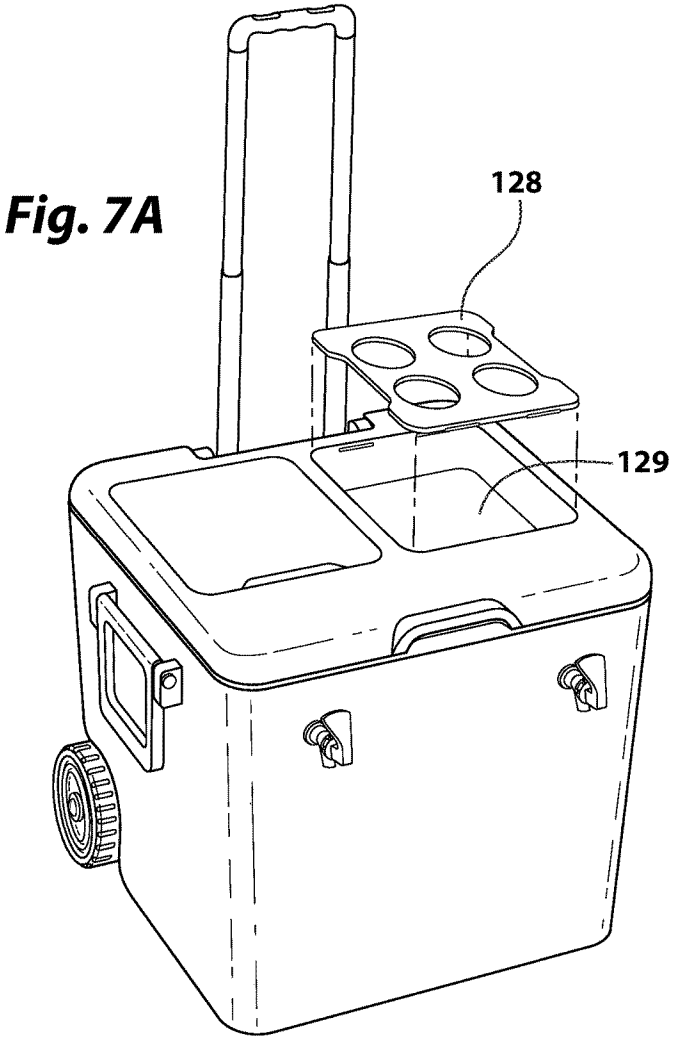
Figures 8A, 8B, 8C:
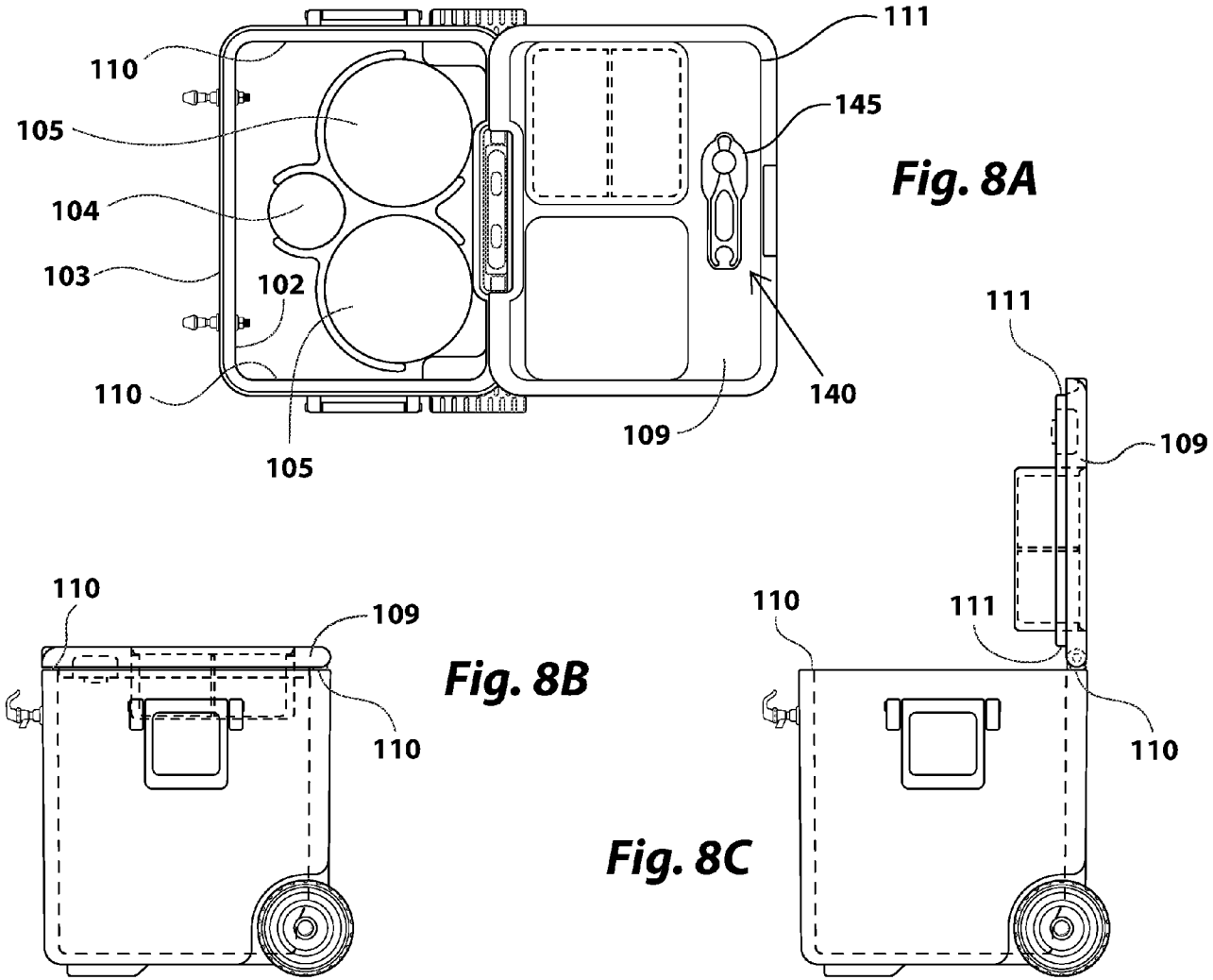
FIGS. 8A, 8B, and 8C illustrate interior and side view of the impact-and-vibration-absorbing self-cooling portable caddy system, the anti-shaking anti-rolling tank-and-growler-clamping system (in a stored position), and the multi-position multi-height beverage-dispensing spigot system.
Figure 9B:
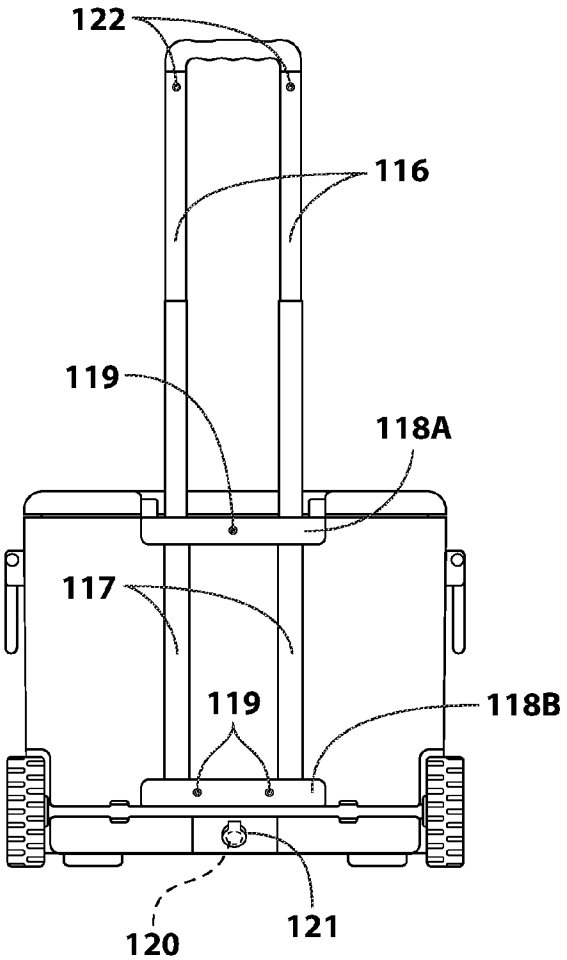
FIGS. 9A and 9B illustrate elevational rear views of the impact-and-vibration-absorbing self-cooling portable caddy system (with a retractable height-adjustable spigot-locking handle in a retracted position and an extended position, respectively).
Figure 9A:
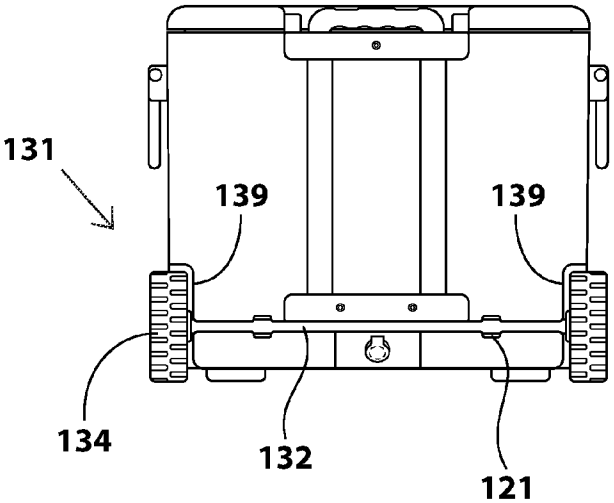
Figure 10B:
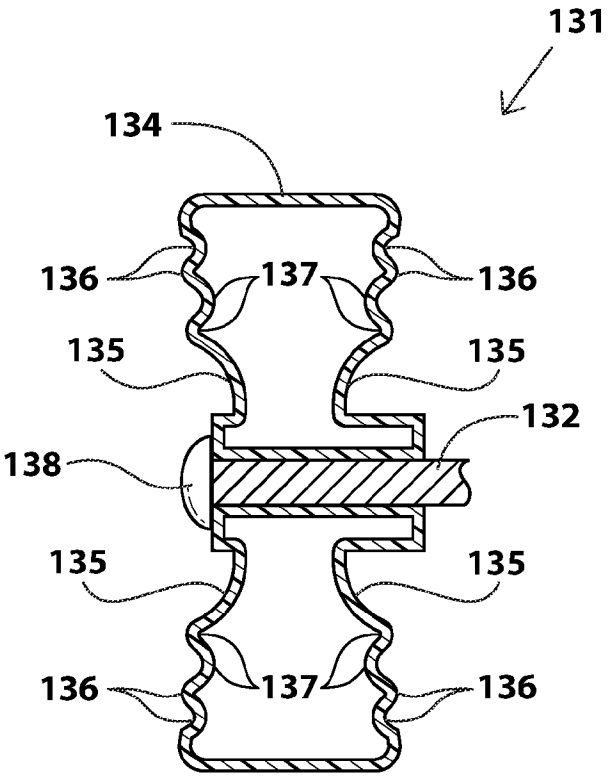
FIGS. 10A and 10B illustrate a side view and a cross-sectional view of the impact-and-vibration-absorbing wheel system.
Figure 10A:
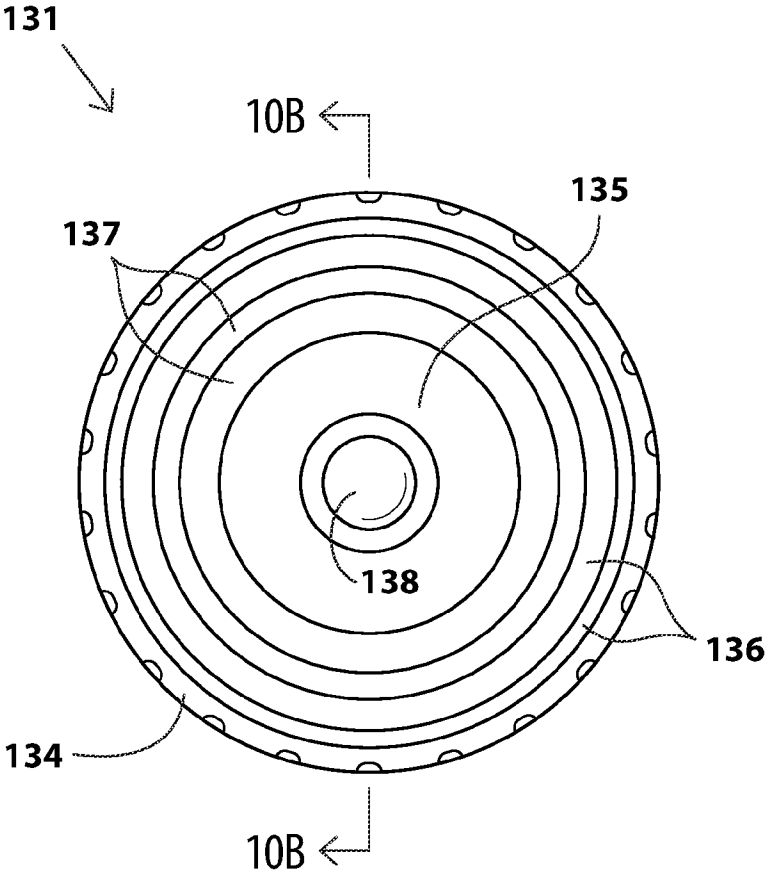
Figure 11:
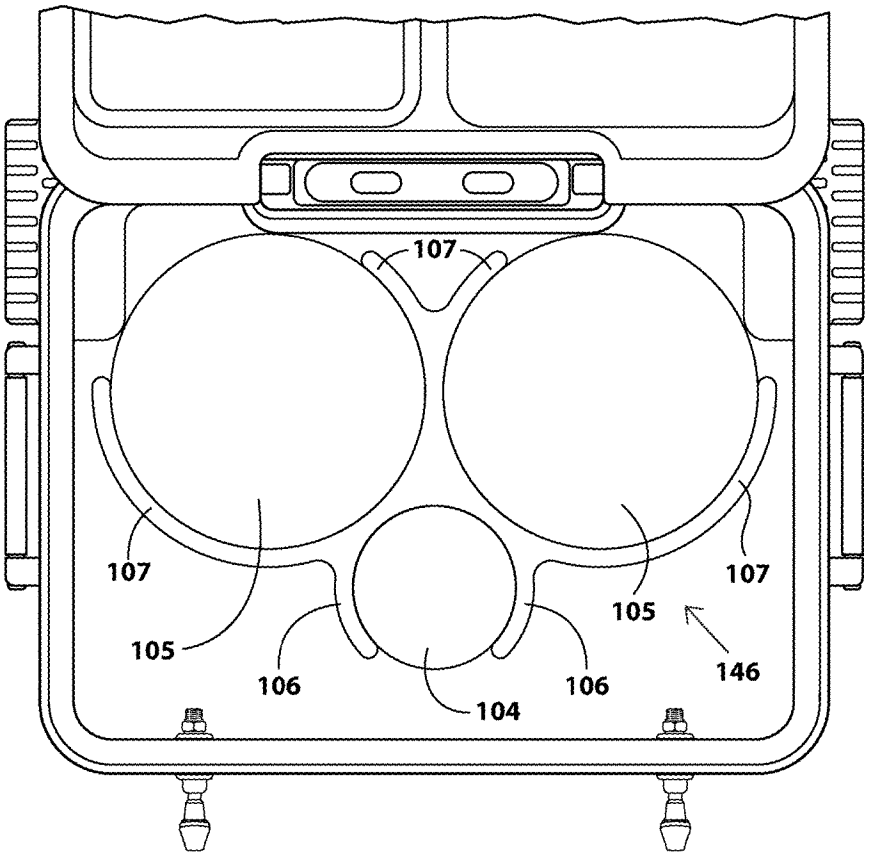
FIG. 11 illustrates a top interior view of the impact-and-vibration-absorbing self-cooling portable caddy system (with tank-impact-and-vibration-absorbing circular springs, growler-impact-and-vibration-absorbing circular springs, CO2-tank-locking recess, and growler-locking recesses).
Figure 13:
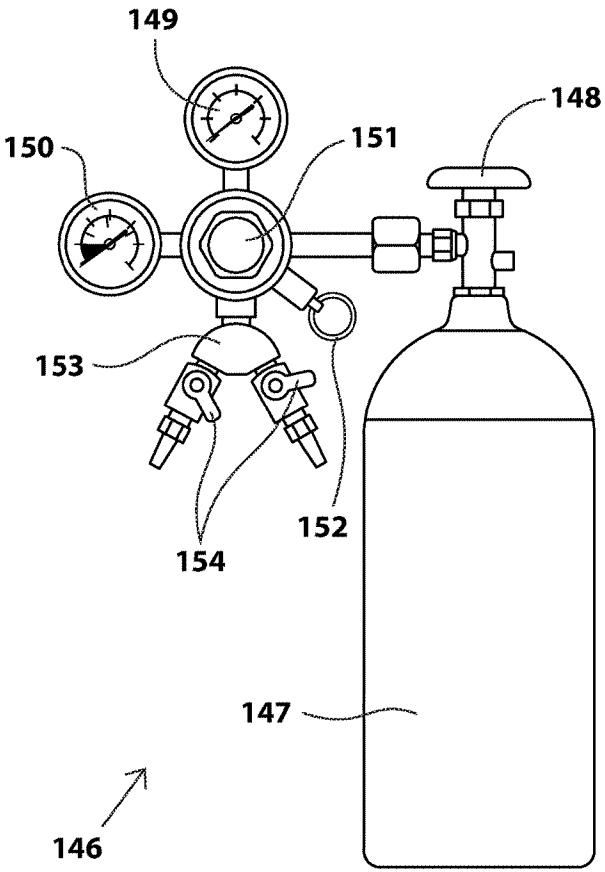
FIG. 13 illustrates a front view of a CO2 tank system.
Figure 12A:
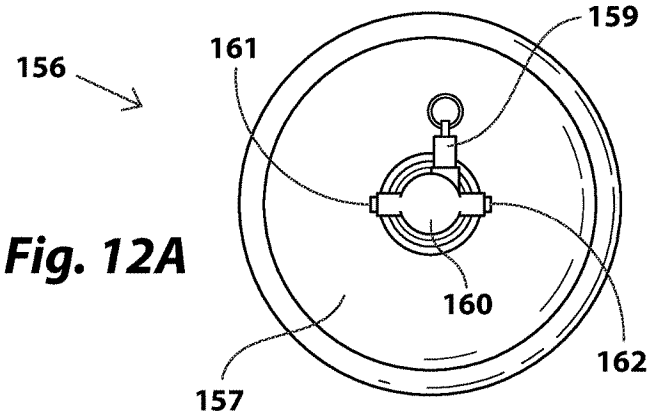
FIGS. 12A and 12B illustrate top and side views of a beverage growler system.
Figure 12B:
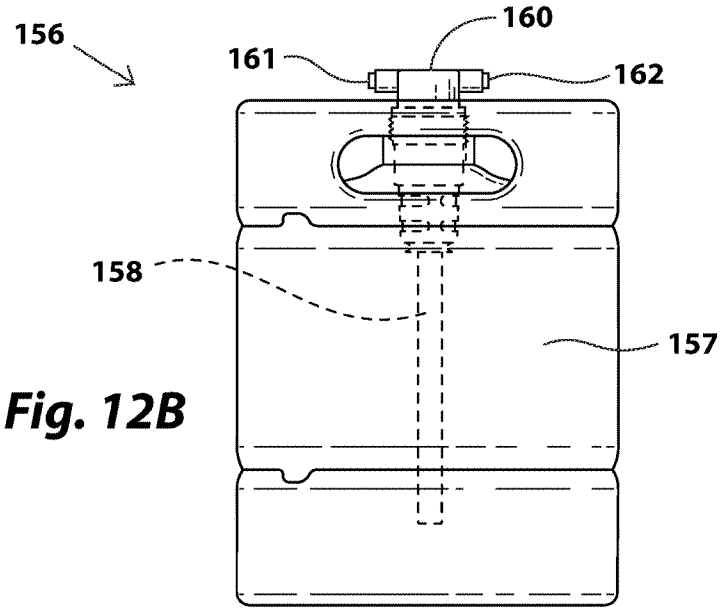
Figure 14A:
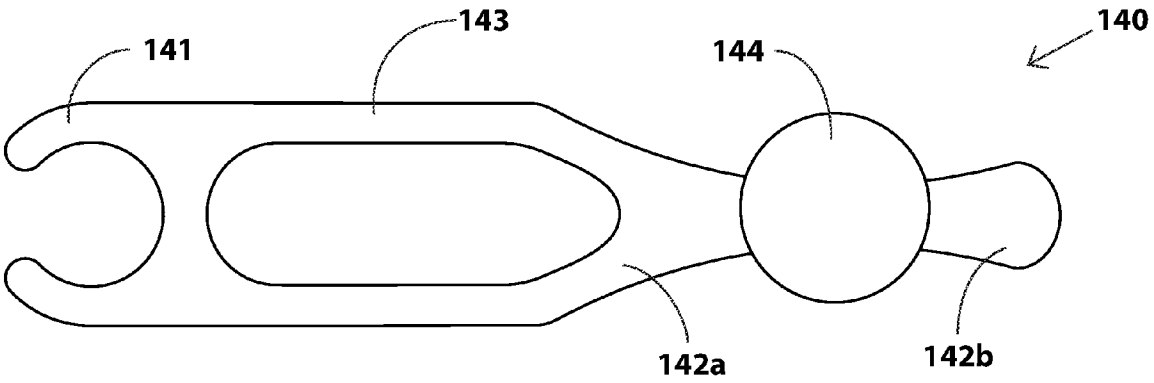
FIGS. 14A and 14B illustrates top and side views of an anti-shaking anti-rolling tank-and-growler-clamping system.
Figure 14B:
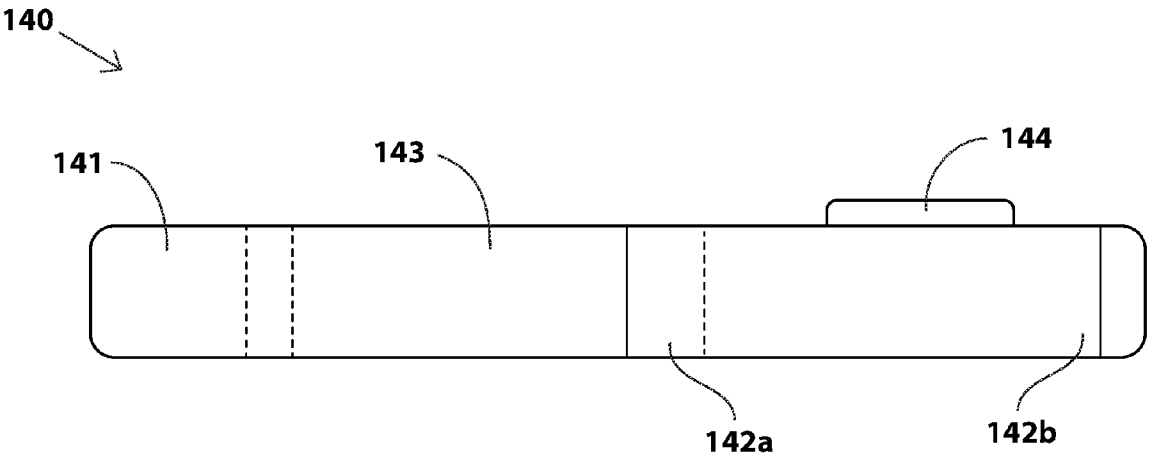

7) (FIGS. 7A, 7B, and 7C)

Snap-on removable cup-holder tray 128 is part of the built-in ice-cream-and-root-beer float system, which provides a way to securely hold multiple cups while preparing the root beer floats and snap-on removable cup-holder tray 128 then snaps out to serve the root beer floats to thirsty recipients.

8) (FIGS. 4, 5, 6B and 6C)

Multi-flavor ice-cream compartments 124 is designed to provide multiple (one or more) flavors of ice-cream. This increases the convenience as well as serving and time efficiency. This gives immediate choices to the recipient being served and makes this impact-and-vibration-absorbing self-cooling portable caddy system more desirable than the prior art.

9) (FIGS. 10A, 10B, 27A, and 27B)

Impact-and-vibration-absorbing wheel system 131 is in contact with the rolling surface, on which the impact-and-vibration-absorbing self-cooling portable caddy system would be transported. The surface may be uneven and therefore would cause the beverages and ice cream to be shaken. Impact-and-vibration-absorbing wheel system 131, in companionship with the anti-shaking anti-rolling tank-and-growler-clamping system 140, will reduce or eliminate pressure build-up in the carbonated beverage contained within the growler canisters. The prior art has no mechanism to accomplish this.

10) (FIGS. 18, 19, 27B, 27C, 14A, 14B, 15D, 27D, and 27C)

CO2-tank-locking recess 104 combined with growler-impact-and-vibration-absorbing circular springs 107, impact-and-vibration-absorbing wheel system 131, and anti-shaking anti-rolling tank-and-growler-clamping system 140 stabilize the movement as to provide a mechanism to minimize or eliminate the impact-and-vibration-absorbing self-cooling portable caddy system from tipping while transporting. The prior art is unstable, and because of the shifting of the heavy tanks filled with CO2 and liquid beverages, will become unbalanced, top-heavy and will tip over when encountering sudden rocks, holes, jagged cement, or uneven side-by-side sidewalk slabs.

11) (FIGS. 4, 5, 6B and 6C)

Multi-flavor ice-cream compartments 124 are uniquely designed to help the cold air circulate around multi-flavor ice-cream compartments 124 and expose the ice cream environment to this cold air, which is produced by the ice, or re-freezable cooling gel-packs 108. This cold environment will keep the ice cream cold for extended periods of time.

12) (FIGS. 40A, 40B, 40C, and 40D,)

Spring-assisted retractable-beverage-hose reels 201 are spring-loaded and able to automatically rotate, so that when finished using multi-position multi-height spigots 166 and serving root beer floats, beverage-dispensing hoses 164 and multi-position multi-height spigots 166 can be instantly and effortlessly retracted back into the impact-and-vibration-absorbing self-cooling portable caddy system, ready for transport or storage.

13) (FIGS. 25F, 25G, 25H, and 25I)

Spigot-locking receptacles 115 are designed as to utilize the least amount of materials during manufacturing. Spigot-locking receptacles 115 are recessed inside retractable height-adjustable spigot-locking handle 114, utilizing empty space for their function. This reduces cost of manufacturing.

14) (FIGS. 25F, 25G, 25H, and 25I)

Spigot-locking receptacles 115, according to their minimalistic design, do not extend outside of the physical dimension of the handles, as to not snag on any clothing, jewelry, or other miscellaneous objects in the path while deploying or while transporting.

Figure 4:
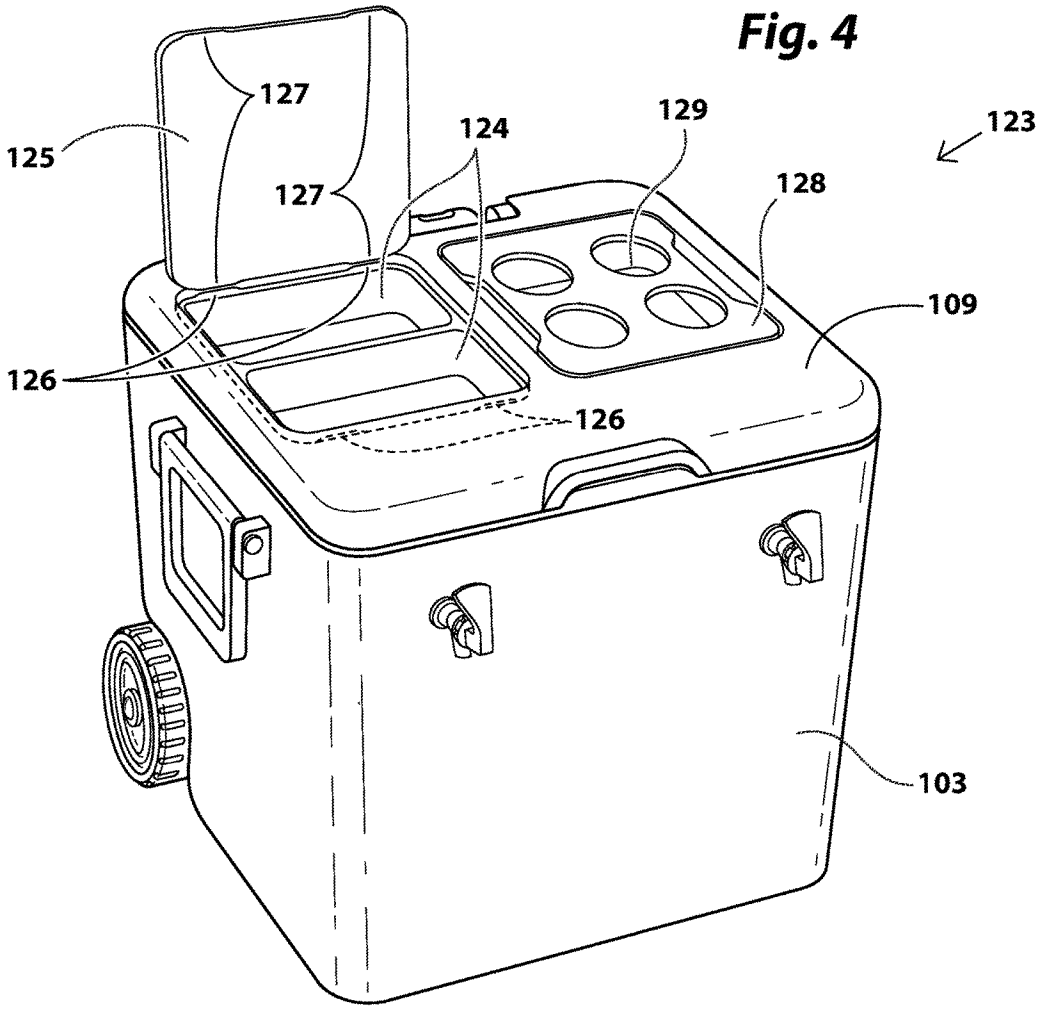
Figure 5:
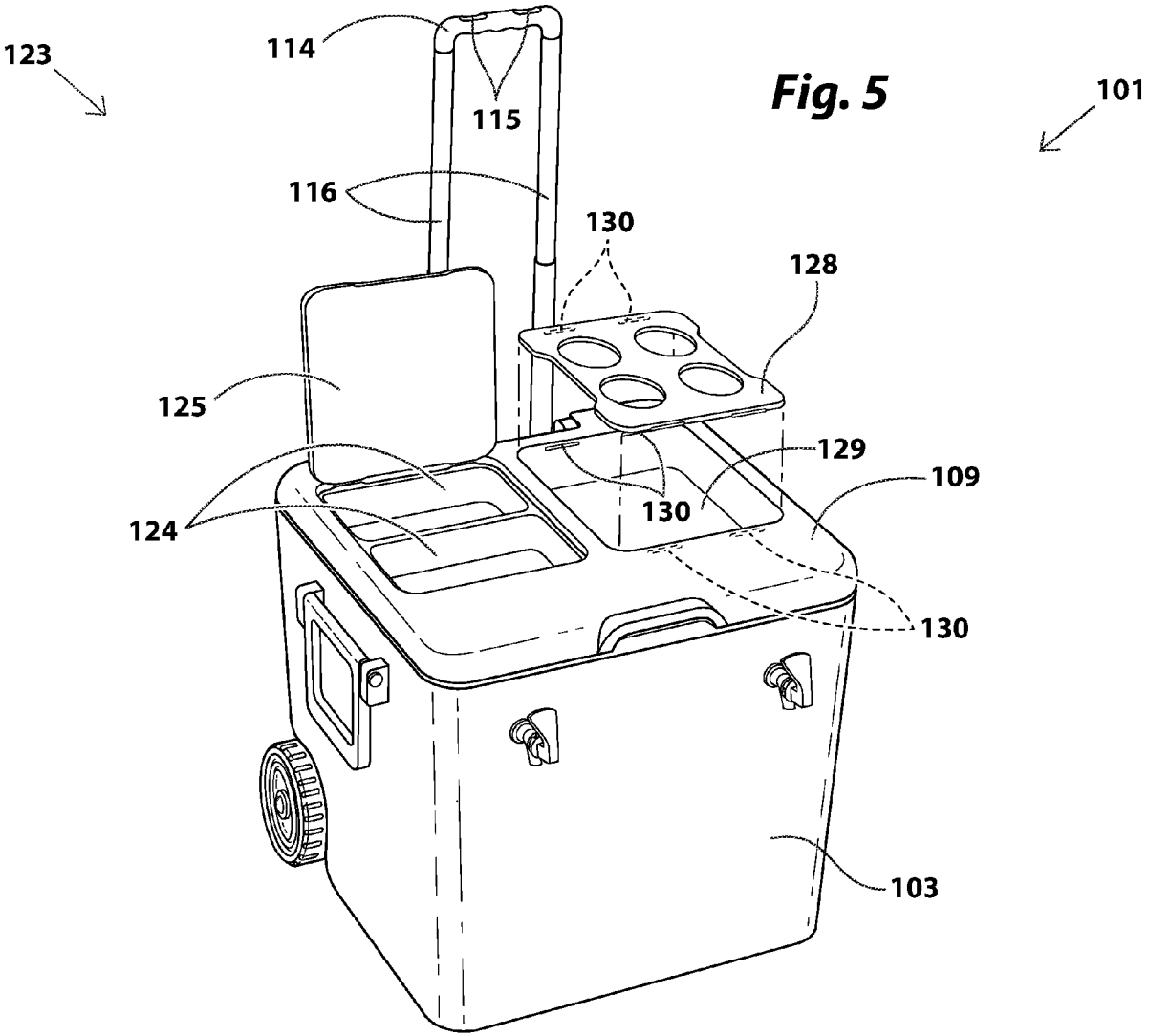
Figure 6B:
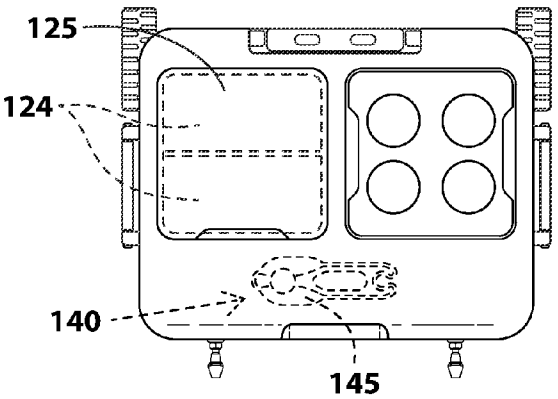
FIGS. 6A, 6B, 6C and 6D illustrate top and side views of the impact-and-vibration-absorbing self-cooling portable caddy system, the root-beer-float system, the impact-and-vibration-absorbing wheel system, and the multi-position multi-height beverage-dispensing spigot system.
Figure 6D:
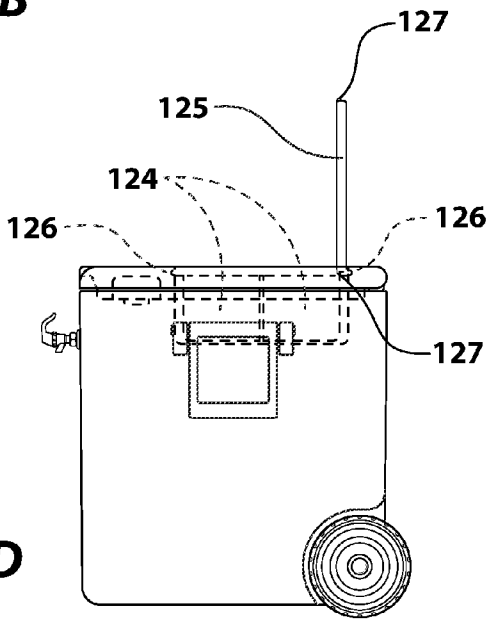
Figure 6A:
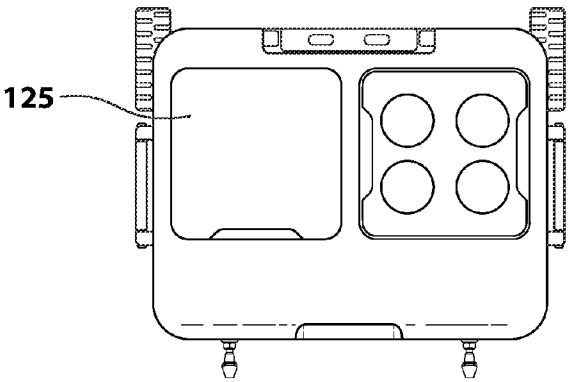
Figure 6C:
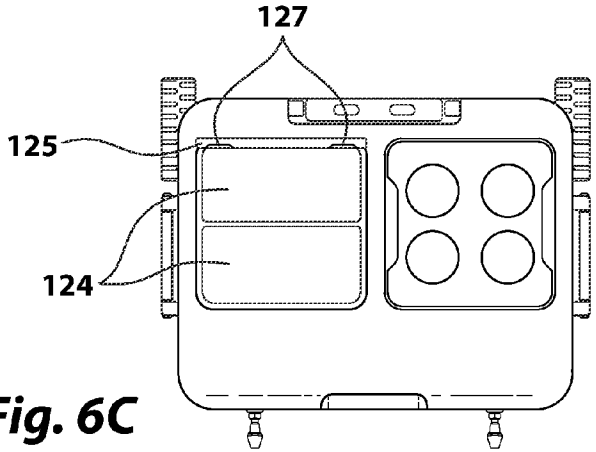

15) (FIGS. 4, and 5)

Built-in root-beer-float system 123 are portable and conveniently at hand to create and serve root beer floats. To have multiple flavors of ice-cream, to keep the ice-cream cold due to the self-cooling compartment.

16) (FIG. 30)

Part of built-in root-beer-float system 123 is snap-on removable cup-holder tray 128, which provides a way to securely hold multiple cups while preparing the root beer floats and snap-on removable cup-holder tray 128 then snaps out to serve the root beer floats to thirsty recipients.

17) (FIGS. 20B, 43A, 43B, 43C, and 43D)

Re-freezable cooling gel-packs 108 are a user option to conveniently provide ice packs, which fit perfectly in the impact-and-vibration-absorbing self-cooling portable caddy system, snugly surrounding the growler kegs, to keep the beverage cold for extended amounts of time. These can be re-frozen by simply placing them in a freezer. The other user option is to provide cooling by pouring in ice cubes into the empty space surrounding the growler kegs.

Figure 15A:
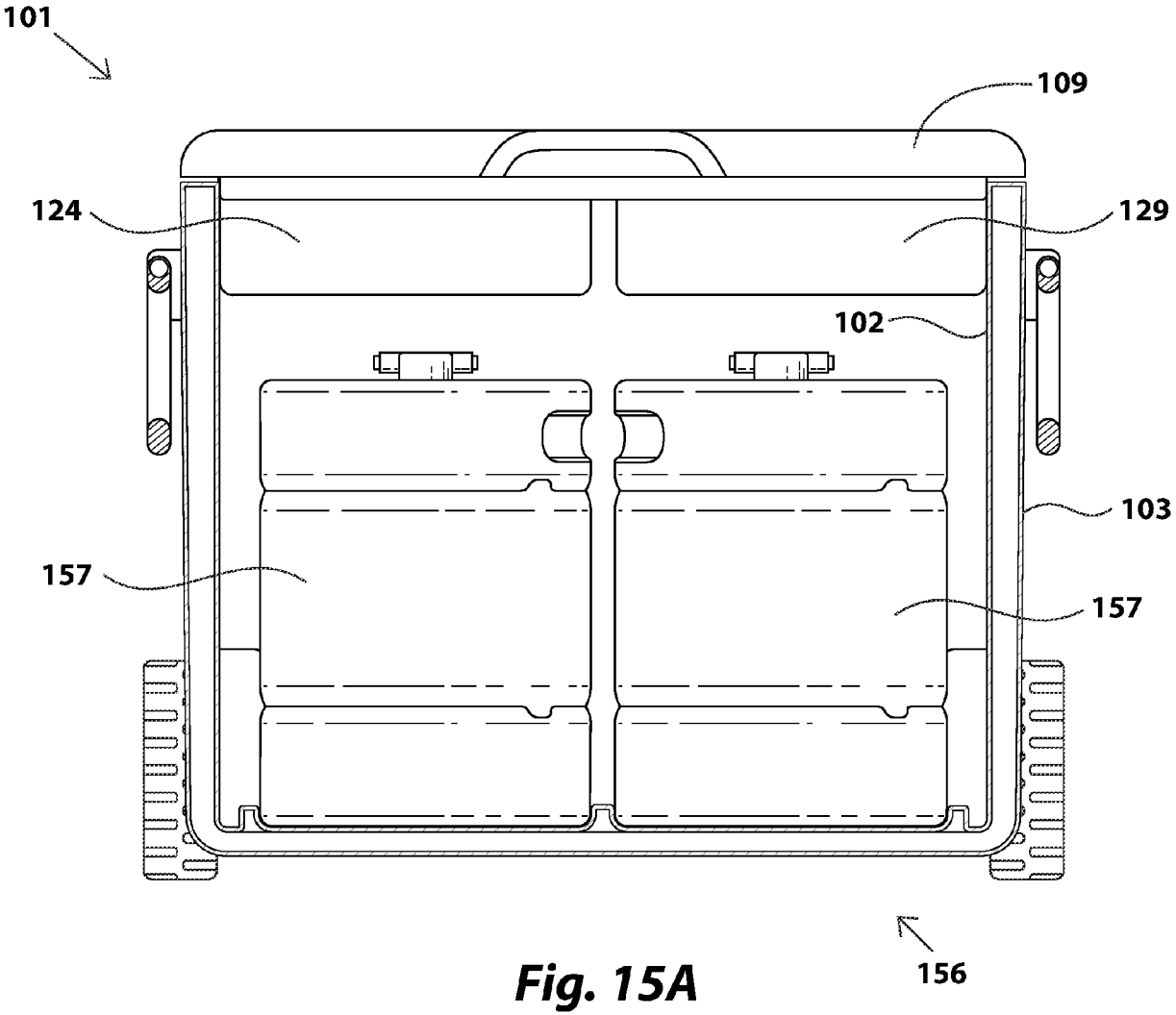
FIGS. 15A, 15B, 15C, 15D, and 15E illustrate cross-sectional, side, top, and interior views of the impact-and-vibration-absorbing self-cooling portable caddy system (with the beverage growler system positioned in growler-locking recesses and the CO2 tank system positioned in CO2-tank-locking recess).
Figure 15B:
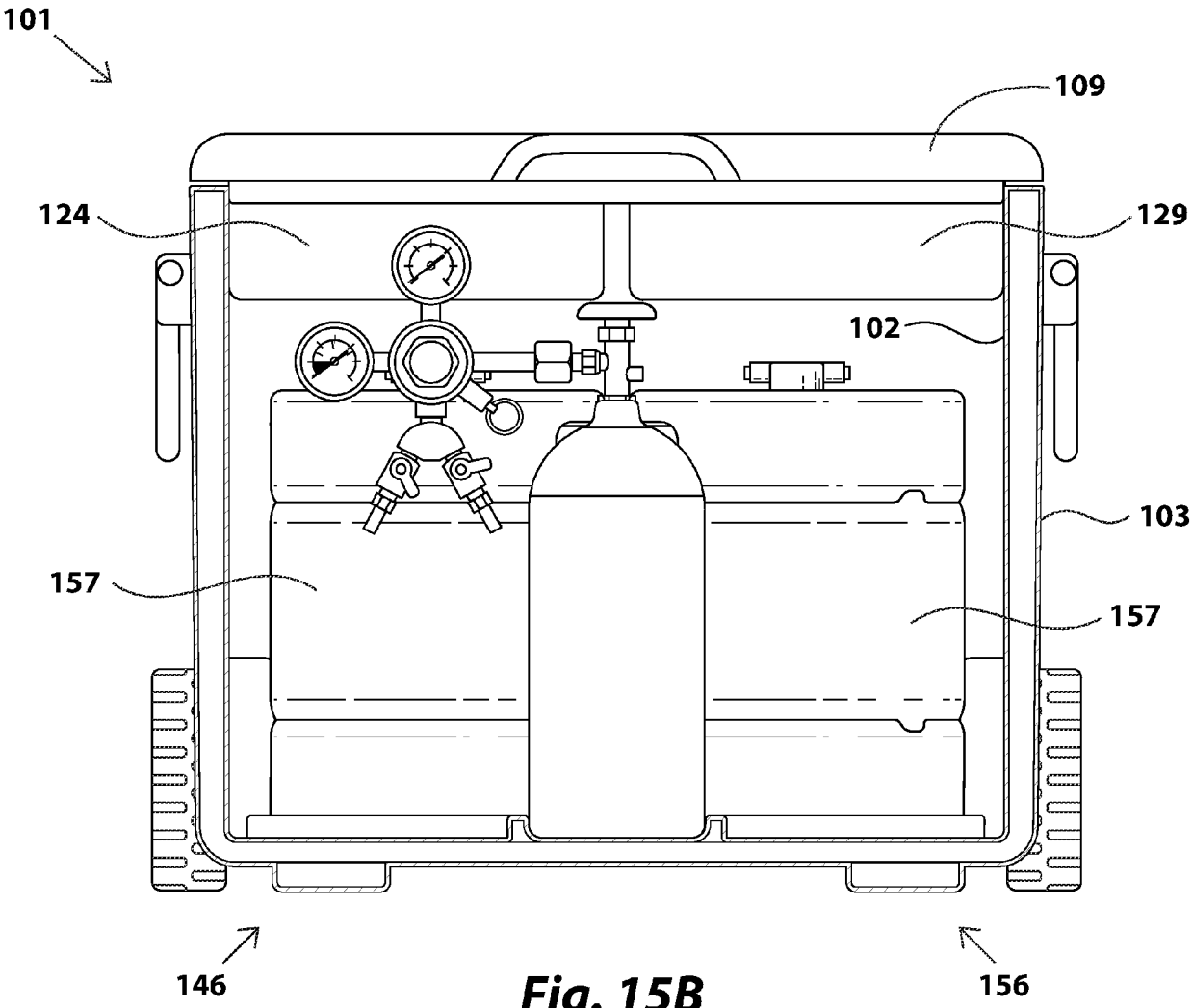
Figure 15C:
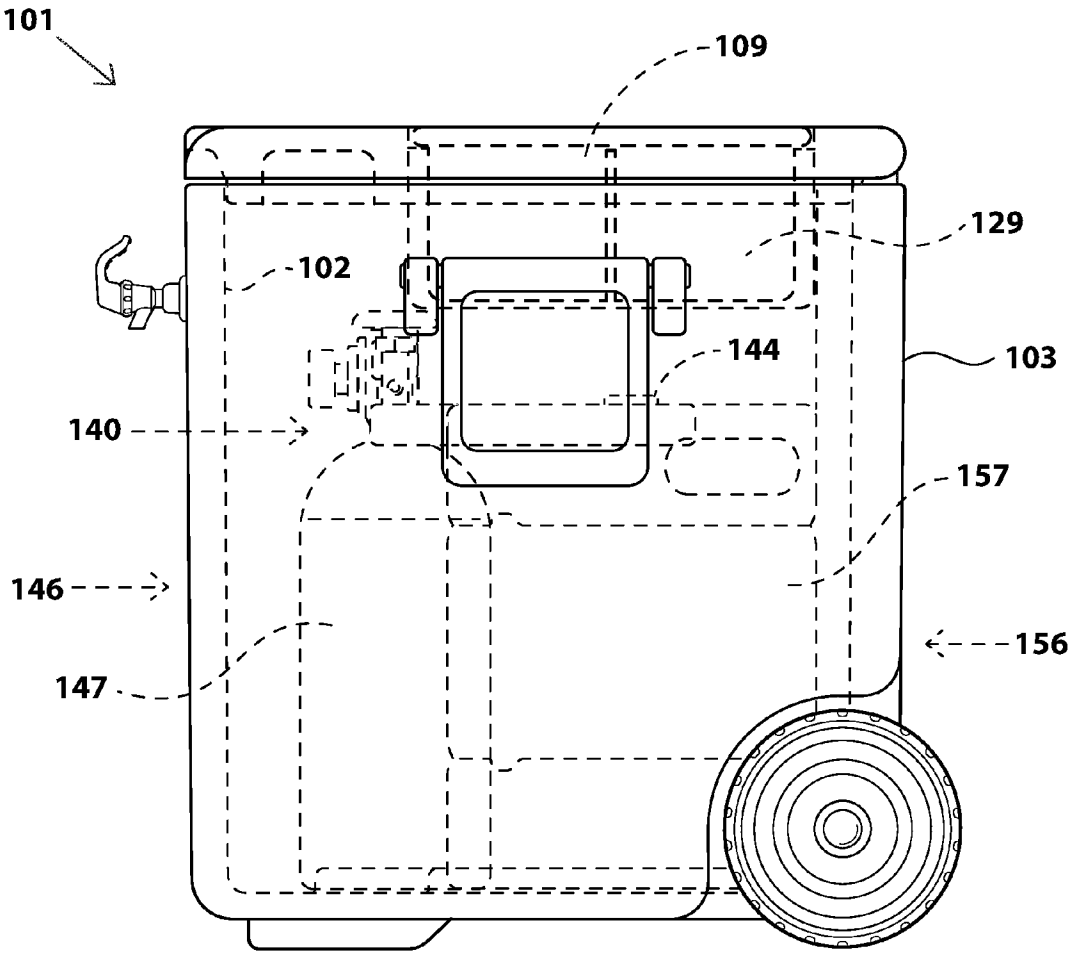
Figure 15D:
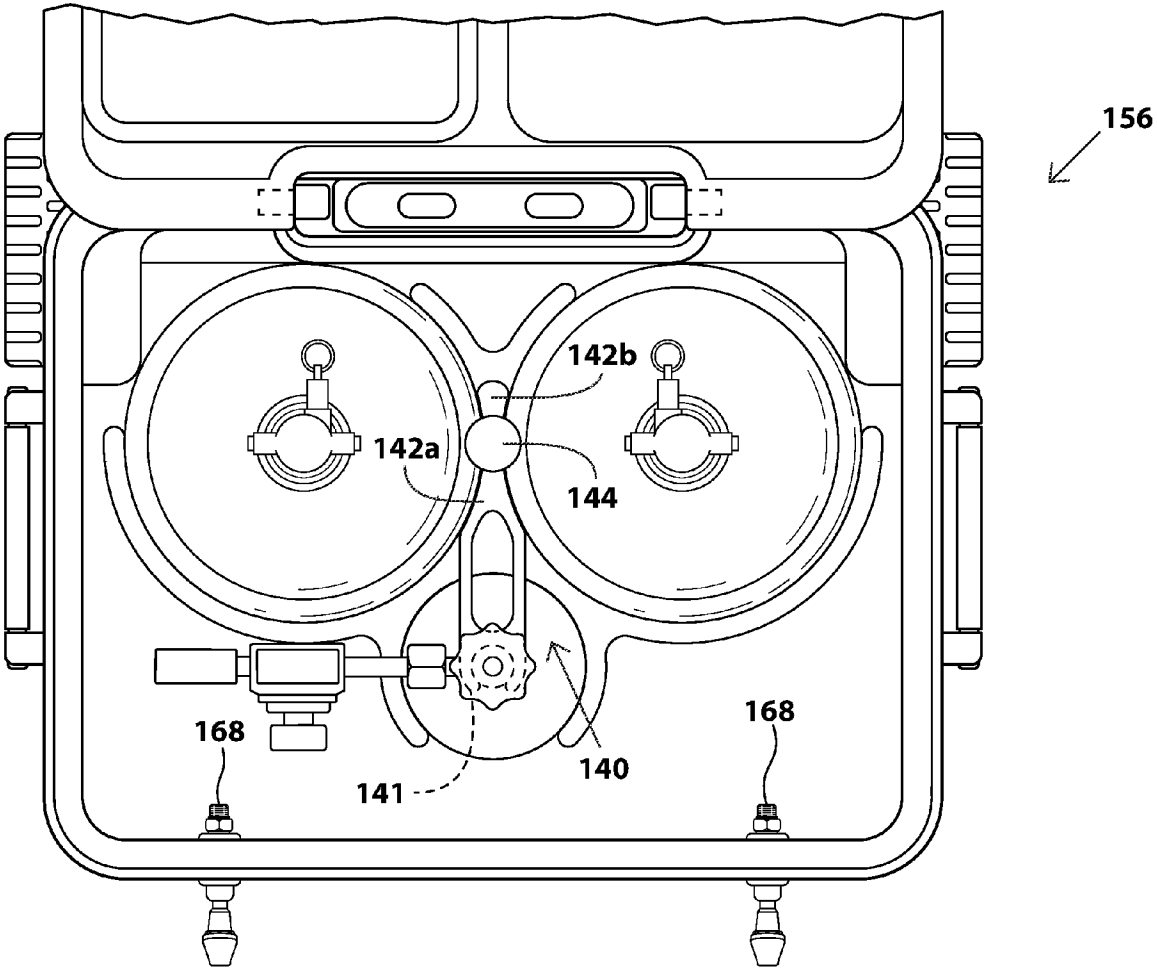
Figure 15E:
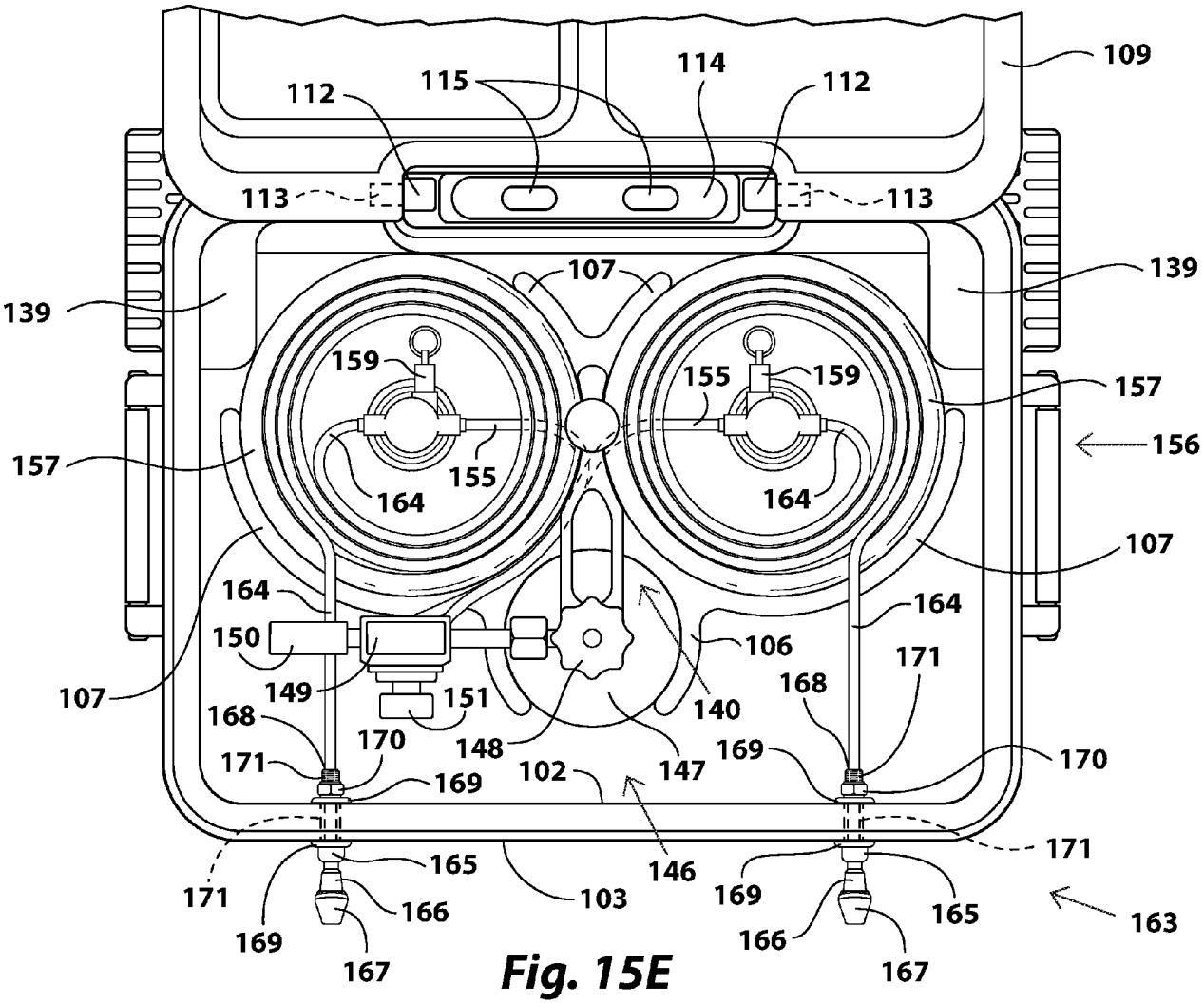
Figure 16B:
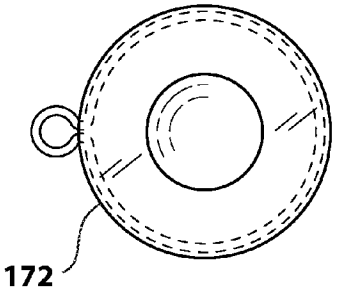
FIGS. 16A, 16B, 16C, 16D, and 16E illustrate side and top views of a spear-top cap and how it is screwed on a growler.
Figure 16A:
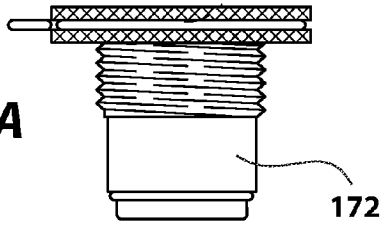
Figure 16C:
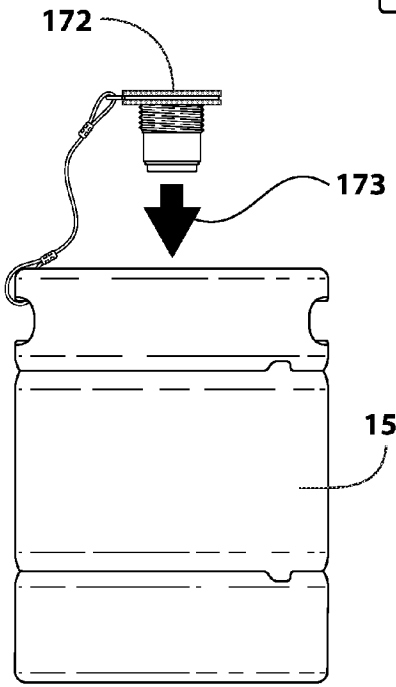
Figure 16D:
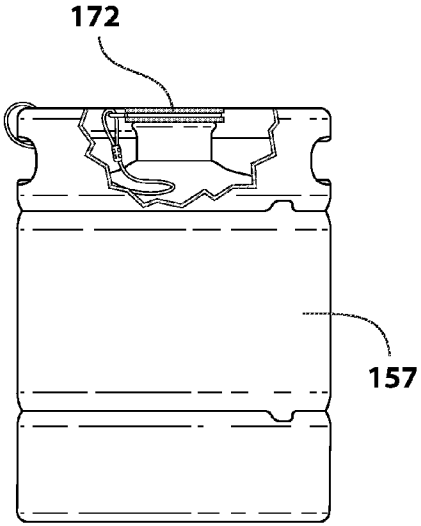
Figure 16E:
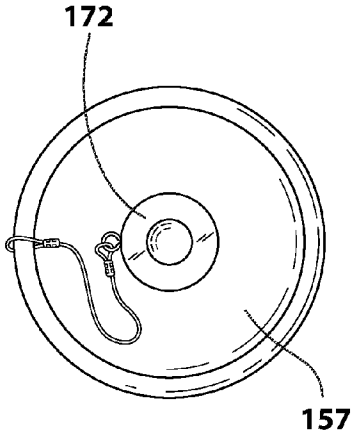
Figure 17:
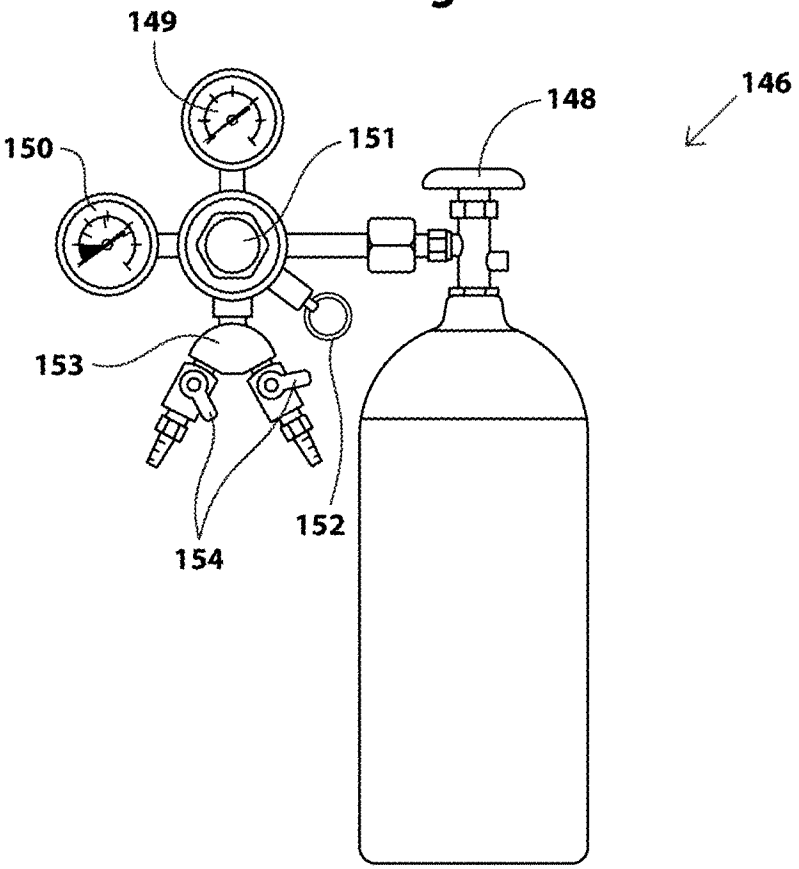
FIG. 17 illustrates a front view of the CO2 tank system.
Figure 18:
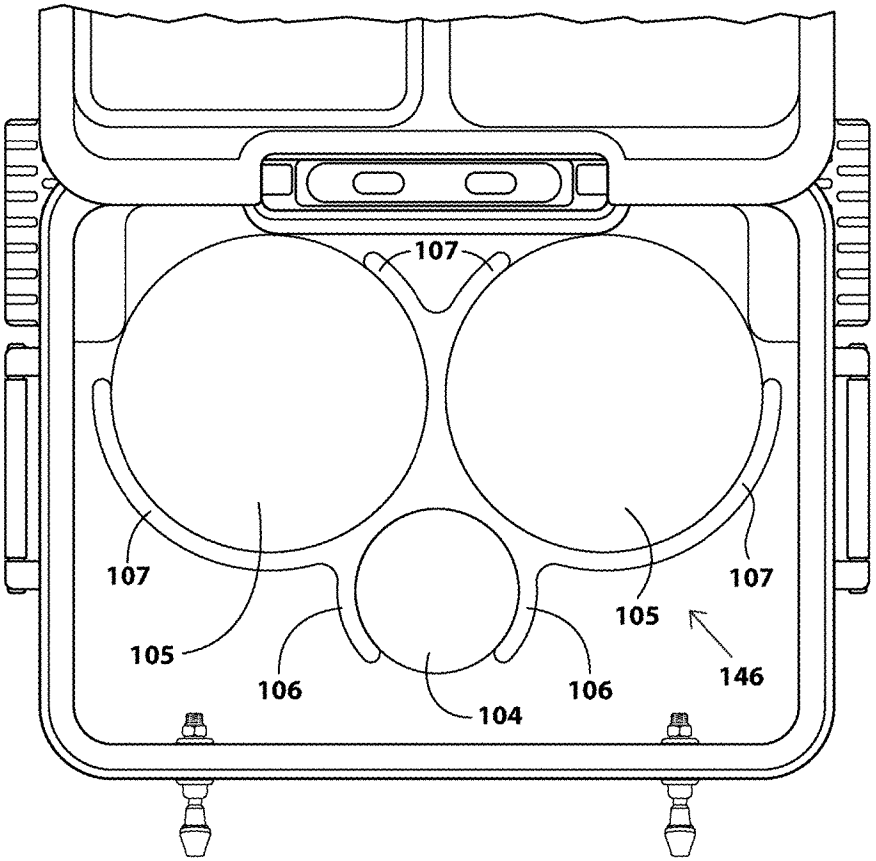
FIG. 18 illustrates a top interior view of the impact-and-vibration-absorbing self-cooling portable caddy system (with tank-impact-and-vibration-absorbing circular springs, growler-impact-and-vibration-absorbing circular springs, CO2-tank-locking recess, and growler-locking recesses).
Figure 19:
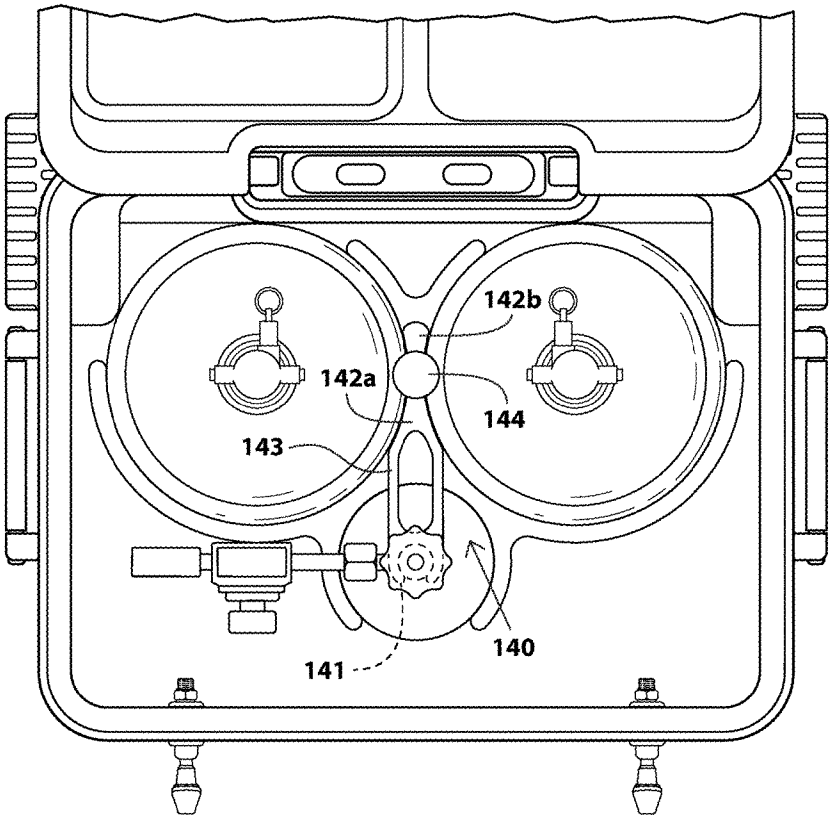
FIG. 19 illustrates a top interior view of the impact-and-vibration-absorbing self-cooling portable caddy system, the CO2 tank system (in CO2-tank-locking recess), the beverage growler system (in growler-locking recesses), the anti-shaking anti-rolling tank-and-growler-clamping system, and the multi-position multi-height beverage-dispensing spigot system.
Figure 20A:
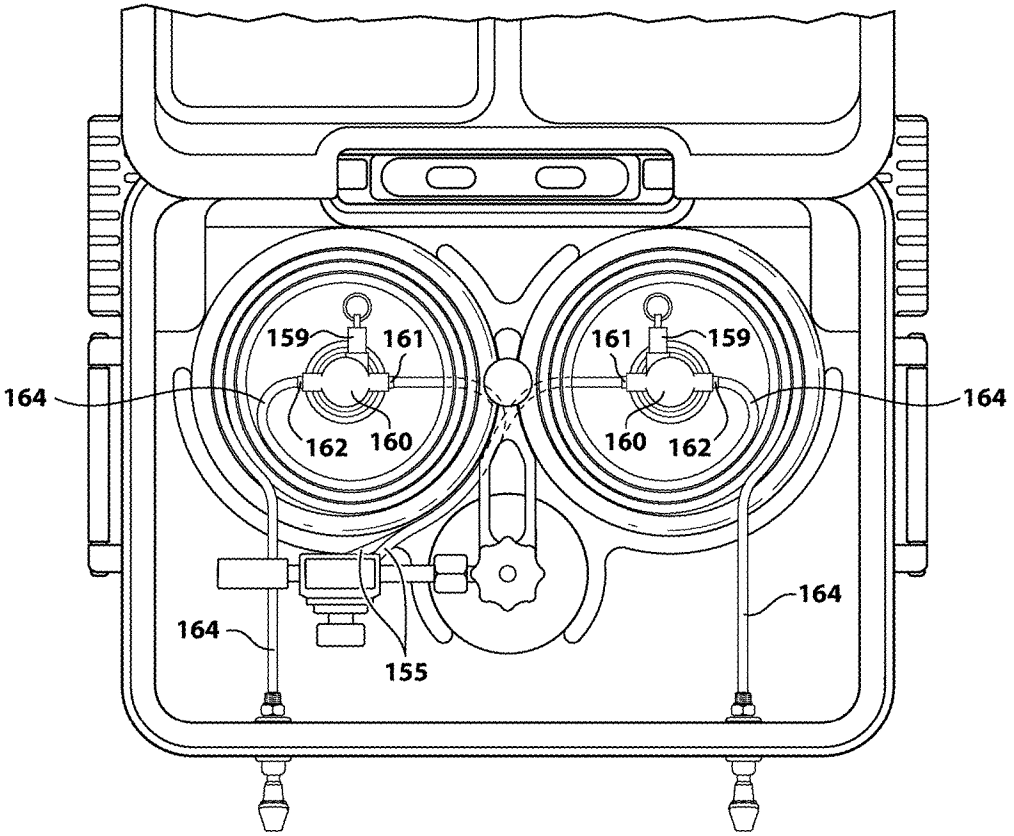
FIGS. 20A and 20B illustrate top interior views of the impact-and-vibration-absorbing self-cooling portable caddy system, the beverage growler system, the CO2 tank system, the anti-shaking anti-rolling tank-and-growler-clamping system, the multi-position multi-height beverage-dispensing spigot system, and re-freezable cooling gel-packs.
Figure 20B:
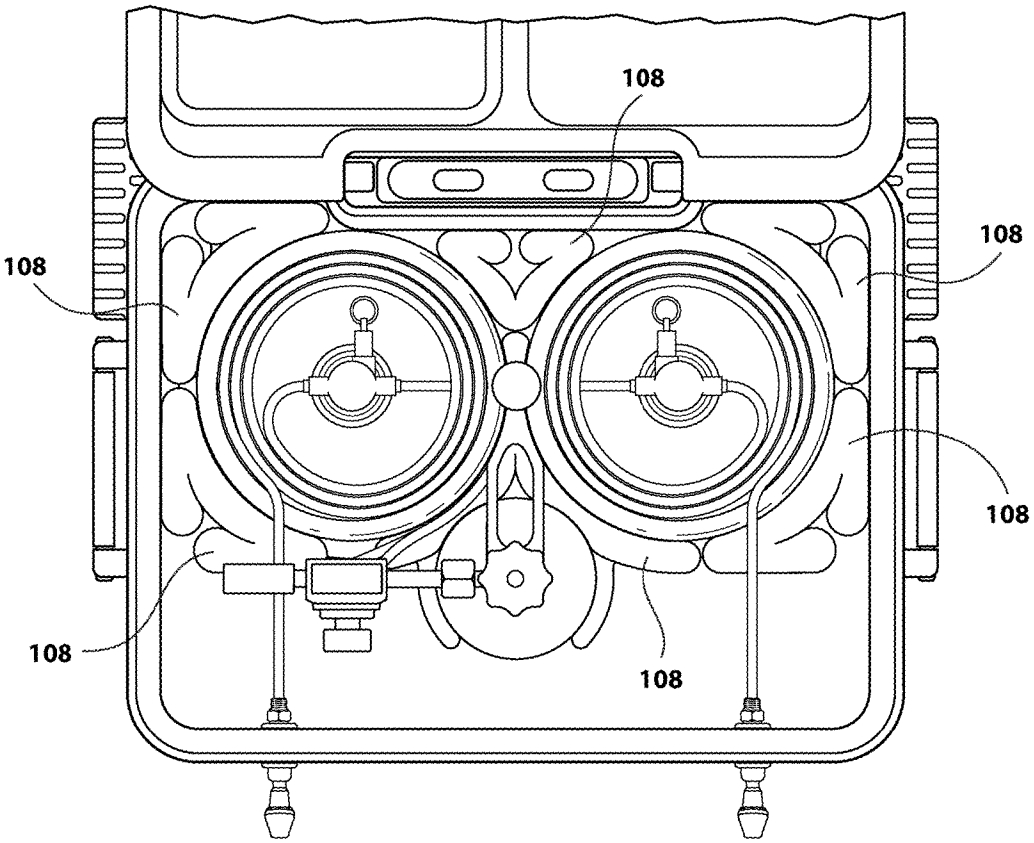
Figure 21:
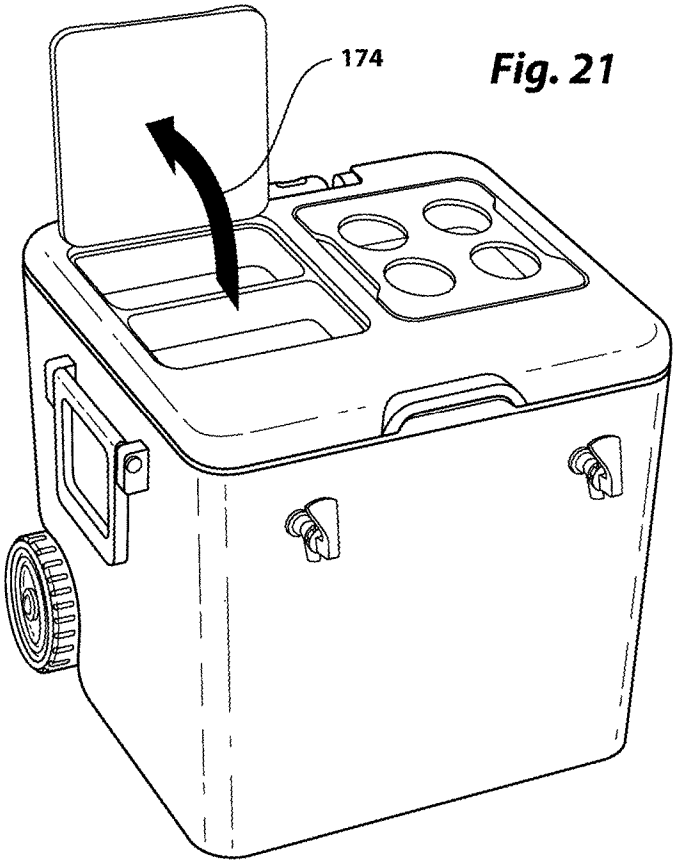
FIGS. 21 and 22 illustrate perspective views of the impact-and-vibration-absorbing self-cooling portable caddy system and the root-beer-float system (with a snap-on ice-cream lid in an open position and a closed position, respectively).
Figure 22:
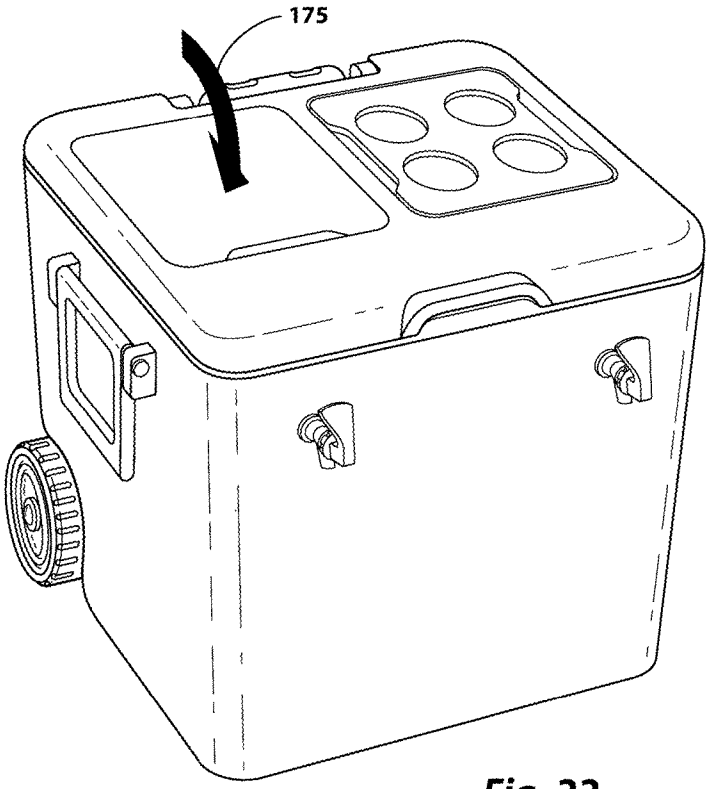

18) (FIGS. 4, 5, and 15A)

These nine above-mentioned systems are all contained in a protective vibration-absorbing portable shell 103, which is portable. The prior art has no mechanism to accomplish this. Previous portable systems contain either a system to cool the keg or to pressurize the keg, but not all nine above-mentioned systems.

19) (FIG. 8A)

Clamp-system-storing recess 145 makes it quick and easy to retrieve and deploy anti-shaking anti-rolling tank-and-growler-clamping system 140 from its secure, compact, integrated storage compartment in the lid of the impact-and-vibration-absorbing self-cooling portable caddy system.

Figure 25B:
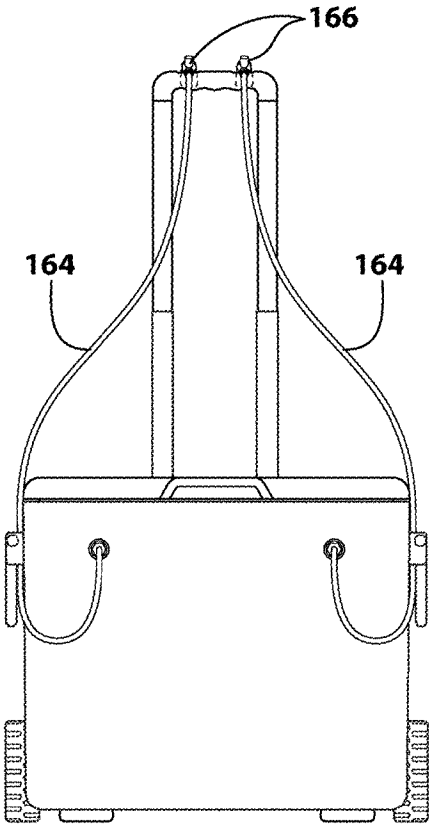
FIGS. 25A, 25B, 25C, 25D, 25E, 25F, 25G, 25H, and 25I illustrate front and side views of how multi-position multi-height spigots of the multi-position multi-height beverage-dispensing spigot system are locked in the spigot-locking receptacles of the retractable height-adjustable spigot-locking handle.
Figure 25A:
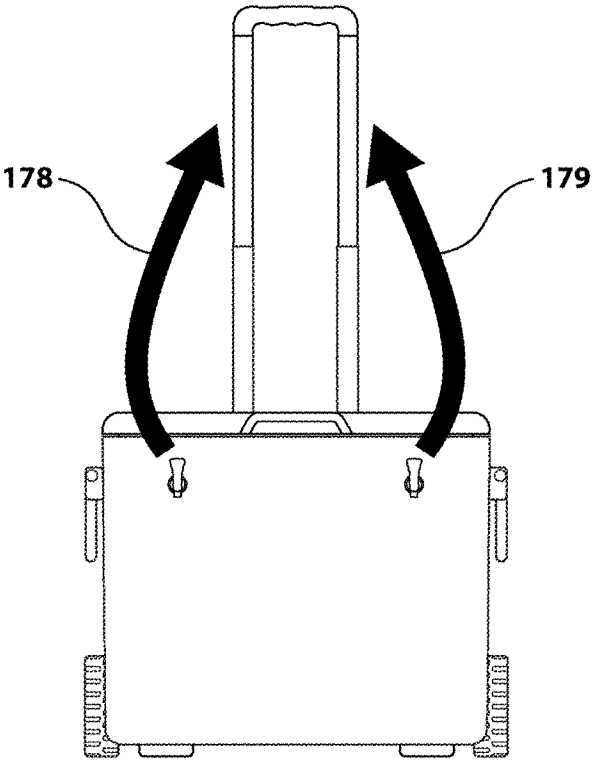
Figures 25C, 25D, 25E:
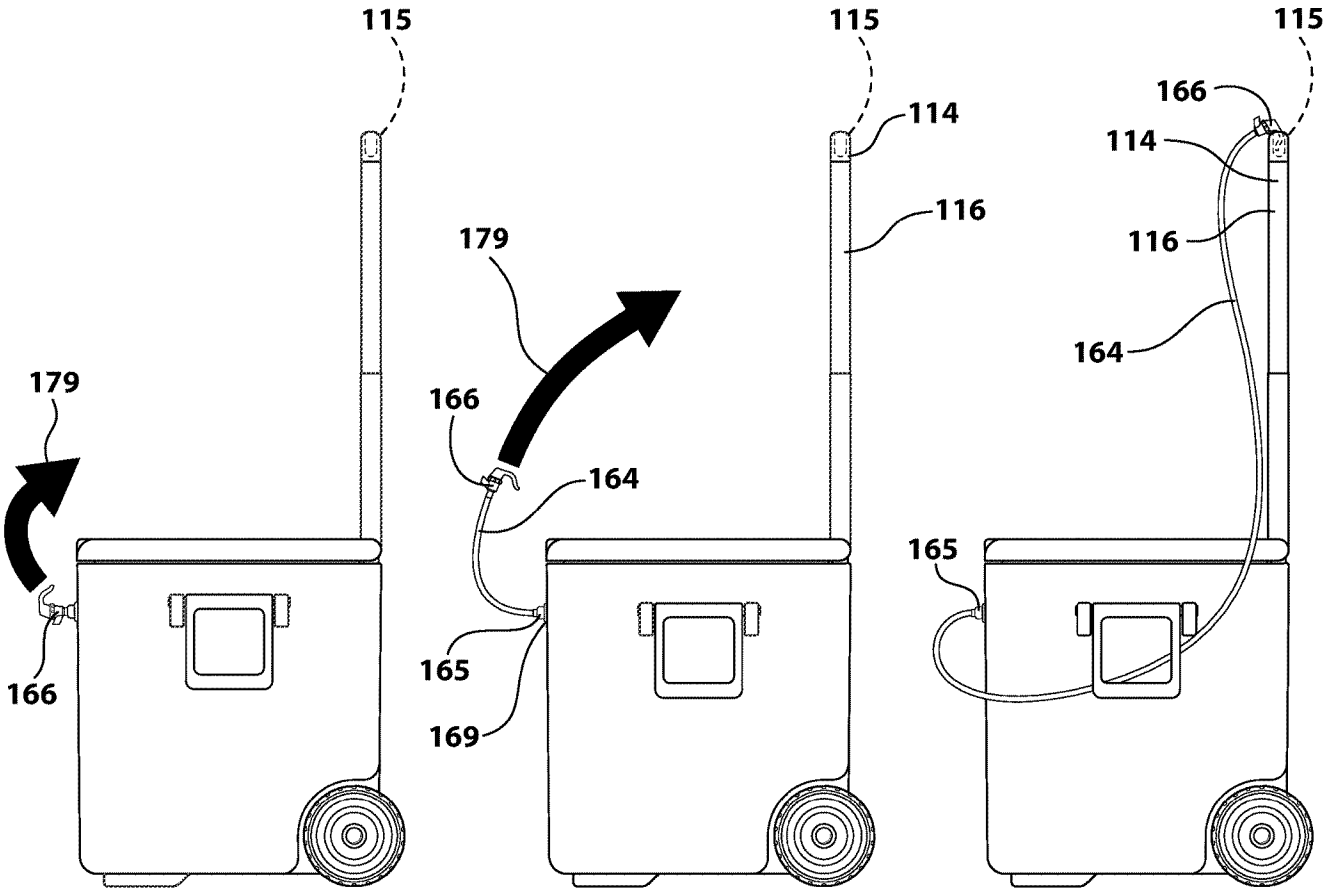
Figure 25G:
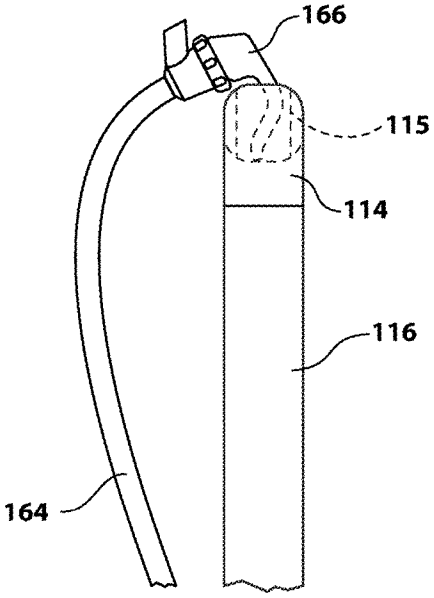
Figure 25F:
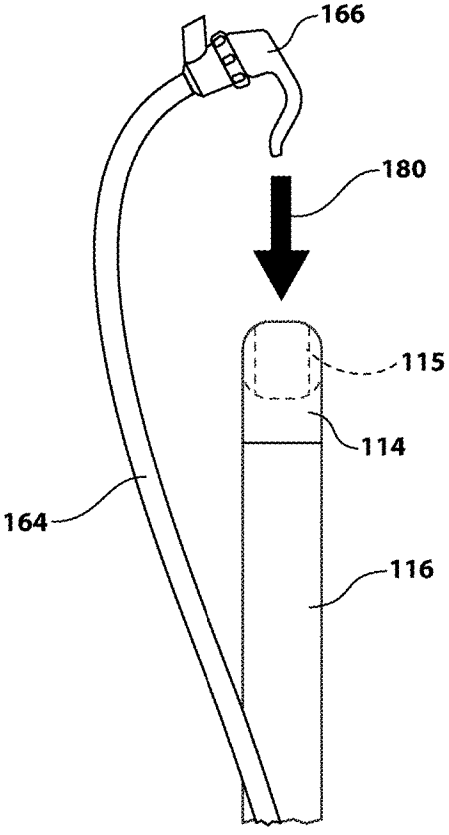
Figure 25I:
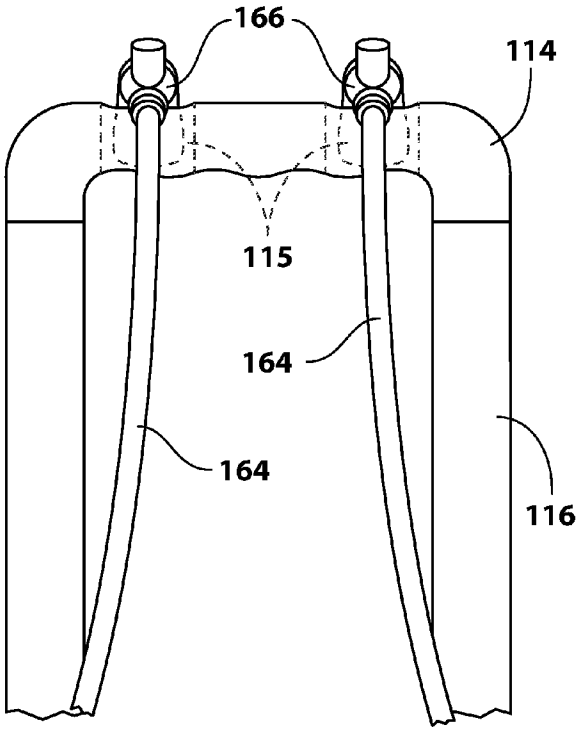
Figure 25H:
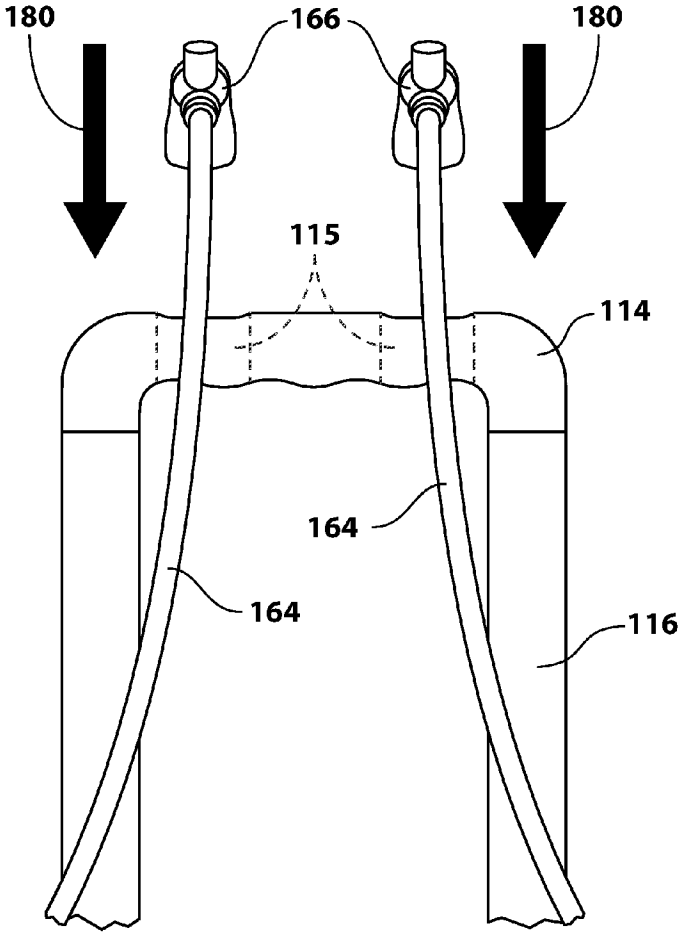
Figure 26:
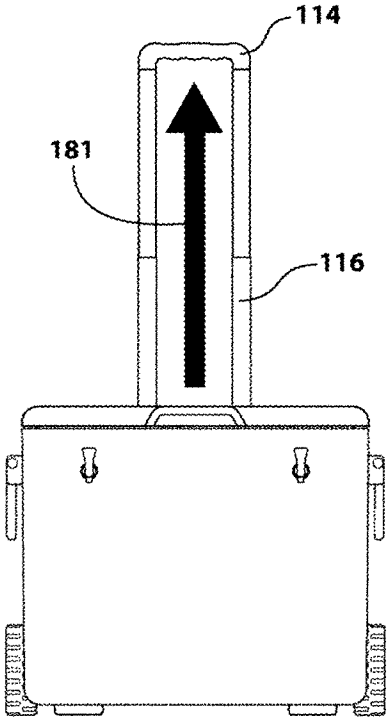
FIG. 26 illustrates an elevational front view of the impact-and-vibration-absorbing self-cooling portable caddy system and the multi-position multi-height beverage-dispensing spigot system (with retractable height-adjustable spigot-locking handle in an extended position of another different height).
Figure 27A:
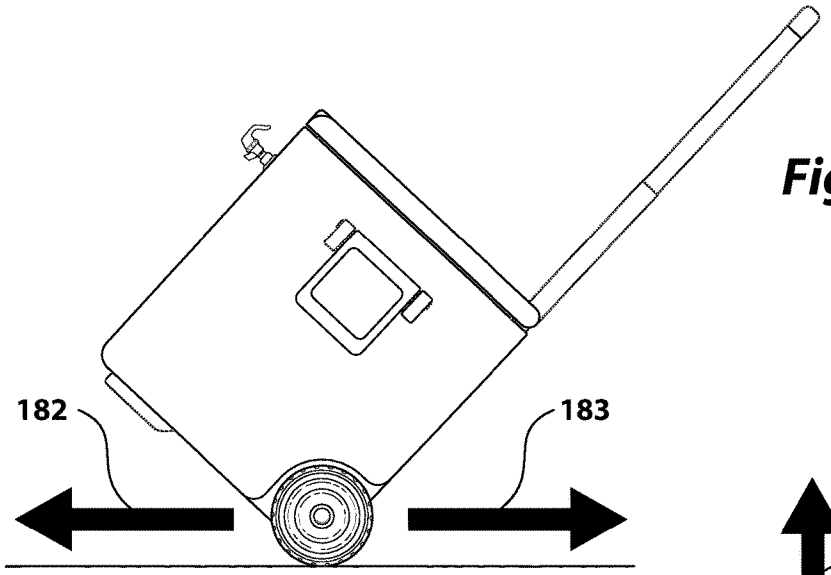
FIGS. 27A, 27B, 27C, 27D, and 27E illustrate side and front views of how the wheel-impact-and-vibration-absorbing circular convex springs, the spoke-impact-and-vibration-absorbing circular concave springs, the tank-impact-and-vibration-absorbing circular springs, and the growler-impact-and-vibration-absorbing circular springs absorb the ground impact and vibration during transport.
Figure 27B:
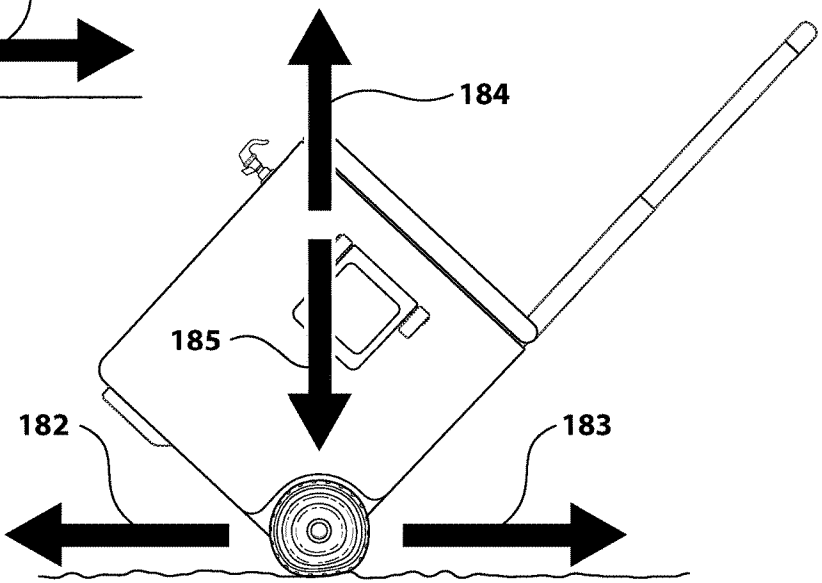
Figure 27C:
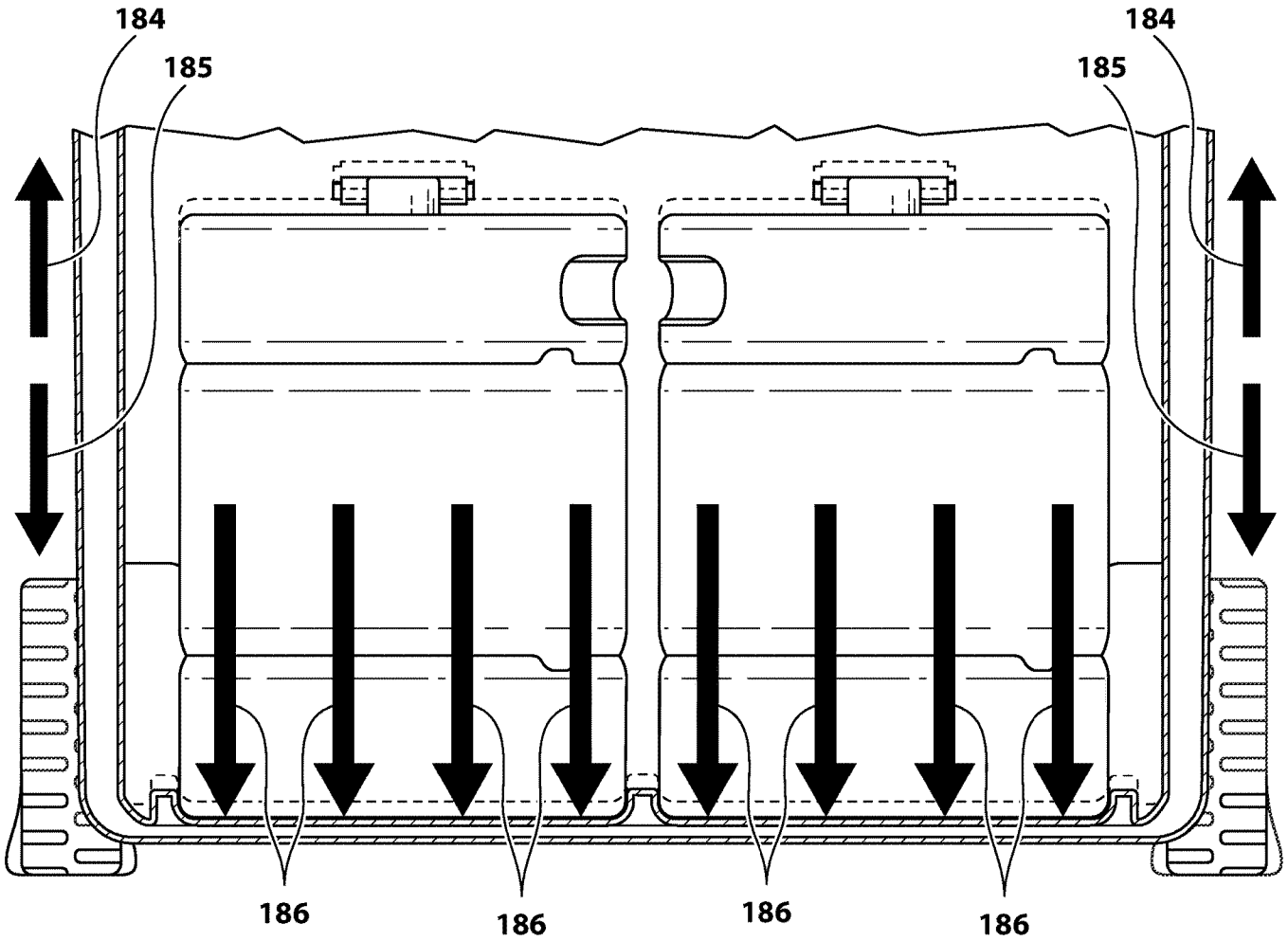
Figure 27D:
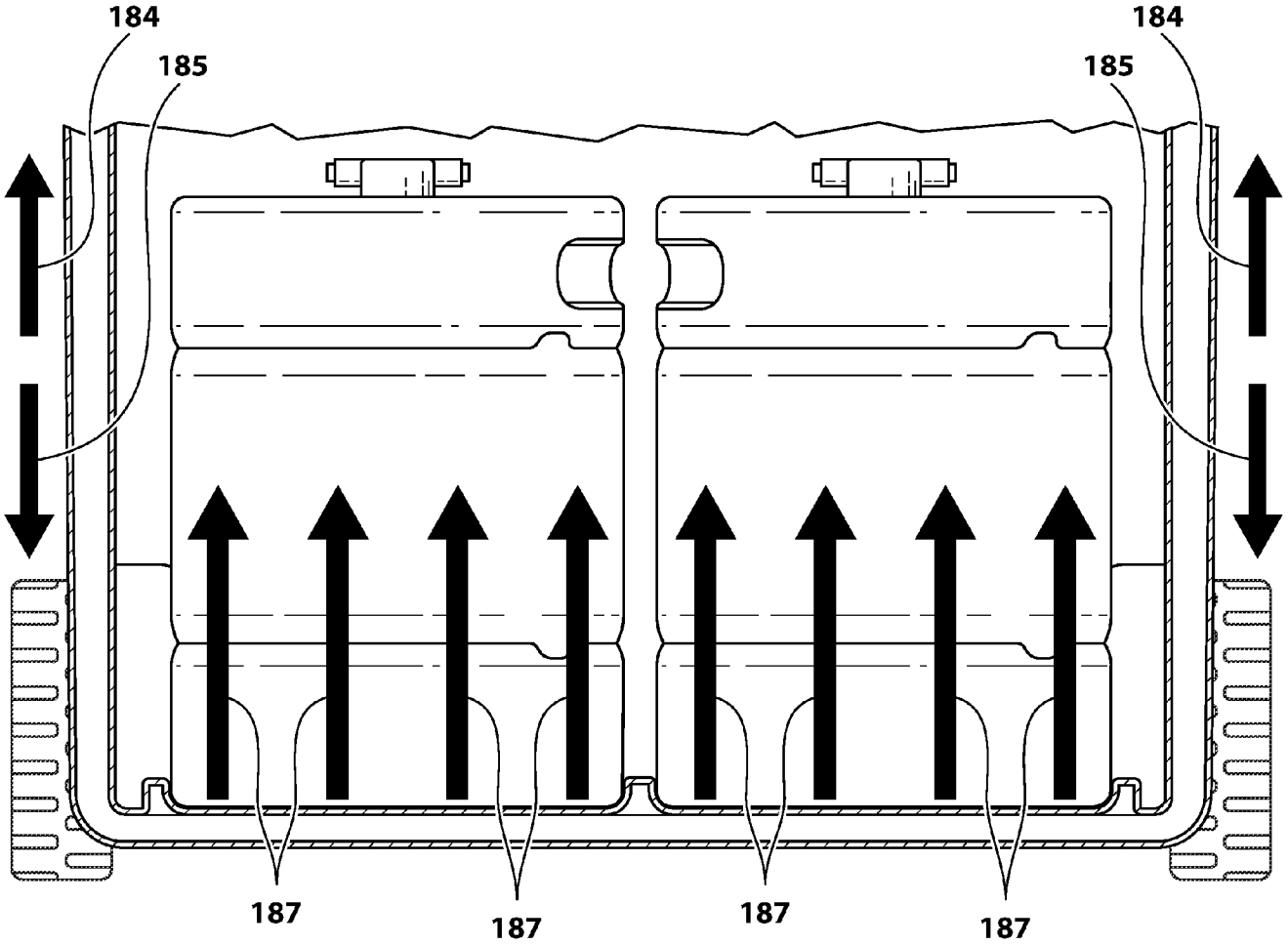
Figure 27E:
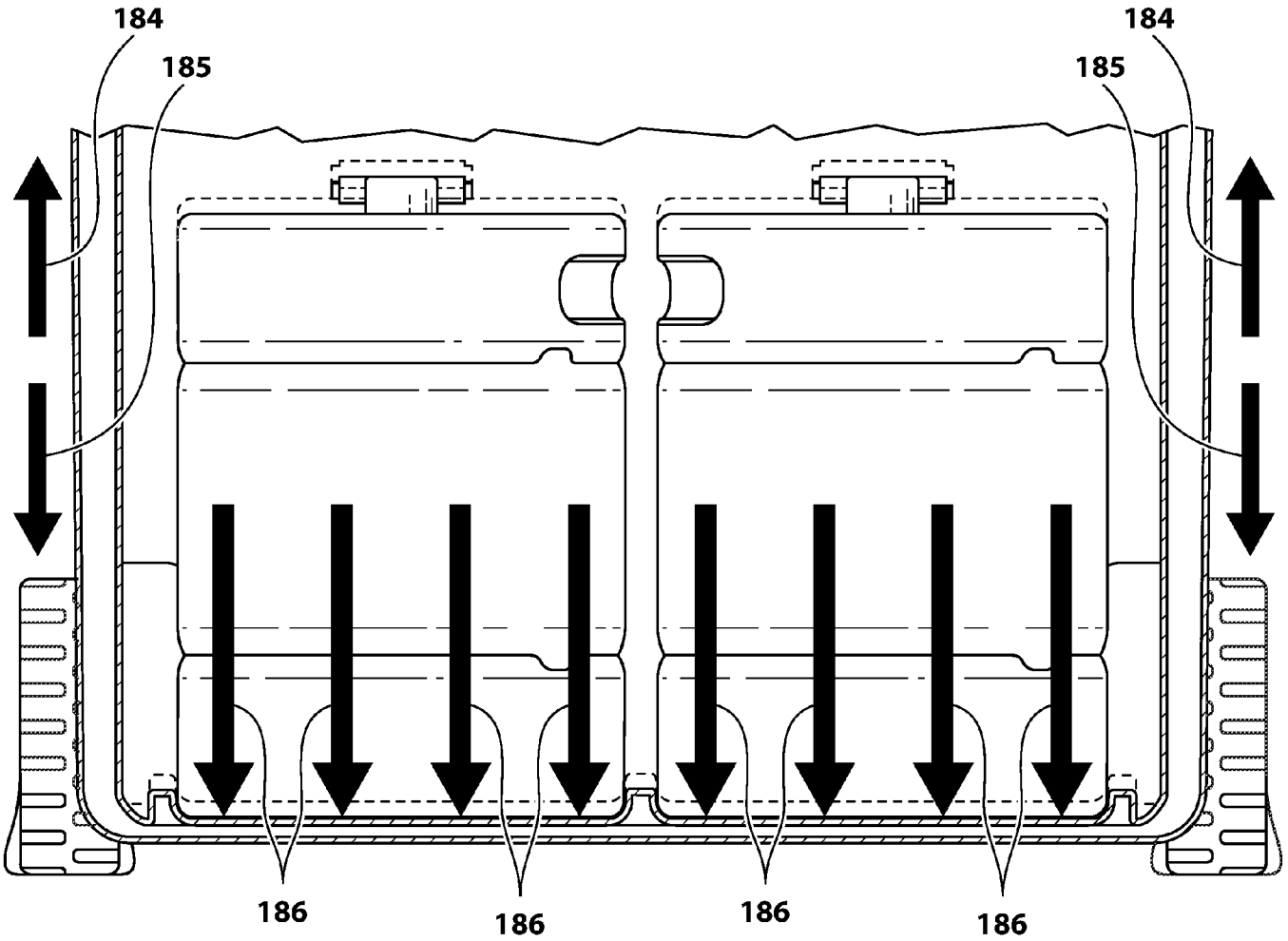

20) (FIGS. 25B, and 25E)

When beverage-dispensing hoses 164 are deployed out from their retracted position, they are then able to be routed through the empty space between the side handles and right and left sides of vibration-absorbing portable shell 103. This safely holds beverage-dispensing hoses 164 out of the way while the operating server is serving. This will prevent beverage-dispensing hoses 164 from causing distraction and/or catching on a serving spoon, or cause a cup to be overturned and spilled.

What is claimed is:

1. A portable beverage-pressurizing-and-dispensing cooler for pressurizing and dispensing beverage, comprising:

a vibration-absorbing portable shell having four sides;

a vibration-absorbing portable vault inserted into said vibration-absorbing portable shell;

a removable tray, said removable tray having a plurality of cup openings molded thereon for holding beverage cups;

a root-beer-float-and-serving-tray lid pivotably attached to said vibration-absorbing portable shell, said root-beer-float-and-serving-tray lid having a plurality of ice-cream compartments molded thereon for storing ice-cream and a tray cavity molded thereon for storing said removable tray;

a tank-vibration-absorbing circular spring, said vibration-absorbing portable vault having a vault bottom, said tank-vibration-absorbing circular spring molded on said vault bottom for stabilizing pressurized CO2 tank and for absorbing transportation vibration;

two growler-vibration-absorbing circular springs, said two growler-impact-and-vibration-absorbing circular springs molded on said vault bottom for stabilizing beverage growlers and for absorbing transportation vibration;

an axle rotatably attached to said vibration-absorbing portable shell;

two wheels rotatably attached to said axle;

a plurality of wheel-vibration-absorbing circular springs molded on said two wheels to absorb transportation vibration respectively;

a CO2 tank, said CO2 tank disposed within said tank-vibration-absorbing circular spring;

two CO2 hoses, said two CO2 hoses connected to said CO2 tank;

two beverage growlers, said two beverage growlers connected to said two CO2 hoses;

two beverage-dispensing hoses, said two beverage-dispensing hoses connected to said two beverage growlers;

two multi-height spigots, said two multi-height spigots connected to said two beverage-dispensing hoses;

a tank-and-growler clamp for clamping on and stabilizing said CO2 tank and said two beverage growlers;

two height-adjustable telescopic posts attached to one of said four sides, each of said two height-adjustable telescopic posts each having a post end;

a retractable spigot-locking handle, said retractable spigot-locking handle attached to said post ends and having two spigot-locking receptacles molded thereon such that said two spigot-locking receptacles are for locking said two multi-height spigots thereto and for locking said two multi-height spigots at a plurality of different heights; and two spring-assisted reels attached to said vibration-absorbing portable vault for said two beverage-dispensing hoses to be wound thereon, wherein one of said vibration-absorbing portable shell four sides is a front side, wherein said two multi-height spigots initially rest on said front side, wherein said two beverage-dispensing hoses are capable of quickly extending out of said front side for said two multi-height spigots to be raised and locked to said two spigot-locking receptacles of said retractable spigot-locking handle.

2. The cooler of claim 1, further comprising two foldable handles foldably attached to two of said four sides for transporting the cooler.

3. The cooler of claim 1, wherein said two multi-height spigots each have a lever pivotably attached thereto, said levers are for hooking in said two spigot-locking receptacles of said retractable spigot-locking handle.

4. The cooler of claim 1, wherein said cup openings comprise four cup openings.

5. The cooler of claim 1, wherein said ice-cream compartments comprise two ice-cream compartments for storing two ice-cream containers.

6. The cooler of claim 1, wherein said tank-and-growler-clamp has a first end and a second end, said first end has a U shape and said second end has a V shape.

7. The cooler of claim 1, wherein said tank-vibration-absorbing circular spring and said two growler-vibration-absorbing circular springs are molded to one another.

8. A portable beverage-dispensing cooler for pressurizing and dispensing beverage, comprising:

a vibration-absorbing portable shell having four sides;

a vibration-absorbing portable vault inserted into said vibration-absorbing portable shell;

a removable tray, said removable tray having a plurality of cup openings molded thereon for holding beverage cups;

a root-beer-float-and-serving-tray lid pivotably attached to said vibration-absorbing portable shell, said root-beer-float-and-serving-tray lid having a plurality of ice-cream compartments molded thereon for storing ice-cream and a tray cavity molded thereon for storing said removable tray;

a tank-vibration-absorbing circular spring, said vibration-absorbing portable vault having a vault bottom, said tank-vibration-absorbing circular spring molded on said vault bottom for stabilizing pressurized CO2 tank and for absorbing transportation vibration;

two growler-vibration-absorbing circular springs, said two growler-impact-and-vibration-absorbing circular springs molded on said vault bottom for stabilizing beverage growlers and for absorbing transportation vibration;

an axle rotatably attached to said vibration-absorbing portable shell;

two wheels rotatably attached to said axle;

a plurality of wheel-vibration-absorbing circular springs molded on said two wheels to absorb transportation vibration respectively;

a CO2 tank, said CO2 tank disposed within said tank-vibration-absorbing circular spring;

two CO2 hoses, said two CO2 hoses connected to said CO2 tank;

two beverage growlers, said two beverage growlers connected to said two CO2 hoses;

two beverage-dispensing hoses, said two beverage-dispensing hoses connected to said two beverage growlers;

two multi-height spigots, said two multi-height spigots connected to said two beverage-dispensing hoses;

a tank-and-growler clamp for clamping on and stabilizing said CO2 tank and said two beverage growlers;

two height-adjustable telescopic posts attached to one of said four sides, each of said two height-adjustable telescopic posts each having a post end; and a retractable spigot-locking handle, said retractable spigot-locking handle attached to said post ends and having two spigot-locking receptacles molded thereon such that said two spigot-locking receptacles are for locking said two multi-height spigots thereto and for locking said two multi-height spigots at a plurality of different heights, wherein one of said vibration-absorbing portable shell four sides is a front side, wherein said two multi-height spigots initially rest on said front side, wherein said two beverage-dispensing hoses are capable of quickly extending out of said front side for said two multi-height spigots to be raised and locked to said two spigot-locking receptacles of said retractable spigot-locking handle.

9. The cooler of claim 8, further comprising two spring-assisted reels attached to said vibration-absorbing portable vault for said two beverage-dispensing hoses to be wound thereon.

10. The cooler of claim 8, further comprising two foldable handles foldably attached to said vibration-absorbing portable shell for carrying the cooler.

11. The cooler of claim 10, wherein said two multi-height spigots each have a lever pivotably attached thereto, said levers are for hooking in said two spigot-locking receptacles of said retractable spigot-locking handle.

12. The cooler of claim 8, wherein said cup openings comprise four cup openings.

13. The cooler of claim 8, wherein said ice-cream compartments comprise two ice-cream compartments for storing two ice-cream containers.

14. The cooler of claim 8, wherein said tank-and-growler-clamp has a first end and a second end, said first end has a U shape and said second end has a V shape.

15. A portable beverage-dispensing cooler for pressurizing and dispensing beverage, comprising:

a vibration-absorbing portable shell having four sides;

a vibration-absorbing portable vault inserted into said vibration-absorbing portable shell; a removable tray, said removable tray having a plurality of cup openings molded thereon for holding beverage cups;

a root-beer-float-and-serving-tray lid pivotably attached to said vibration-absorbing portable shell, said root-beer-float-and-serving-tray lid having a plurality of ice-cream compartments molded thereon for storing ice-cream and a tray cavity molded thereon for storing said removable tray;

a tank-vibration-absorbing circular spring, said vibration-absorbing portable vault having a vault bottom, said tank-vibration-absorbing circular spring molded on said vault bottom for stabilizing pressurized CO2 tank and for absorbing transportation vibration;

two growler-vibration-absorbing circular springs, said two growler-impact-and-vibration-absorbing circular springs molded on said vault bottom for stabilizing beverage growlers and for absorbing transportation vibration;

two height-adjustable telescopic posts attached to one of said four sides, each of said two height-adjustable telescopic posts each having a post end; and a retractable spigot-locking handle, said retractable spigot-locking handle attached to said post ends and having two spigot-locking receptacles molded thereon such that said two spigot-locking receptacles are for locking spigots therein and for locking spigots at a plurality of different heights, further said cooler comprising a CO2 tank, two CO2 hoses, two beverage growlers, two beverage dispensing hoses, and two multi-height spigots, wherein said two CO2 hoses connect said CO2 tank to said two beverage growlers, wherein said two beverage-dispensing hoses connect said two beverage growlers to said two multi-height spigots;

wherein one of said vibration-absorbing portable shell four sides is a front side, wherein said two multi-height spigots initially rest on said front side, wherein said two beverage-dispensing hoses are capable of quickly extending out of said front side for said two multi-height spigots to be raised and locked to said two spigot-locking receptacles of said retractable spigot-locking handle.

16. The cooler of claim 15, wherein said two multi-height spigots each have a lever pivotably attached thereto respectively, said levers are for hooking in said two spigot-locking receptacles of said retractable spigot-locking handle.

17. The cooler of claim 15, further comprising two spring-assisted reels attached to said vibration-absorbing portable vault for said two beverage-dispensing hoses to be wound thereon.

18. The cooler of claim 15, further comprising an axle rotatably attached to said vibration-absorbing portable shell, two wheels rotatably attached to said axle, and a plurality of wheel-vibration-absorbing circular springs molded on said two wheels to absorb transportation vibration respectively.

19. The cooler of claim 15, further comprising two foldable handles foldably attached to said vibration-absorbing portable shell for carrying the cooler.

* * * * *